US006235455B1

(12) United States Patent
Ito et al.

(10) Patent No.: US 6,235,455 B1
(45) Date of Patent: May 22, 2001

(54) SILVER HALIDE COLOR PHOTOGRAPHIC LIGHT SENSITIVE MATERIAL AND IMAGE FORMING METHOD BY USE THEREOF

(75) Inventors: Junji Ito; Kazuhiro Miyazawa, both of Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/553,311

(22) Filed: Apr. 20, 2000

(30) Foreign Application Priority Data

Apr. 26, 1999 (JP) ..... 11-117870
Jun. 21, 1999 (JP) ..... 11-173986
Sep. 6, 1999 (JP) ..... 11-251325

(51) Int. Cl.[7] ..... G03C 7/30
(52) U.S. Cl. ..... 430/362; 430/363
(58) Field of Search ..... 430/362, 363

(56) References Cited

U.S. PATENT DOCUMENTS 5,747,227 * 5/1998 Kawai ..... 430/363
5,792,597 * 8/1998 Kawai ..... 430/363
5,869,228 * 2/1999 Yokozawa ..... 430/363
5,982,988 * 11/1999 Suzuki ..... 395/109
5,998,105 * 12/1999 Murakoshi ..... 430/363
6,033,831 * 3/2000 Ikeda et al. ..... 430/363
6,043,020 * 3/2000 Ohtani ..... 430/363

* cited by examiner

*Primary Examiner*—Hoa Van Le
(74) *Attorney, Agent, or Firm*—Frishauf, Holtz, Goodman, Langer & Chick, P.C.

(57) ABSTRACT

The image forming method comprising the steps of subjecting a silver halide photographic light-sensitive material comprising an yellow image forming layer, a magenta image forming layer and a cyan image forming layer to scanning exposure with a light beam so that an exposure time is not more than $10^{-13}$ second per pixel, and developing the photographic material by a color developer, wherein the maximum exposure amount ($E_{max}$) is controlled by an output of a calibration patch, and a difference between the logarithm of the exposure amount necessary to give a density of 0.3 and the logarithm of $E_{max}$ is within the range of from 0.35 to 0.6 in each of the yellow, magenta and cyan image forming layers.

34 Claims, No Drawings

SILVER HALIDE COLOR PHOTOGRAPHIC LIGHT SENSITIVE MATERIAL AND IMAGE FORMING METHOD BY USE THEREOF

FIELD OF THE INVENTION

This invention relates to a silver halide color photographic light-sensitive material and an image forming method using the light-sensitive material.

BACKGROUND OF THE INVENTION

Recently, manipulating an image as digital data has increased considerably, increased accompanied with the progress in the operation rate of computers and related network technology. Image information digitized by a device such as a scanner can be easily edited or processed by computer and text data or an illustration can be added to the digitized information. Hard copy materials such as materials for sublimation thermal transfer printing, fusion thermal transfer printing, ink-jet printing, electrostatic transfer printing, thermo-autochrome printing and a silver halide photographic light-sensitive material, are usable for making a hard copy according to the digitized image information. Of these, the silver halide photographic light-sensitive material, hereinafter also referred to simply as light-sensitive material, is frequently used for making a high quality hard copy since the light-sensitive material is considerably superior to the other printing materials in sensitivity and exhibited excellent gradation and image storage ability.

Besides, many kinds of apparatus for imagewise exposing the sight-sensitive material utilizing the digitized image information have recently been developed. Typical examples 64 thereof include ones using a scanning exposure method in which a light source such as a light emission diode, a gas laser, a semiconductor laser or a second harmonic generated image by a combination such the light emission element and a SHG element is used. Such a digital exposing apparatus is preferable since the light-sensitive material is exposed in a shorter time at a higher resolution.

However, the wavelength of the light for exposing and the exposing time can vary over a wide range since a variety of light sources are used in the exposing apparatus. Accordingly, a light-sensitive material is required so that a high quality print can be stably obtained even when any type of exposing apparatus is used since the quality of the print varies depending on the exposing apparatus used.

For example, in a material widely used for printing a visual approval image, blurring and color mixing of the image often occur since such a light-sensitive material is designed to stably provide a high quality image when the material is exposed through a color negative film. Specifically, the majority of usual light-sensitive materials are designed based on a relatively long wavelength light of from 440 to 470 nm with respect to the blue-sensitive silver halide emulsion and the blue-light absorbing anti-irradiation dye. Therefore, deterioration in the sharpness of the yellow image component, formation of a yellow blur is exhibited around black fine lines of the image and mixing of magenta or cyan color into the yellow image often occurs, depending on the blue light exposing system of the digital exposing apparatus.

Besides, chances of outputting a detailed and complex image such as the fine lines of text or geometrical patterns are increased with the digitization of an image. There is a strong demand to reproduce such images at high fidelity and stability.

It has been widely known that adding an anti-irradiation dye or colloidal silver into a coated layer will prevent blurring of an image. However, the photographic sensitivity of the light-sensitive material is lowered and the whiteness of the background deteriorates with an increase of the amount of the dye, even though the effect of the dye is increased. Accordingly, the requirements to stably obtain a high quality image in various exposing apparatus is difficult to satisfy by such a method.

A method for improving tone reproductions of details in shadow portions by regulation of the point gamma in the high density regions is disclosed in Japanese Patent Publication Open for Public Inspection (hereinafter, also denoted as JP O.P.I.) No. 8-36247, and a method for improving the character quality by regulating the latitude and N value of the magenta color-forming layer is disclosed in JP O.P.I. No. 10-20461.

However, still further improvement is demanded since deterioration of the sharpness of yellow image and mixing of magenta and cyan color in the yellow image are occurred depending on the blue-light exposing system of the digital exposing apparatus even when the above-mentioned technology is applied.

An image, including an image based on photographic image data such as a portrait, a landscape and a still life, hereinafter referred to a image scene, and an image of text, particularly an image of fine black text, in combination occurs often since image information digitized by a device such as a scanner can be easily edited or processed via a computer and data for text or an illustration can be added to the information. In such an image, it is necessary to satisfy two requirements at the same time to naturally reproduce the scene image and to reproduce the text image with no blurring.

It is necessary that the light-sensitive material be exposed to light with the light amount varied based on the image data to reproduce the digitized image data as a silver halide photographic image. At the time of exposure, a calibration operation is carried out so that the image density reproduced on the print according to the image data agrees with the objective density. In such a case, blurring of the text image tends to form when calibration is carried out so that the scene image is naturally reproduced, particularly when the color and detail reproduction in the portion of midscale to high density is naturally reproduced, and the reproduction of the scene image tends to be unnaturally when the calibration is carried out so that blurring of the text image does not form. Accordingly, it is necessary to repeat the calibration by trial and error while varying the exposure condition to obtain suitable reproduction of both the scene image and the text image. It is essential to overcome this problem.

JP O.P.I. No. 9-171237 discloses a method for inhibiting blurring of the text image by regulating the maximum gamma and the fill-in $D_{max}$ by digital exposure to improve the sharpness of the image in a high density region. However, there is considerable deterioration of the image quality of character when a density exceeding the fill in $D_{max}$ is reproduced, and there is no description in this publication regarding the natural reproduction of the scene image. JP O.P.I. No. 10-20461 discloses a method for improving the quality of a text image by regulation of the dynamic range and the N value (degree of blurring). However, in such technology, the color balance in the edge portions of the text image tends to be lost in a high density region exceeding 2.0. It is demanded to improve such a problem.

Many kinds of digital image exposing apparatus are available in the market, and many kinds of apparatus are newly being developed accompanied with progress in light sources and controlling means. An apparatus using a generated light source having a sharp wavelength distribution, such as a laser or LED, is become the mainstream of digital image exposing apparatus. However, the kind of lasers or LEDs is not unified. Accordingly, the wavelength of the exposure light is often different for each apparatus. It has been found that a beautiful print without any blurring of the image in one exposing apparatus and blurring is tends to form in a high density region or unnatural reproduction of the scene tends to occur in another apparatus, which uses light of a different wavelength. Such a problem can be solved by optimizing the light-sensitive material for each of the apparatus. However, such is not practical to respond to the problem, since many kinds of digital exposing apparatus are available on the market, and it is expected that there will be a further increase in this kind of apparatus in the future. Under such conditions, an image forming method is demanded, whereby a beautiful print can be obtained using any exposure apparatus.

SUMMARY OF THE INVENTION

The object of the invention is to provide a silver halide color photographic light-sensitive material and an image forming method using the light-sensitive material by which a high print quality can be obtained stably and the blurring of specific color of fine lines and the mixing of magenta and cyan in the yellow image areas is inhibited even when any kind of exposing apparatus is used.

The object of the invention is to provided an image forming method in which a light-sensitive material is exposed to light based on digitized information of an image and developed. By such a method, the blur of fine line images is difficult, while the color reproducibility in the high and midscale density regions is maintained, which the variation of the fine line image reproducibility according to the variation of exposure and developing conditions, is inhibited and the color contamination is difficult to occur.

The above objects of the invention can be attained by the following 1 to 39.

1. An image forming method comprising the steps of subjecting a silver halide photographic light-sensitive material comprising a support having thereon an yellow color image forming layer, a magenta color image forming layer and a cyan color image forming layer each containing a silver halide emulsion to scanning exposure with a light beam so that an exposure time is not more than $10^{-3}$ second per pixel, and developing the photographic material by a color developer, wherein a maximum exposure amount (denoted as $E_{max}$) is controlled by an output of a calibration patch, and a difference between the logarithm of the exposure amount necessary to give a density of 0.3 (denoted as $E_{0.3}$) and the logarithm of $E_{max}$ is within the range of from 0.35 to 0.6 in each of the yellow, magenta and cyan image forming layers;

2. The image forming method described in 1, wherein in the yellow image forming layer exhibit a density given by the exposure of $E_{max}$ is not more than a limiting $D_{max}$ (denoted as $LD_{max}$);

3. The image forming method described in 2, wherein a mean gradation between the $LD_{max}$ and a density given by an exposure amount 0.1 higher by logarithm than the exposure amount giving a density of the $LD_{max}$ ($LE_{max}$) is within the range of from 1.5 to 4.0 in each of the yellow, magenta and cyan image forming layers;

4. The image forming method described in 2, wherein, in at least one of the yellow, magenta and cyan image forming layers, an exposure amount giving a density of the $LD_{max}$ ($LE_{max}$) is smaller than the $E_{max}$ and a ratio (γH/γL) of a mean gradation between the $LE_{max}$ and the $E_{max}$ (γH) to a mean gradation between an exposure amount giving a density of ½ of the $LTD_{max}$ (denoted as LhE) and the $LE_{max}$ (γL) is within the range of 0.35 to 0.9;

5. The image forming method described in 2, wherein an exposure amount giving a density of the $LD_{max}$ ($LE_{max}$) is smaller than the $E_{max}$ in each of the yellow, magenta and cyan image forming layers, a ratio (γLY/γLM) of a mean gradation between an exposure amount giving a density of ½ of the $LD_{max}$ (LhE) and the $LE_{max}$ in the yellow image forming layer (γLY) to a mean gradation between an exposure amount giving a density of ½ of the $LD_{max}$ (LhE) and the $LE_{max}$ in the magenta image forming layer (γLM) is within the range of 0.9 to 1.2, and a ratio (γLC/γLM) of a mean gradation between an exposure amount giving a density of ½ of the $LD_{max}$ (LhE) and the $LE_{max}$ (γLC) in the cyan-image forming layer to the γLM is within the range of 0.9 to 1.35;

6. The image forming method described in 1, wherein a ratio ($D_{max}R/D_{max}G$) of a red reflection density (denoted $D_{max}R$) to a green reflection density (denoted as $D_{max}G$) of a black image area formed by subjecting each of the yellow, magenta and cyan image forming layers to exposure of $E_{max}$ is within the range of from 1.02 to 1.18, and a ratio ($D_{max}B/D_{max}G$) of a blue reflection density (denoted as $D_{max}B$) to $D_{max}G$ is within the range of 0.85 to 1.0;

7. The image forming method described in 1, wherein a black image area formed by subjecting each of the-yellow, magenta and cyan image forming layers to an exposure of $E_{max}$ exhibits an L* value of 12±4, an a* value of −1±2, a b* value of −5±2 and an (a*+b*) value of −6±2 in 1976 CIE L*a*b* color space;

8. The image forming method described in 1, wherein a ratio ($LD_{max}R/LD_{max}G$) of a red light reflection density ($LD_{max}R$) to a green light reflection density ($LD_{max}G$) of the black image area formed by subjecting each of the yellow, magenta and cyan image forming layers to an exposure of $LE_{max}$ giving a limiting $D_{max}$ ($LD_{max}$) is within the range of 1.02 to 1.18, and a ratio ($LD_{max}B/LD_{max}G$) of a blue light reflection density ($LD_{max}B$) to ($LD_{max}G$) is within the range of 0.85 to 1.0;

9. The image forming method-described in 1, wherein a black image area formed by subjecting each of the yellow, magenta and cyan image forming layers to an exposure of $LE_{max}$ giving a limiting $D_{max}$ ($LD_{max}$) exhibits an L* value of 15±4, an a* value of −1±2, a b* value of −5±2 and an (a*+b*) value of −6±2 in 1976 CIE L*a*b* color space;

10. The image forming method described in 1, wherein at least one of the color image forming layers comprises a silver halide emulsion containing silver halide grains which are spectrally sensitized with at least two sensitizing dyes each exhibiting an absorption maximum different in wavelength by not less than 40 nm from each other;

11. The image forming method described in 10, wherein said silver halide grains are blue-sensitive;

12. The image forming method described in 1, wherein at least one of the yellow, magenta and cyan image forming layers comprises a silver halide emulsion containing silver halide grains having an average chloride content of not less than 95 mol %; and an exposure amount ($E_{max}\lambda$) necessary to give the maximum density ($D_{max}$) with light at a wavelength of λ nm is formulated by the following equation (1):

$$S_\lambda = -\log(E_{max}\lambda) \quad (1)$$

wherein a difference between a maximum value of $S_\lambda$ and a minimum value of $S_\lambda$ at the wavelengths of from 400 nm to 490 nm is not more than 1.3;

13. The image forming method described in 12, wherein an average value of $S_\lambda$ over the range of from 400 to 490 nm ($S_B$) and a value of $S_\lambda$ at a wavelength of 470 nm ($S_{470}$) satisfy the following requirement (2):

$$|S_{470}-S_B|\leqq 0.55 \quad (2);$$

14. The image forming method described in 12, wherein an average value of $S_\lambda$ over the range of from 400 to 490 nm ($S_B$) and an average value of $S_\lambda$ over the range of 510 to 570 nm ($S_G$) satisfy the following requirement (3):

$$|S_B/S_G|\leqq 0.55 \quad (3);$$

15. The image forming method described in 12, wherein $S_\lambda$ and a spectral reflective density ($D_\lambda$) at a wavelength of λ nm are formulated by the following equation (4):

$$SD_\lambda=D_\lambda+S_\lambda \quad (4)$$

wherein a difference between a maximum value of $SD_\lambda$ and a minimum value of $SD_\lambda$ over the range of from 400 nm to 490 nm is not more than 0.9;

16. The image forming method described in 15, wherein an average value of $SD_\lambda$ over the wavelength range of 400 to 490 nm ($SD_B$) and $SD_{470}$ which is $SD_\lambda$ at a wavelength of 470 nm satisfy the following requirement (5):

$$|SD_{470}-SD_B|\leqq 0.49 \quad (5);$$

17. The image forming method described in 15, wherein an average value of $SD_\lambda$ over the wavelenth range of from 400 to 490 nm ($SD_B$) and an average value of $SD_\lambda$ over the wavelenth range of 510 to 570 nm (SDG) satisfy the following requirement (6):

$$|SD_B/SD_G|\leqq 0.3 \quad (6);$$

18; The image forming meth od described in 12, wherein a difference between a maximum value of $S_\lambda$ and a minimum value of $S_\lambda$ is not more than 1.1;

19. The image forming method described in 13, wherein $S_{470}$ and $S_B$ satisfy the following requirement (7):

$$|S_{470}-SD_B|\leqq 0.5 \quad (7);$$

20. The image forming method described in 14, wherein $S_B$ and $S_G$ satisfy the following requirement (8):

$$|S_B/S_G|\leqq 0.44 \quad (8);$$

21. The image forming method described in 15, wherein a difference between a maximum value of $S_\lambda$ and a minimum value of $S_\lambda$ is not more than 0.75;

22. The image forming described in 16, wherein $SD_{470}$ and SDB satisfy the following requirement (9):

$$|SD_{470}-SD_B|\leqq 0.45 \quad (9);$$

23. The image forming method described in 17, wherein $SD_B$ and $SD_G$ satisfy the following requirement (10):

$$|SD_B/SD_G|\leqq 0.18 \quad (10);$$

24. The image forming method described in any of 1 to 23, wherein the light beam comprises a blue light emitted from a semiconductr laser emitting light of a wavelength of 390 to 430 h or a combination of a semiconductor laser and a second harmonic generation element (SHG element);

25. The image forming method described in 1, wherein at least one of the color image forming layers comprises a silver halide emulsion containing silver halide grains having an average chloride content of not less than 95 mol % and which are spectrally sensitized with a first sensitizing dye represented by formula 1 and a second sensitizing dye exhibiting a spectral absorption maximum at a wavelength of 380 to 430 nm when the dye is added a silver halide emulsion having an average chloride content of silver chloride of not less than 95 mol % and a pAg value of 6.0 to 7.7:

Formula 1

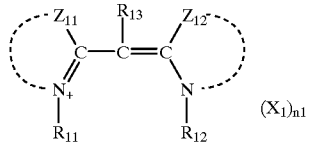

wherein $Z_{11}$ and $Z_{12}$ are each independently a group of non-metallic atoms necessary to form a benzothiazole ring, a naphthothiazole ring, a benzoselenazole ring, a naphthoselenazole ring, a benzimidazole, a naphthoimidazole, a benzoxazole or a naphthoxazole; $R_{11}$ and $R_{12}$ are each independently an alkyl group, an alkenyl group or an aryl group, $R_{13}$ is a hydrogen atom, a fluorine atom, a methyl group or an ethyl group; $X_1$ is a counter ion necessary to neutralize the charge, n1 is an integer of 0 or more necessary to neutralize the intramolecular charge; and one of $Z_{11}$ and $Z_{12}$ is naphthothiazole ring or a naphthoselenazole ring when another one of $Z_{11}$ and $Z_{12}$ is a benzimidazole ring or a benzoazole ring;

26. The image forming method described in 25, wherein the second sensitizing dye is represented by Formula 2:

Formula 2

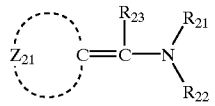

wherein $Z_{21}$ is a group of non-metallic atoms necessary to form a rhodanine ring, a 2-thiohydantoine ring, a 2-thiooxazoline-2,4-dione ring, a 2-thioselenazoline-2,4-dione ring, a barbituric acid ring, a 2-thiobarbituric acid ring or a 2-pyrazoline-5-one ring; $R_{21}$, $R_{22}$ and $R_{23}$ are each a hydrogen atom, an alkyl group, an alkenyl group or an aryl group, and $R_{21}$, $R_{22}$ and $R_{23}$ may form a ring structure by bonding with each other;

27. The image forming method described in 25, wherein the second sensitizing dye is represented by Formula 3:

Formula 3

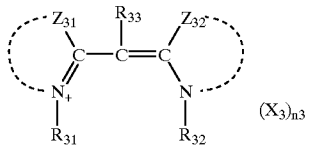

wherein $Z_{31}$ is a group of non-metallic atoms necessary to form a thiazole ring, a thiazoline ring, a thiazolidine ring, a benzothiazole ring, a naphthothiazole ring, a selenazole ring, a selenazoline ring, a selenazolidine ring, a benzoselenazole ring, a naphthoselenazole ring, an oxazole ring, an oxazoline ring, an oxazolidine ring, a benzoxazole ring, a naphthoxazole ring, an imidazole ring, an imidazoline ring, an imidazolidine ring, a benzimidazole ring, a naphthimidazole ring, a pyrrole ring, a pyrroline ring, a pyrrolidine ring, an indole ring, a pyridine ring or a quinoline ring; $Z_{32}$ is a group of non-metallic atoms necessary to form a pyrrole ring, a pyrroline ring, a pyrrolidine ring or an indole ring; $R_{31}$ and $R_{32}$ are each an alkyl group, an alkenyl group or an aryl group, $R_{33}$ is a hydrogen atom, a fluorine atom, a methyl group or an ethyl group; $X_3$ is a counter ion necessary to neutralize the charge and n3 is an integer on 0 or more necessary to neutralize the intramolecular charge;

28. The image forming method described in 25, wherein the second sensitizing dye is represented by Formula 4:

Formula 4

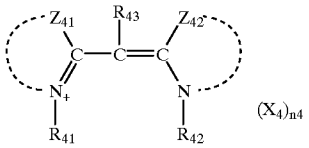

wherein $Z_{41}$ and $Z_{42}$ are each a group of non-metallic atoms necessary to form a thiazole ring, a thiazoline ring, a thiazolidine ring, a benzothiazole ring or a naphthothiazole ring, at least one of $Z_{41}$ and $Z_{42}$ is a thiazole ring, a thiazoline ring or a thiazolidine ring; $R_{41}$ and $R_{42}$ is an alkyl group, an alkenyl group or an aryl group, $R_{43}$ is a hydrogen atom, a fluorine atom, a methyl group or an ethyl group; $X_4$ is a counter ion necessary to neutralize the charge and n4 is an integer on 0 or more necessary to neutralize the intramolecular charge;

29. The image forming method described in 25, wherein the second sensitizing dye is represented by Formula 5:

Formula 5

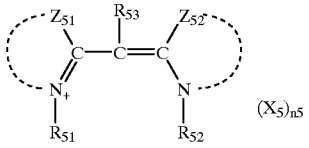

wherein $Z_{51}$ and $Z_{52}$ are each a group of non-metallic atoms necessary to form a thiazole ring, a thiazoline ring, a thiazolidine ring, a benzothiazole ring, a naphthothiazole ring, an oxazole ring, an oxazoline ring, an oxazolidine ring, a benzoxazole ring or a naphthoxazole ring, and at least one of $Z_{51}$ and $Z_{52}$ is an oxazole ring, an oxazoline ring, an oxazolidine ring, a benzoxazole ring or a naphthoxazole ring; $R_{51}$ and $R_{52}$ are each an alkyl group, an alkenyl group or an aryl group, $R_{53}$ is a hydrogen atom, a fluorine atom, a methyl group or an ethyl group; $X_5$ is a counter ion necessary to neutralize the charge and n5 is an integer on 0 or more necessary to neutralize the intramolecular charge; provided that when at least one of $Z_{51}$ and $Z_{52}$ is a naphthoxazole ring, another one is not a naphthoxazole ring, a naphthothiazole ring and benzothiazole ring, and when at least one of $Z_{51}$ and $Z_{52}$ is a naphthothiazole ring, another one is not a benzoxazole ring;

30. The image forming method described in 25, wherein the second sensitizing dye is represented by Formula 6:

Formula 6

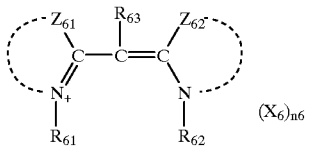

wherein $Z_{61}$ and $Z_{62}$ are each a group of non-metallic atoms necessary to form a thiazole ring, a thiazoline ring, a thiazolidine ring, a benzothiazole ring, a naphthothiazole ring, a selenazole ring, a selenazoline ring, a selenazolidine ring, a benzoselenazole ring, a naphthoselenazole ring, an imidazole ring, an imidazoline ring, an imidazolidine ring, a benzimidazole ring, a naphthoimidazole ring, an oxazole ring, an oxazoline ring, an oxazolidine ring, a benzoxazole ring or a naphthoxazole ring, and at least one of $Z_{61}$ and $Z_{62}$ is an imidazole ring, an imidazoline ring, an imidazolidine ring, a benzimidazole ring or a naphthimidazole ring; $R_{61}$ and $R_{62}$ is an alkyl group, an alkenyl group or an aryl group, and $R_{63}$ is a hydrogen atom, a fluorine atom, a methyl group or an ethyl group; $X_6$ is a counter ion necessary to neutralize the charge and n6 is an integer on 0 or more necessary to neutralize the intramolecular charge; provided that when at least one of $Z_{61}$ and $Z_{62}$ is a naphthoimidazole ring, another one is not a naphthoxazole, a benzothiazole, a naphthothiazole, a benzoselenazole, a naphthoselenazole and a naphthoimidazole, and when at least one of $Z_{51}$ and $Z_{52}$ is a naphthothiazole ring or a naphthoselenazole ring, another one is not a benzimidazole ring;

31. The image forming method described in 25, wherein said second sensitizing dye is represented by Formula 7, Formula 7

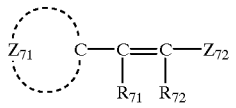

wherein $Z_{71}$ is a group of non-metallic atoms necessary to form a thiazole ring, a thiazoline ring, a thiazolidine ring, a benzothiazole ring, a naphthothiazole ring, an oxazole ring, an oxazoline ring, an oxazolidine ring, a benzoxazole ring, a naphthoxazole ring, a selenazole ring, a selenazoline ring, a selenazolidine ring, a benzoselenazole ring, a naphthoselenazole ring, an imidazole ring, an imidazoline ring, an imidazolidine ring, a benzimidazole ring, a naphthoimidazole ring, a pyrrole ring, a pyrroline ring, a pyrrolidine ring, an indole ring, a pyridine ring or a quinoline ring, and $Z_{72}$ is a phenyl group, a cyclohexyl group, a furyl group, a pyrazolyl group or an amino group; and $R_{71}$ and $R_{72}$ are each a hydrogen atom, an alkyl group, an alkenyl group or an aryl group;

32. The image forming method described in 25, wherein said second sensitizing dye is represented by Formula 8:

Formula 8

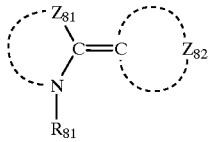

wherein $Z_{81}$ is a group of non-metallic atoms necessary to form a thiazoline ring, a thiazolidine ring, a selenazoline ring, a selenazolidine ring, a oxazoline ring, an oxazolidine ring, an imidazoline ring, an imidazolidine ring, a pyrroline ring or a pyrrolidine ring; $Z_{82}$ is a group of non-metallic atoms necessary to form a rhodanine ring, a 2-thiohydantoine ring, 2-thiooxazoline-2,4-dinoe ring, a 2-thioselenazoline-2,4-dione ring, a barbituric acid ring, a 2-thiobarbituric acid ring or a 2-pyrazoline-5-one ring; and $R_{81}$ is an alkyl group, an alkenyl group or an aryl group;

33. The image forming method described in 25, wherein the second sensitizing dye is represented represented by Formula 9:

Formula 9

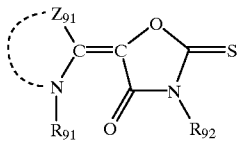

wherein $Z_{91}$ is a group of non-metallic atoms necessary to form a benzoxazole ring, a naphthoxazole ring, a a benzimidazole ring, a naphthoimidazole ring, an indole ring, a benzindole ring, a pyridine ring or a quinoline ring; and $R_{91}$ and $R_{92}$ are each an alkyl group, an alkenyl group or an aryl group;

34. The image forming method described in 25, wherein said second sensitizing dye is represented by Formula 10:

Formula 10

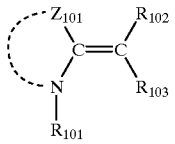

wherein $Z_{101}$ is a group of non-metallic atoms necessary to form a thiazoline ring, a thiazolidine ring, a benzothiazole ring, a naphthothiazole ring, an oxazoline ring, an oxazolidine ring, a benzoxazole ring, a naphthoxazole ring, a selenazoline ring, a selenazolidine ring, a benzoselenazole ring, a naphthoselenazole ring, an imidazoline ring, an imidazolidine ring, a benzimidazole ring, a naphthimidazole ring, a pyrroline ring, a pyrrolidine ring, an indole ring, a pyridine ring or a quinoline ring; $R_{101}$ is an alkyl group, an alkenyl group or an aryl group, and $R_{102}$ and $R_{103}$ are each a hydrogen atom, an alkyl group, an alkenyl group or an aryl group; and $R_{102}$ and $R_{103}$ may be bonded to form a ring structure other than a rhodanine ring, a 2-thiohydantoine ring, a 2-thiooxazoline-2,4-dinoe ring, a 2-thioselenazoline-2,4-dione ring, a barbituric acid ring, a 2-thiobarbituric acid ring and a 2-pyrazoline-5-dione ring.

DETAILED DESCRIPTION OF THE INVENTION

The image forming methods described above are further described in detail below. The image forming methods described above are each characterized in that the maximum exposure light amount ($E_{max}$) is controlled by the output of a calibration patch and the difference of the logarithm of exposure amount ($E_{0.3}$) necessary to form a reflective density of 0.3 and the logarithm of $E_{max}$ is within the range of from 0.35 to 0.6 in each of the yellow-, magenta- and cyan-image forming layers. The logarithm is the common logarithm to the base 10.

Generally, an original image is divided into fine squares and the density information of each of the squares is digitized, when image information is handled in digitized data. In this invention, the minimum unit of the divided squares which the original image is divided into is defined as a pixel. Accordingly, the exposure time per pixel corresponds to the time in which the intensity or the exposure time is controlled by the digitized data of indivisual pixels.

Scanning exposure by a light beam is generally carried out by a combination of line exposure by a light beam (luster exposure: main scanning) and the motion of the light-sensitive material in the direction perpendicular to the direction of the line exposure (i.e., subscanning). For example, is frequently used a drum method in which the light-sensitive material is fixed on the periphery or on the inner periphery of a cylindrical drum, and the drum is rotated while irradiated with a light beam to carry out the main scanning, and at the same time, the light source is moved perpendicularly to the rotating direction of the drum to carry out the subscanning, and a polygon mirror method in which a light beam is irradiated onto a rotating polygon mirror to scan the light-sensitive material by the light beam reflected by the polygon in the horizontal direction of rotation of the polygon mirror (main scanning) so that the light-sensitive material is transported in the perpendicular direction to the rotation direction of the polygon mirror to carry out the subscanning. When an exposure apparatus is used in which light sources are arranged in an array, it is regarded that the main scanning device is replaced by the light source array. Therefore, the exposure by such an apparatus can be included in the scanning exposure of the invention.

The $E_{max}$ is defined as the exposure amount when the exposure is carried out based on data representing the maximum density in the image data, for example, the image data of (R,G,B)=(0,0,0) correspond to the maximum density data in the image data having 8 bit gradation, as processed by PhotoShop, Adobe System Co., Ltd.

The $E_{0.3}$ is defined as the exposure amount to each of the color forming layers necessary to form a gray patch image having Status A reflective density of (R,G,B)=(0.30, 0.30, 0.30).

When the difference of the logarithm of $E_{0.3}$ and the logarithm of $E_{max}$ is larger than 0.6, the blurring tens to form at the edges of indivisual text character images and when the difference is smaller than 0.35, unnatural reproduction in the midscale density to high density regions of the scene image tends to occur. Moreover, when all of the yellow-, magenta- and cyan-image forming layers do no satisfy the above-mentioned condition, color blurring tends to form at the edges of indivisual text character image and the color reproducibility at the midscale to high density regions of a scene image tends to be lowered.

One of embodiments of the inventions is characterized in that the maximum exposure amount at the time of image formation (denoted as $E_{max}$) is controlled according to the output of a calibration patch, and at least in the yellow-image forming layer, the image density formed by the exposure of $E_{max}$ is not more than a limiting maximum density (hereinafter, denoted as a limiting $D_{max}$ or simply as $LD_{max}$) The limiting $D_{max}$ (or $LD_{max}$) is defined as the density of the output of a solid monochromatic patch exposed to the maximum exposure amount (LE.) within the range of the exposure amount in which the half width of a fine line is substantially not varied when a monochromatic fine line having one pixel width is output while varying the exposure amount under an image output condition of resolution of 200 dpi or 600 dpi (in the invention, the dpi is defined as a printing density of one dot per inch or 2.54 cm). Regarding the yellow image forming layer, the blue reflection density component in a Status A density of the solid yellow patch image is defined as $LD_{max}$ (herein, the blue reflection density means a reflection density measure with blue light). Regarding the magenta image forming layer and the cyan image forming layer, the green reflective density component and the red reflective density component are defined as the $LD_{max}$, respectively (herein, the green reflection density and the red reflection density also mean reflection densities measured with green light and red light, respectively). Exemplarily, the $LD_{max}$ can be determined by the following procedure. A combination of image data light is prepared for each of the yellow-, magenta- and cyan-image, by which a monochromatic fine line image having one pixel width and a solid monochromatic patch image for densitometry can be output with the same intensity. Test charts are outputted using the image data (exposure and development), while the exposure amount is varied stepwise by the difference of approximately 0.1 of the logarithm value. The exposure amount can be varied by inserting a filter in the optical system between the light source and the light-sensitive material. The exposure amount can also be varied by optimally changing the image data when the exposure apparatus has a conversion table (LUT) showing a correspondence between the image data and the exposure light amount.

On the thus obtained test chart, the Status A reflection density of the solid monochromatic patch is measured and the density profile of the fine line image is measured by scanning in the direction of perpendicular to the direction of the fine line using a microdensitometer, PDM-5AR manufactured by Konica Corp. with a blue, green or red Wratten Filter. Base on the density profile of the fine line image, the half width of the fine line image (the distance between the points having a half value of the density of the maximum density of the profile) is determined, and a graph is prepared, showing the relation of the half value width of the fine line image and density of the solid color patch image. In the graph, the half width of the fine line image is plotted in approximately parallel to the X-axis since the half width of the fine line image is substantially constant in the region of relatively low density of the patch image. However, the half width of the fine line image is increased with an increase in the density of the patch image when the density of the patch image exceeds a certain value, and the plotted curve assumes to have a gradient to the X-axis. The density of the patch image corresponding to such an inflection point of the plotted curve is the limiting $D_{max}$ (or $LD_{max}$), and the exposure amount giving the density of $LD_{max}$ is defined as the $LE_{max}$. When the inflection point does not appear on the graph, it is contemplated that the maximum exposure amount in the chart preparation procedure is lowerer than the $LE_{max}$. In this case, the $LD_{max}$ and $LE_{max}$ can be determined by repeating the output of the test chart, followed by measurement by increasing the maximum exposure amount.

In the yellow image forming layer, the yellow blurring at the fringe of black text character image rarely occurs and a high quality print can be prepared when the density obtained by the exposure by the amount of $E_{max}$ is less than the $LD_{max}$ value.

One of embodiments of the invention is characterized in that the maximum exposure amount at the time of forming images ($E_{max}$) is controlled by output of a calibration patch and the mean gradation between a density of the limiting $D_{max}$ ($LD_{max}$) and a density obtained by the exposure amount 0.1 higher by logarithm than the exposure for forming the density of $LD_{max}$ ($LE_{max}$) is within the range of 1.5 to 4.0. The $LD_{max}$ and the $LE_{max}$ can be determined by the above-mentioned procedure. Alternatively, the same chart is outputted by exposure to the amount of light higher by 0.1 of the logarithm than the $LE_{max}$ to measure the density of the solid monochromatic patch image. The mean gradation can be determined by dividing the difference of the thus measured density and the density of $LD_{max}$ by the difference of the exposure amount. When the mean gradations in each of the yellow, magenta and cyan image forming layers are within the above-mentioned range, a high quality textured images can be maintained since the width of blurring of the black text character image is relatively small and color balance is rarely lost, and the discontinuity of density and tone are difficultly formed in the range of the midscale to high density areas of the scene image. Thus prints having good quality can be obtained.

One embodiment of the invention is characterized in that the maximum exposure amount for forming an image is controlled by the output of a calibration patch, and in at least one color image forming layer, the exposure ($LE_{max}$) necessary for forming the limiting $D_{max}$ ($LD_{max}$) is less than $E_{max}$, and the ratio of $\gamma H/\gamma L$ is 0.35 to 0.9 in the color image forming layer, in which $\gamma H$ is the mean gradation between $LE_{max}$ and $E_{max}$ and $\gamma L$ is the mean gradation between the exposure amount necessary to form a density of ½ of the density of $LD_{max}$ (denoted as LhE) and the $LE_{max}$. The $LD_{max}$ and $LE_{max}$ can be determined by the afore-mentioned procedure, and the LhE can be determined by plotting a graph showing the relationship between the exposure light amount and the density of the solid monochromatic patch. When the above-mentioned conditions are satisfied, the contrast of the outline of black fine line text image is high and relatively high quality text images can be maintained even though the conditions are disadvantageous from the point of view of the blurring width of the black fine line text image, and a print having good reproducibility in the midscale to high density areas of the scene image can be obtained.

One embodiment of the invention is characterized in that the maximum exposure light amount for forming an image is controlled by the output of a calibration patch, the exposure ($LE_{max}$) necessary to form the limiting $D_{max}$ ($LD_{max}$) is less than $E_{max}$ in each of the yellow, magenta and cyan color image forming layers, and the ratio of $\gamma LY/\gamma LM$ is within the range of from 0.9 to 1.2, in which $\gamma LY$ is the mean gradation between the exposure amount necessary to for a density of ½ of the $LD_{max}$ (LhE) to the $LE_{max}$ in the yellow color image forming layer, and $\gamma LM$ is the mean gradation between the exposure amount (LhE) necessary to for a density of ½ of the $LD_{max}$ and the $LE_{max}$ in the magenta color image forming layer, and the ratio of $\gamma LC/\gamma LM$ is within the range of from 0.9 to 1.35, in which $\gamma LC$ is the mean gradation between the exposure amount necessary to for a density of ½ of the $LD_{max}$ (LhE) and the $LE_{max}$ in the cyan color image forming layer. The $LD_{max}$, $LE_{max}$, and LhE can be determined by the foregoing procedures. When the above-mentioned conditions are satisfied, relatively high quality text images can be maintained even though the conditions are disadvantageous from the point of view of the blurring width of the black fine line character image since the $LD_{max}$ is less than the $E_{max}$ and color aberration at the edges of the black fine line text rarely occurs, and a print having good reproducibility in the midscale to high density areas of the scene image can be obtained.

One embodiment of the invention is characterized in that the maximum exposure light amount for forming an image is controlled by the output of a calibration patch, the ratio ($D_{max}R/D_{max}G$) of the red reflection density $D_{max}R$ to the green reflection density in the black image formed by exposure of each of the yellow, magenta and cyan image forming layers to light of the $E_{max}$ is within the range of from 1.02 to 1.18, and the ratio ($D_{max}B/D_{max}G$) of the blue reflection density $D_{max}B$ to the $D_{max}G$ is within the range of from 0.85 to 1.0. The reflection density is a Status A reflection density. When the above-mentioned conditions are satisfied, the color aberration at the edge portions of black fine line text images (particularly black text images constituted by image data corresponding to the maximum density) is small and good text quality can be maintained even under a condition for making a good quality image in the high density area (such as the black portion of a tuxedo).

One embodiment of the invention is characterized in that the maximum exposure amount to form an image is controlled by the output of a calibration patch, and the black image formed by exposure of the yellow, magenta and cyan color image forming layers to light of $E_{max}$ satisfies the conditions that the value of L* is 12±4, the value of a* is −1±2, the value of b* is −5±2 and the value of (a*+b*) is −6±2 in 1976 CIE L*a*b* color space. These calorimetric values are well known metrics in the CIE System (International Commission on Illumination), and their derivation is discussed at length in many texts on color science. When the above-mentioned conditions are satisfied, the color aberration at the edge portions of black fine line text image (particularly black text image constituted by image data corresponding to the maximum density) rarely occurs and good text quality can be maintained even under a condition for making good quality image in the high density areas.

One embodiment of the invention is characterized in that the maximum exposure amount to form images is controlled by the output of a calibration patch, the ratio ($LD_{max}R/LD_{max}G$) of the red reflection density ($LD_{max}R$) to the green reflection density ($LD_{max}G$) of a black image area formed by exposure of the yellow, magenta and cyan color image forming layer to an amount of light of the $LE_{max}$ necessary to form the limiting $D_{max}$ ($LD_{max}$) in each of the color image forming layers is within the range of 1.02 to 1.18, and the ratio ($LD_{max}B/LD_{max}G$) of the blue reflection density $LD_{max}B$ to the $LD_{max}G$ is within the range of 0.85 to 1.0. The $LD_{max}$ and the $LE_{max}$ can be determined by the foregoing procedure. In cases when $LE_{max}$ is larger than $E_{max}$, the reflection density (Dm,,) of the black image formed by the maximum exposure amount to form images is used as the value of $LD_{max}$. When the above-mentioned conditions are satisfied, the color aberration at the edge portions of black fine line text image (particularly achromatic text image constituted by image data corresponding to the maximum density to the midscale density) rarely occurs and good text quality can be maintained even under a condition for achieving good quality of image in high density areas.

One embodiment of the invention is characterized in that the maximum exposure light amount for forming an image is controlled by the output of a calibration patch, and the black image area formed by exposing to the amount of light ($LE_{max}$) necessary to form the limiting $D_{max}$ ($LD_{max}$) in each of the yellow, magenta and cyan color-image forming layer satisfies the conditions that the value of L* is 15±4, the value of a* is −1±2, the value of b* −5±2 and the value of (a*+b*) is −6±2 in 1976 CIE L*a*b* color space. The $LD_{max}$ and the $LE_{max}$ can be determined by the foregoing procedures. In cases where $LE_{max}$ is larger than $E_{max}$, the reflection density ($D_{max}$) of the black image area formed by the maximum exposure amount for image formation is used as the value of $LD_{max}$. When the above-mentioned conditions are satisfied, the color aberration at the edge portions of black fine line text image (particularly achromatic text image constituted by image data corresponding to the maximum density to the midscale density) rarely occurs and good text quality can be maintained even under a condition for achieving a good quality image in high density areas.

Any known light source can be used in the image forming apparatus to utilize the image forming method according to the invention. Examples of light sources include a light emission diode (LED), a gas laser, a semiconductor laser (LD), a combination of LD or a solid laser using a LD as the exciting light source and a second harmonics generating element (so-called SHG element), a combination of a tungsten light and a band pass filter, a combination of a halogen lamp, a PLZT element and a color filter, and a combination of a VFPH element and a color filter. A blue light source having a wavelength of 400 to 450 nm was energetically *developed to be utilized mainly in the high density recording on a photodisk such as a digital video disk (DVD), and application of such elements to light sources for the exposure is studied at the present. For example are known a combination of a semiconductor laser emitting light having a wavelength of 800 to 900 nm such as GaAs type and a second harmonics generation (SHG) element such as an inorganic crystal of a $LiNbO_3$ type or a $LiTaO_3$ type or an organic crystal such as 2-methyl-4-nitroaniline, a blue light emission semiconductor laser using a InGa type material which emits light of a wavelength of from 380 to 430 nm, a scintillator and a dye laser using a coumalin dye. Of these, the combination of a solid laser and the SHG and the semiconductor lasers each emitting light of a wavelength of 380 to 430 nm are particularly preferable as the light source in the invention since the overlapping the spectral sensitivity distribution of the green-sensitive layer is somewhat smaller compared with a light source of 431 to 480 nm. Accordingly, unnecessary color formation in the green-sensitive layer can be reduced even when the intensity of blue-light on the surface of the light-sensitive material is increased and blurring of yellow image can be inhibited by reducing the light scattering in the support.

There is no specific limitation to the means for satisfying the essential condition of the invention. For example, such means include suitable control of the characteristics of the light-sensitive silver halide contained in the light-sensitive material, suitable control of the amount of light-sensitive silver halide, coupler or Th anti-irradiation dye, and suitable control of the objective A value of the reproduced density on the print constituted by the digitized data corresponding to the maximum density, which is set according to the obtained calibration, and a combination of such means.

Any of known spectral sensitizing dyes can be used for spectral sensitizing the silver halide emulsion to be used in the light-sensitive material relating to the invention. Known monomethine cyanine compounds and the compounds described in British Patent No. 447,038 are preferably used a s the blue-sensitizing dye. It is preferred that at least two kinds of blue-sensitizing dye each having the maximum spectral sensitive wavelength ($\lambda_{max}$) different not less than 40 nm from each other are used in combination to make a suitable difference in the sensitivity from that of the green-sensitive layer and to reduce the blur of yellow image which is caused by light scattering in the support. Dyes GS-1 through GS-5 described in the same publication are preferably used as the green-sensitizing dye and Dyes RS-1 through RS-8 described in the same publication are preferably used as the red-sensitizing dye. An infrared-sensitizing dye is necessary when the image wise exposure is carried out by infrared rays using a semiconductor laser. Dyes IRS-1 through IRS-11 described on 6 through 8 pages of JP O.P.I. No. 4-285950 are preferably used as the infrared-sensitizing dye. Moreover, it is preferable that the infrared-, red-, green- or blue-sensitizing dye is used together with a compound such as the super sensitizers SS-1 through SS-9 described on pages 8 through 9 of JP O.P.I. No. 4-285950 and the compound S-1 through S-17 described on pages 15 through 17 of JP O.P.I. No. 5-66515. When the sensitizing dyes are used in combination, it may be allowed to add two or more kinds of the dye into one silver halide emulsion, to mix two or more kinds of silver halide emulsion each sensitized by different kinds of sensitizing dye, or to combine such the methods.

The sensitizing dye may be added at an optional period from the silver halide grain formation to the finish of chemical sensitization.

The sensitizing dye may be added in a form dissolved in a water-miscible solvent such as of methanol, ethanol, fluorinated alcohol and acetone or in water. The sensitizing dye may also added in a form of dispersion of solid particles. The adding method using no water-miscible solvent is preferred from the viewpoint of the protection of the environment.

The foregoing 12 to 24 relating to the invention will Abe further described below. one embodiment of the invention is characterized in that the value of $S_\lambda$ calculated by the foregoing Formula (1) based on the exposure light amount $E_{max}\lambda$ necessary to form the maximum density ($D_{max}$) by light of wavelength of $\lambda$ (nm) in the image forming method comprising the step of imagewise exposing to light a light-sensitive material for a time of not more than $10^{-3}$ seconds per pixel according to image information digitized by blue, green and red light each different in the wavelength and the step of developing the light-sensitive material.

The $D_{max}$ is defined as a reflection Status A density formed by exposed to light according to data corresponding to the maximum density in the image data of 8 bit gradation processed by PhotoShop of Adobe System (for example, (R,G,B)=(0,0,0) is the image data corresponding the maximum density), and $E_{max}$ is the light amount giving to the light sensitive material in this case and log($E_{max}$) in Expression 1 is the common logarithm of $E_{max}$. Accordingly, the value of $D_{max}$ is not necessary to agree with the reflection density obtained by developing the light-sensitive material exposed for a satisfactorily long time to white light (hereinafter referred to black ground density). The value of $D_{max}$ is frequently set at a value somewhat lower than the black ground density from the viewpoint of reproducibility of the outputted image, the maximum output of the light source used for exposure, the capability of processing and operation of the light source controlling apparatus. It is preferred that the red, green and blue reflection density of the gray patch are each respectively not lower than 2.1, even though the value of $D_{max}$ may be optionally set. In such a case, the image in the shadow area of a scenic image is made clear and the outline of fine image such as text image also clearly appears so that the sharpness of the overall image is suitably reproduced.

In the invention, the intensity of the exposure on the surface of recording material is an exposure intensity per unit area and the beam diameter and the beam strength can be measured by inserting a beam monitor composed of a combination of a beam slit and a power meter into the path of the exposing light, so that the exposure intensity can be conducted from the results of the measurement. The beam diameter is the diameter of the light beam at the point at which the strength of the light beam is become to $e^{-2}$.

Accordingly, the exposure amount per pixel can be calculated by the product of the exposure light intensity and the exposure time. In the invention the exposure light amount is a light amount per pixel.

Any of the several known light sources such as a light emission diode LED), a gas laser, a semiconductor laser (LD), and a combination of a solid laser exited by a semiconductor laser and a second harmonics generation element (so-called SHG element), may be used as the light source in the invention. As the source of blue light, one generating-light having a wavelength of from 390 nm to 430 nm is preferred and light generated by the semiconductor laser and light of second harmonics generated by the combination of a semiconductor laser or solid laser and a SHG element each having a wavelength of from 390 nm to 430 nm is preferable'since the optical color mixing is hardly occurred and a stable image density can be obtained easily. A light source generating light having a wavelength of from 510 nm to 570 nm is preferable for the green light source and a light source generating light having a wavelength of from 620 nm to 710 nm is preferable for the red light source.

In embodiments of the invention, the relationship between SB (an average value of $S_\lambda$ within the wavelength region of from 400 to 490 nm) and $S_{470}$ ($S_\lambda$ when the wavelength of the exposure light is 470 nm) and the relationship and SG (an average value of $S_\lambda$ within the wavelength region of from 510 to 570 nm) are defined.

The average value of $S_\lambda$ within the foregoing wavelength region can be obtained by determining the $S_\lambda$ at each wavelength by using combinations of light emission diodes each emitting light having a different wavelength from each other by a certain difference and an interference filter, and taking the average the thus obtained value of $S_\lambda$.

In embodiments of the invention, the value of $SD_\lambda$ calculated from $E_{max}$ at wavelength $\lambda$ (nm) and the spectral reflection density $D_\lambda$ according to the fore going Formula (4), satisfies the designated relationship within the range of the specified wavelength region. As is well known, the spectral reflective density $D_\lambda$ at wavelength $\lambda$ (nm) can be easily determined by measuring the spectral reflectivity.

There is no specific limitation in the way to satisfy the essential conditions of the invention, and, for example, a method in which the characteristics of silver halide are a suitably controlled by optimizing the silver halide composition or by controlling the kind thereof, the added amount and the adding method of the sensitizing dye, and the method in which the coating amount of silver halide, the amount of coupler, the amount of the water-soluble dyes each having a spectral absorption at a wavelength of from 400 to 480 nm, from 510 to 570 nm, and from 620 to 730 nm or the amount of UV absorbent is suitably controlled. Such methods may be applied singly or in combination.

Any known sensitizing dyes may be used for spectral sensitization, BS-1 through BS-8 described in JP O.P.I. No. 3-251840, page 28, are preferably used solely or in combination as a blue sensitizing dye. GS-1 through GS-5 described in the same publication are each preferably used as a green sensitizing dye, and RS-1 through RS-8 described in page 29 of the same publication are each preferably used as a red-sensitizing dye. When the exposure is carried out using infrared ray by a semiconductor layer, an infrared sensitizing dye is necessary, and IRS-1 through IRS-11 described in JP O.P.I. No. 4-285950, pages 6–8, are each preferably used as the infrared sensitizing dye. It is preferable that the infrared, green and blue sensitizing dye are each used in combination together with a supersensitizer such as SS-1 through SS-9 described in JP O.P.I. No. No. 4-285950, pages 8–9, or a compound such as S-1 through S-17 described in JP O.P.I. No. 5-66515, pages 15–17.

The sensitizing dye may be added in a form of solution with a water-miscible solvent such as methanol, ethanol, fluorinated alcohol, acetone and formamide, or water, or in a form of solid particle dispersion.

The foregoing 25. through 34. will be further described below.

The silver halide color photographic light-sensitive materials described in 25. through 34. are each characterized in that a high print quality can be stably obtained and the specifically colored blur of fine line and the mixing of magenta or cyan color to yellow image are inhibited. Such the properties are obtained by that the light-sensitive material contains a silver halide emulsion which is spectrally sensitized by at least one kind of sensitizing dye represented by Formula 1 and at least one kind of sensitizing dyer which has the maximum spectral absorption within the wavelength region of from 380 nm to 430 nm when the dye is added into a silver halide emulsion having a silver chloride content of not less than 95 mol % and a pAg value of from 6.0 to 7.7, In the invention, it is particularly preferred that the above-mentioned spectrally sensitized silver halide emulsion is contained in the yellow image forming layer.

As the sensitizing dye having the maximum spectral absorption in the wavelength region of from 380 nm to 430 nm, the compounds represented by the foregoing Formula 2 to 9 or 10 are preferably used.

The compounds represented by Formula (1) to (10) relating to the invention are described below.

In Formula 1, $Z_{11}$ and $Z_{12}$ are each a group of non-metallic atoms necessary to form a benzothiazole ring, a naphtho-thiazole ring, a benzoselenazole ring, a naphthoselenazole ring, a benzimidazole ring, a naphthimidazole ring, a benzoxazole ring or a naphthoxazole ring, these rings may each have a substituent, provided that when at least one of $Z_{11}$ and $Z_{12}$ is a benzimidazole or a benzoxazole ring, another one of $Z_{11}$ and $Z_{12}$ is a naphthothiazole ring or a naphthoselenazole ring. Any group may be the substituent of $Z_{11}$ and $Z_{12}$. Examples of the substituent include an alkyl group such as a methyl group, an ethyl group, a propyl group, an isopropyl group, a butyl group, an isobutyl group, a hexyl group, an octyl group, a dodecyl group, an octadecyl group, a cyclopentyl group, a cyclopropyl group and a cyclohexyl group, a hydroxyl group, an alkoxycarbonyl group having from 1 to 35 carbon atoms such as a methoxycarbonyl group, an ethoxycarbonyl group, a phenoxycarbonyl group and a benzyloxycarbonyl group, an alkoxyl group having from 1 to 53 carbon atoms such as a methoxy group, an ethoxy group, a benzyloxy group and a phenetyl group, an aryloxy group having from 6 to 35 carbon atoms such as a phenoxy group, a 4-methylphenoxy group and an a-naphthoxy group, and an acyloxy group having from 1 to 35 carbon atoms such as an acetyloxy group and a propionylbxy group, an acyl group having from 1 to 35 carbon atoms such as an acetyl group, a propionyl group, a benzoyl group and a mecyl group, a carbamoyl group having from 1 to 35 carbon atoms such as a carbamoyl group, an N,N-dimethylcarbamoyl group, a morpholinocarbamoyl group and a piperidinocarbamoyl group, a sulfamoyl group having from 0 to 35 carbon atoms such as a sulfamoyl group, an N,N-dimethylsulfamoyl group, a morpholinosulfamoyl group and a piperidinosulfamoyl group, an aryl group having from 6 to 35 carbon atoms such as a phenyl group, a 4-chlorophenyl group and an a-naphthyl group, a heterocyclic group having from 4 to 35 carbon atoms such as a 2-pyridyl group, a tetrahydrofurfuryl group, a morpholino group and a thienyl group, an amino group having from 0 to 35 carbon atoms such as an amino group, a dimethylamino group, an anilino group and a diphenylamino group, an alkylthio group such as a methylthio group and an ethylthio group, an alkylsulfonyl group having from 1 to 35 carbon atoms such as a methylsulfonyl group and a propylsufonyl group, an alkylsulfinyl group having from 1 to 35 carbon atoms such as a methylsulfinyl group, a nitro group, a phosphoric acid group, an acylamino group having from 1 to 35 carbon atoms such as an acetylamino group, an ammonium group having from 1 to 35 carbon atoms such as a trimethylammonium group and a tributylammonium group, a mercapto group, a hydrazino group having from 1 to 35 carbon atoms such as a trimathylhydrazino group, an ureido group such as an ureido group and an N,N-dimethylureido group, an imido group having from 1 to 35 carbon atoms, and an unsaturated carbon hydride group having from 1 to 35 carbon atoms such as a vinyl group, an ethinyl group, a 1-cyclohexenyl group and a bendylidene group.

The foregoing substituents each may further have a substituent such as a carboxyl group, a sulfo group, a halogen atom such as a fluorine atom, a chlorine atom, a bromine atom and an iodine atom.

Among the above-mentioned substituents, an alkyl group such as a methyl group, an ethyl group, a carboxymethyl group, a 2-carboxyethyl group, 3-carboxypropyl group, a 4-carboxy-butyl group, a sulfomethyl group, a 2-sulfoethyl group, a 3-sulfopropyl group, a 4-sulfobutyl group, a 3-sulfobutyl group, a 2-hydroxy-3-sulfopropyl group, a 2-cyanoethyl group, a 2-chloroethyl group, a 2-bromoethyl group, a 2-hydroxyethyl group, a 3-hydroxypropyl group, a hydroxymethyl group, a 2-hydroxyethyl group, a 4-hydroxybutyl group, a 2,4-dihydroxy-butyl group, a 2-methoxyethyl group, a 2-ethoxyethyl group, a methoxymethyl group, a 2-ethoxycarbonylethyl group, a methoxycarbonylmethyl group, a 2-phenoxyethyl group, a 2-(4-phenylphenoxy)ethyl group, a 2-naphthoxyethyl group,, a 2-acetyloxyethyl group, a 2-propionyloxyethyl group, a 2-acetylethyl group, a 3-benzoylpropyl group, a 2-carbamoylethyl group,, a 2-morpholinocarbonylethyl group, a sulfamoylmethyl group, a 2-(N,N-dimethylsulfamoyl)ethyl group, a benzyl group, a 2-naphthylethyl group, a 2-(2-pyridyl)ethyl group, an aryl group, a 3-aminopropyl group, a dimethylaminomethyl group, a 3-dimethylaminopropyl group, a methylthiomethyl group, a 2-methylsulfonylethyl group, a methylsulfinylmethyl group, a 2-acetylaminoethyl group, an acetylaminomethyl group, a trimethylammoniummethyl group, a 2-mercaptoethyl group, a 2-trimethylhydrazinoethyl group, a methylsulfonylcarbamoylmethyl group and a (2-methoxy) ethoxymethyl group; an aryl group such as a phenyl group, a 1-naphthyl group, a p-phenylphenyl group and a p-chlorophenyl group,; a heterocyclic group such as a 2-pyridyl group, a 2-thiazolyl group and a 4-phenyl-2-thiazolyl group, 2-thienyl group, 5-bromo-2-thienyl group, a carboxyl group, a chloro group, a bromo group, a formyl group, an acetyl group, a benzoyl group, a 3-carboxypropanoyl group, a 3-hyfroxypropanoyl group, a chlorine atom, an N-phenylcarbamoyl group, an N-butylcarbamoyl group, a boric acid group, a sulfo group, a cyano group, a hydroxyl group, a methoxy group, a methoxycarbonyl group, an acetyloxy group and a dimethylamino group, are preferably used as the substituent of $Z_{11}$ and $Z_{12}$.

$R_{11}$ and $R_{12}$ are each an alkyl group, an alkenyl group or an-aryl group.

Preferable examples of the alkyl group represented by $R_{11}$ or $R_{12}$ include an unsubstituted alkyl group having from 1 to 12, preferably from 1 to 8, carbon atoms such as a methyl group, an ethyl group, a propyl group, a butyl group, a pentyl group, an octyl group, a decyl group, a dodecyl group and an octadecyl group, a substituted alkyl group having from 1 to 18 carbon atoms having a substituent such as a carboxyl group, a sulfo group, a cyano group, a halogen atom such as a fluorine atom, a chlorine atom and a bromine atom, a hydroxyl group, an alkoxycarbonyl group having from 1 to 8 carbon atoms, for example, a methoxy-carbonyl group, an ethoxycarbonyl group, a phenoxycarbonyl group and a benzyloxycarbonyl group, an alkoxyl group having from 1 to 8 carbon atoms, for example, a methoxy group, an ethoxy group, a benzyloxy group and a phenethyloxy group, a single ring aryloxy group having from 6 to 10 carbon atoms, for example, a phenoxy group and a p-tolyloxy group, an acyloxy group having from 1 to 3 carbon atoms, for example, an acetyloxy group and a propionyloxy group, an acyl group having from 1 to 8 carbon atoms, for example, an acetyl group, a propionyl group, a benzoyl group and a mecyl group, a carbamoyl group having from 1 to 8 carbon atoms, for example, a carbamoyl group, an N,N-dimethylcarbamoyl group, a morpholinocarbamoyl group and a piperidinocarbamoyl group, a sulfamoyl group having from 1 to 8 carbon atoms, for example, a sulfamoyl group, an N,N-dimethlsulfamoyl group, a morpholinosulfamoyl group and a piperidinosulfamoyl group, and an aryl group having from 6 to 10 carbon atoms, for example, a phenyl group, a 4-chlorophenyl group, a 4-methylphenyl group and an α-naphthyl group.

Among the above-mentioned, the followings are further preferable; an unsubstituted alkyl group having from 1 to 6 carbon atoms such as a methyl group, an ethyl group, an n-propyl group, an n-butyl group, an n-pentyl group and an n-hexyl group, a carboxy-substituted alkyl group having from 1 to 6 carbon atoms such as a 2-carboxyethyl group, a carboxymethyl group, a 3-carboxypropyl group, a 4-carboxybutyl group and a 3-carboxybutyl group, a sulfo-substituted alkyl group having from 1 to 6 carbon atoms such as a 2-sulfoethyl group, a 3-sulfopropyl group, a 4-sulfobutyl group and a 3-sulfobutyl group, a methanesulfonylcarbamoylmethyl group. A 2-sulfomethyl group, a 3-sulfopropyl group, a 3-sulfobutyl group, a 4-sulfobutyl group and a methane-sulfonylcarbamoyl methyl group are particularly preferred.

The alkenyl group represented by $R_{11}$ or $R_{12}$ is, for example, a propenyl group, a 3-butenyl group, a 1-methyl-3-propenyl group, a 3-pentenyl group, a 1-methyl-3-butenyl group and a 4-hexenyl group.

The aryl group represented by $R_{11}$ or $R_{12}$ is for example, a phenyl group and a naphthyl group.

$R_{13}$ is a hydrogen atom, a fluorine atom, methyl group or an ethyl group.

$X_1$ is included in the formula for showing the presence or non-presence of an anion or a cation when a counter ion is necessary to neutralizing the intramolecular charge. It is depended on the molecular structure of the substituent that one compound is either anionic, cationic or nonionic. The examples of typical anion as the counter ion include an inorganic or organic ammonium ion such as a triethylammonium ion and a pyridinium ion, an alkali metal ion such as a sodium ion and a potassium ion, and an alkali-earth metal ion such as a calcium ion and a magnesium ion. The examples of typical cation as the counter ion include a halide ion such as a fluoride ion, a chloride ion, a bromide ion and an iodide ion, an arylsulfonate ion such as a p-toluenesulfonate ion and a p-chlorobenzenesulfonate, an alkylsulfonate ion such as methanesulfonate ion, an aryldisulfonate ion such as a 1,3-benzenesulfonate ion, a 1,5-naphthalenedisulfonate and a 2.6-naphthalenedisulfonate ion, an alkylsulfate ion such as a methylsulfate ion and an ethylsulfate ion, a sulfate ion, a thiocyanate ion, a perchlorate ion, a tetrafluorobarate ion, a pyrolinate ion, an acetate ion, a trifluoromethanesulfonate ion, and a hexafluorophosphate ion. An ionic polymer, another organic compound having an opposite charge, and a metal complex such as a bis(nickel(III) 1,2-benzenedithiorate ion may be usable a the counter ion.

Among them, a sodium ion, a potassium ion, a triethylammonium ion and a pyridinium ion are preferred. n1 is an number of 0 or more necessary to neutralizing the intramolecular charge.

In Formula 2, $Z_{21}$ is a group of non-metallic atoms necessary to form a rhodanine ring, a 2-thiohydantoine ring, a 2-thiooxazoline-2,4-dione ring, a 2-thioselenazoline-2,4-dione ring, a thiobarbituric acid ring or a 2-pyrazoline-5-one ring. The nitrogen atom of the foregoing heterocyclic rings each may be substituted with a substituent such as an alkyl group, an alkenyl group or an aryl group. Any group may be used as the substituent of the nitrogen atom of the heterocyclic ring represented by $Z_{21}$, and the groups described with respect to the substituent of $Z_{11}$ and $Z_{12}$ are concretely usable. An alkyl group and a sulfoalkyl group each having from 1 to 4 carbon atoms, and a phenyl group are preferred.

$R_{21}$, $R_{22}$ and $R_{23}$ are each a hydrogen atom, an alkyl group, an alkenyl group or an aryl group, and may be form a ring. It is preferable that $R_{21}$ and $R_{22}$ are each a hydrogen atom or an alkyl group, and it is particularly preferable that at least one of them is an alkyl group. The alkyl group is preferably one having from 1 to 6 carbon atoms. It is also preferred that a 5- or 6-member nitrogen-containing heterocyclic ring is formed by $R_{21}$, $R_{22}$ and $R_{23}$.

In Formula 3, $Z_{31}$ is a group of non-metallic atoms necessary to form a thiazole ring, thiazoline ring, a thiazolidine ring, a benzothiazole ring, a naphthothiazole ring, a selenazole ring, a selenazoline ring, a selenazolidine ring, a benzoselenazole ring, a naphthoselenazole ring, a an oxazole ring, an oxazoline ring, an oxazolidine ring, a benzoxazole ring, a naphthoxazole ring, an imidazole ring, an imidazoline ring, an imidazolidine ring, a benzimidazole ring, a naphthimidazole ring, pyrrole ring, a pyrroline ring, a pyrrolidine ring, an indole ring, a pyridine ring or a quinoline ring, each of which may have a substituent. $Z_{32}$ is a group of non-metallic atoms necessary to form a pyrrole ring, a pyrroline ring, a pyrrolidine ring or an indole ring. Any group may be a substituent of $Z_{31}$ and $Z_{32}$, and the groups described as the substituent of $Z_{11}$ and $Z_{12}$ are applicable. $R_{31}$, $R_{32}$ are each an alkyl group, an alkenyl group or an aryl group, and the groups described with respect to $R_{11}$ and $R_{12}$ are applicable in concrete. $R_{33}$ is a hydrogen atom, a fluorine atom, a methyl group or an ethyl group. $X_3$ is a counter ion necessary to neutralize the intramolecular charge and those described with respect to $X_1$ are usable. n3 is a number of 0 or more necessary to neutralize the intramolecular charge.

In Formula 4, $Z_{41}$ and $Z_{42}$ are each a group of non-metallic atom necessary to form a thiazole ring, a thiazoline ring, a thiazolidine ring, a benzothiazole ring or a naphthothiazole ring, each of which may have a substituent. At least one of $Z_{41}$ and $Z_{42}$ is a thiazole ring, a thiazoline ring or a thiazolidine ring. Any group may be the substituent of $Z_{41}$ and $Z_{42}$, and the groups described as the substituent of Zil and $Z_{12}$ are applicable in concrete. $R_{41}$ and $R_{42}$ are each an alkyl group, an alkenyl group or an aryl group. Concretely, the groups described with respect to $R_{11}$ and $R_{12}$ are usable. $R_{43}$ is a hydrogen atom, a fluorine atom, a methyl group or an ethyl group. $X_4$ is a counter ion necessary to neutralize the intramolecular charge and those described with respect to $X_1$ are usable. n4 is a number of 0 or more necessary to neutralize the intramolecular charge.

In Formula 5, $Z_{51}$ and $Z_{52}$ is a group of atoms necessary to form a thiazole ring, a thiazoline ring, a thiazolidine ring, a benzothiazole ring, a naphthothiazole ring, an oxazole ring, an oxazoline ring, an oxazolidine ring, a benzoxazole ring or a naphthoxazole ring, each of which may have a substituent. At least one of $Z_{51}$ and $Z_{52}$ forms an oxazole ring,, an oxazoline ring, an oxazolidine ring, a benzoxazole ring or a naphthoxazole ring, provided that when one of $Z_{51}$ and $Z_{52}$ is a naphthoxazole, another one is not naphthoxazole ring, a naphthothiazole ring nor a benzothiazole, and when one of $Z_{51}$ and $Z_{52}$ is a naphthothiazole, another one is not a benzoxazole. Any group may be a substituent of $Z_{51}$ and $Z_{52}$, and the groups described as the substituent of $Z_{11}$ and $Z_{12}$ are applicable in concrete. $R_{51}$ and $R_{52}$ are each an alkyl group, an alkenyl group or an aryl group. Concretely, the groups described with respect to $R_1$ and $R_{12}$ are usable. $R_{53}$ is a hydrogen atom, a fluorine atom, a methyl group or an ethyl group. $X_5$ is a counter ion necessary to neutralize the intramolecular charge and those described with respect to $X_1$ are usable. n5 is a number of 0 or more necessary to neutralize the intramolecular charge.

In Formula 6, $Z_{61}$ and $Z_{62}$ are each a group of non-metallic atoms necessary to form a thiazole ring, a thiazoline ring, a thiazolidine ring, a benzothiazole ring, a naphthothiazole ring, a selenazole ring, a selenazoline ring, a selenazolidine ring, a benzoselenazole ring, a naphthoselenazole ring, an imidazole ring, an imidazoline ring, an imidazolidine ring, a benzimidazole ring, a naphthimidazole ring, a an oxazole ring, an oxazoline ring, an oxazolidine ring, a benzoxazole ring or a naphthoxazole ring, each of which may have a substituent. When one of $Z_{61}$ and $Z_{62}$ is a naphthimidazole, another one is not naphthoxazole ring, a benzothiazole ring, a naphthothiazole ring, a benzoselenazole ring, a naphthoselenazole nor a naphthimidazole. When one of $Z_{61}$ and $Z_{62}$ is a naphthothiazole or a naphthoselenazole, another one is not a naphthoselenazole ring. Any group may be the substituent of $Z6_1$ and $Z_{62}$, and the groups described as the substituent of $Z_{11}$ and $Z_{12}$ are applicable in concrete. $R_{61}$ and $R_{62}$ are each an alkyl group, an alkenyl group or an aryl group. Concretely, the groups with respect to $R_{11}$ and $R_{12}$ are usable. $R_{63}$ is a hydrogen atom, a fluorine atom, a methyl group or an ethyl group. $X_6$ is a counter ion necessary to neutralize the intramolecular charge and those described with respect to $X_1$ are usable. n6 is a number of 0 or more necessary to neutralize the intramolecular charge.

In Formula 7, $Z_{71}$ is a group of non-metallic atoms necessary to form a thiazole ring, thiazoline ring, a thiazolidine ring, a benzothiazole ring, a naphthothiazole ring, an oxazole ring, an oxazoline ring, an oxazolidine ring, a benzoxazole ring, a naphthoxazole ring, a selenazole ring, a selenazoline ring, a selenazolidine ring, a benzoselenazole ring, a naphthoselenazole ring, an imidazole ring, an imidazoline ring, an imidazolidine ring, a benzimidazole ring, a naphthimidazole ring, a pyrrole ring, a pyrroline ring, a pyrrolidine ring, an indole ring, a pyridine ring or a quinoline ring, each of which may have a substituent. $Z_{72}$ is a phenyl group, a cyclohexyl group, a furyl group, a pyrazolyl group or an amino group, each of which may have a substituent. Any group may be a substituent of $Z_{71}$ and $Z_{72}$, and the groups described as the substituent of $Z_{11}$ and $Z_{12}$ are applicable in concrete. $R_{71}$ and $R_{72}$ are each a hydrogen atom, an alkyl group, an alkenyl group or an aryl group, which may form a ring. It is preferable that the $R_{71}$ and $R_{72}$ are each a hydrogen atom or an alkyl group, preferably an alkyl group having from 1 to 6 carbon atoms.

In Formula 8, $Z_{81}$ is a group of non-metallic atoms necessary to form a thiazoline ring, a thiazolidine ring, a selenazoline ring, a selenazolidine ring, an oxazoline ring, an oxazolidine ring, an imidazoline ring, an imidazolidine ring, a pyrroline ring or a pyrrolidine ring, and $Z_{82}$ is a group of non-metallic atoms necessary to form a rhodanine ring, a 2-thiohydantoine ring, a 2-thioxazoline-2,4-dione ring, 2-thioselenazoline-2,4-dione ring, a barbituric acid ring, a 2-thiobarbituric acid ring or a 2-pyrazoline-5-one ring. The nitrogen atom of the above-mentioned heterocyclic rings may be substituted with an alkyl group, an alkenyl group or an aryl group. Any groups may be the substituent of $Z_{81}$, and those described with respect to $Z_{11}$ and $Z_{12}$, preferably an alkyl group having from 1 to 4 carbon atoms, a sulfoalkyl group or a phenyl group, are applicable in concrete. $P_{81}$ is an alkyl group, an alkenyl group or an aryl group, and those described with respect to $R_{11}$ and $R_{12}$ are usable.

In Formula 9, $Z_{91}$ is a group of non-metallic atoms necessary to form a benzoxazole ring, a naphthoxazole ring, a benzimidazole ring, a naphthimidazole ring, an indole ring, a benzindole ring, a pyridine ring or a quinoline i ring, each of which may have a substituent. Any groups may be the substituent of $Z_{91}$, and those described with respect to $Z_{11}$ and $Z_{12}$ are applicable in concrete. $R_{91}$ and $R_{92}$ are each an alkyl group, an alkenyl group or an aryl group, and those described with respect to $R_{11}$ and $R_{12}$ are applicable in concrete.

In Formula 10, $Z_{101}$ is a group of non-metallic atoms necessary to form a thiazole ring, thiazoline ring, a thiazolidine ring, a benzothiazole ring, a naphthothiazole ring, an oxazole ring, an oxazoline ring, an oxazolidine ring, a benzoxazole ring, a naphthoxazole ring, a selenazole ring, a selenazoline ring, a selenazolidine ring, a benzoselenazole ring, a naphthoselenazole ring, an imidazole ring, an imidazoline ring, an imidazolidine ring, a benzimidazole ring, a naphthimidazole ring, a pyrrole ring, a pyrroline ring, a pyrrolidine ring, an indole ring, a pyridine ring or a quinoline ring, each of which may have a substituent. Any groups may be the substituent of $Z_{101}$, and those described with respect to $Z_{11}$ and $Z_{12}$ are applicable in concrete. $R_{101}$ is an alkyl group, an alkenyl group or an aryl group, and those described with respect to RI, and $R_{12}$ are applicable in concrete. $R_{102}$ and $R_{103}$ are each a hydrogen atom, an alkyl group, an alkenyl group or an aryl group, which may form a ring other than a rhodanine ring, a 2-thiohydantoine ring, a 2-thiooxazoline-2,4-dione ring, a 2-thioselenazoline-2,4-dione ring, a barbituric acid ring, a 2-thiobarbituric acid ring and a 2-pyrazoline-5-one ring. At least one of $R_{102}$ and $R_{103}$ is preferably an alkyl group. The alkyl group is preferably one having from 1 to 6 carbon atoms.

Concrete examples of dye usable in the invention are shown below. However the dye is not limited thereto.

(1-1)
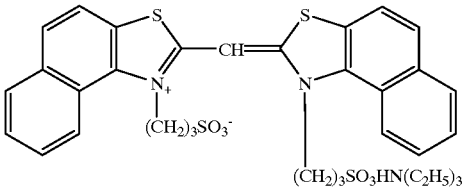
(1-2)
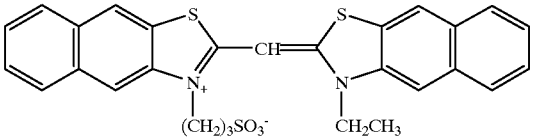
(1-3)
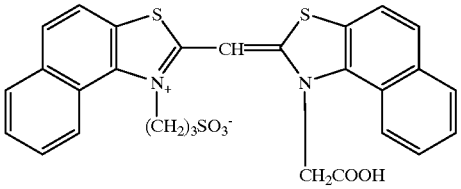
(1-4)
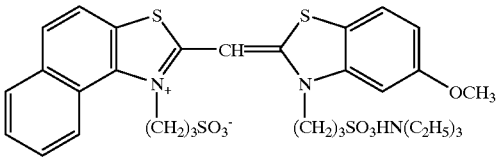
(1-5)
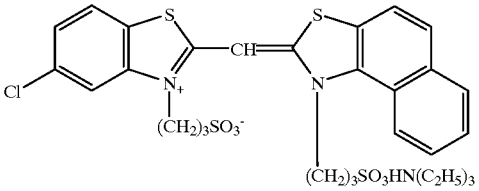
(1-6)
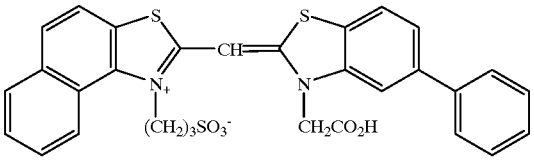
(1-7)
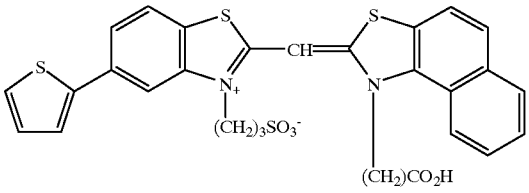
(1-8)
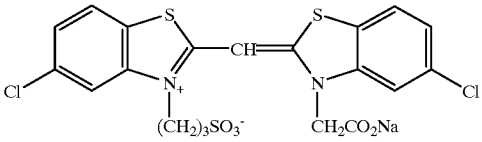
-continued
(1-9)
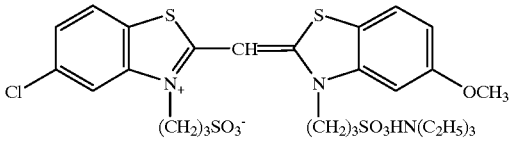
(1-10)
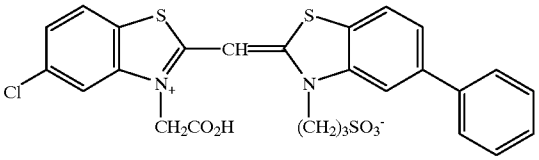
(1-11)
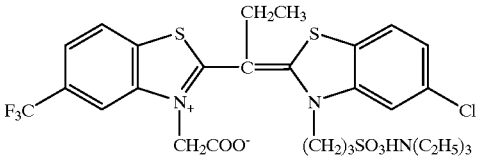
(1-12)
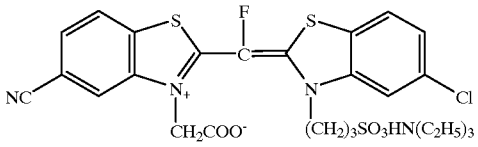
(1-13)
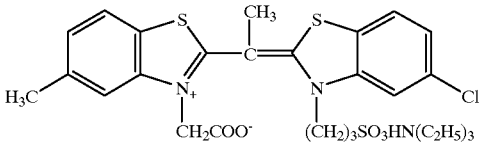
(1-14)
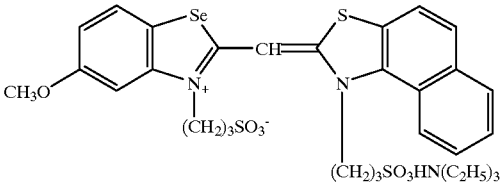
(1-15)
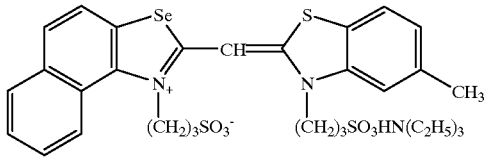
(1-16)
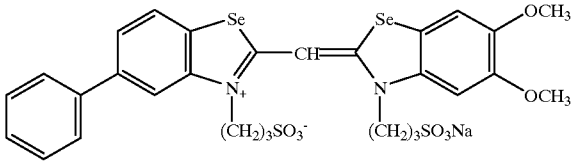

-continued
(1-17)
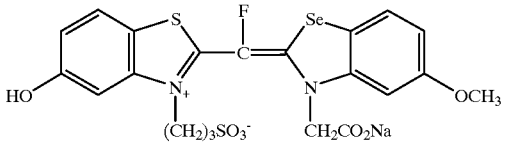
(1-18)
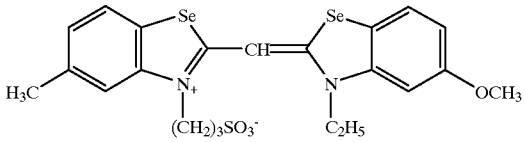
(1-19)
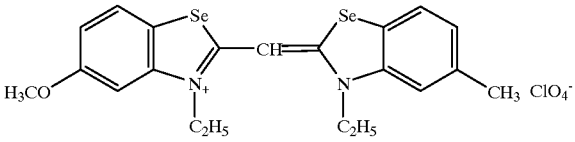
(1-20)
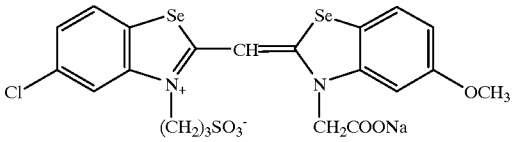
(1-21)
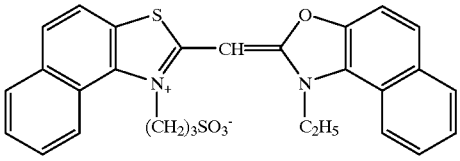
(1-22)
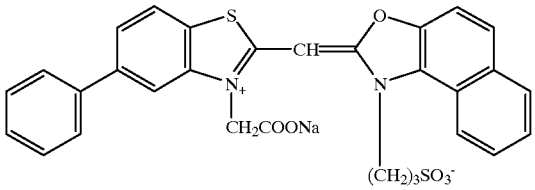
(1-23)
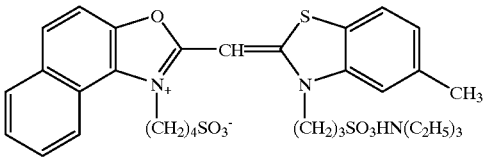
(1-24)
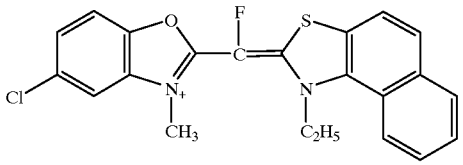
-continued
(1-25)
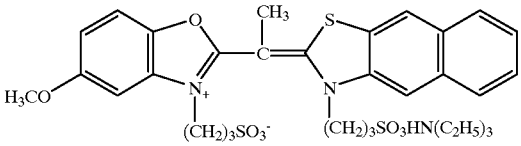
(1-26)
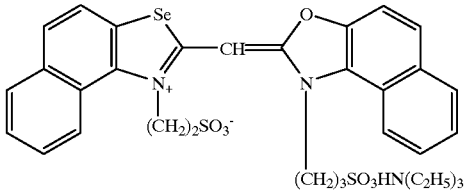
(1-27)
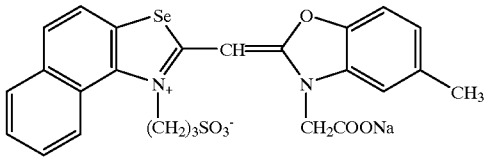
(1-28)
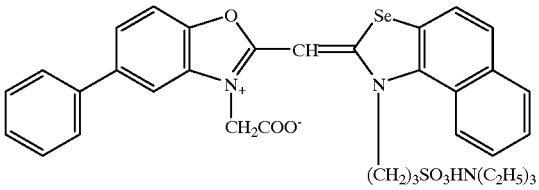
(1-29)
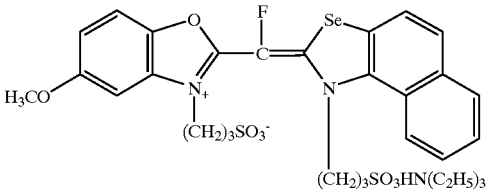
(1-30)
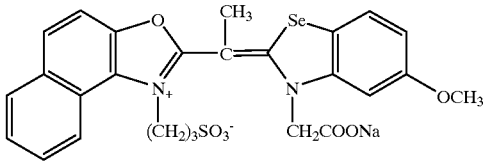
(1-31)
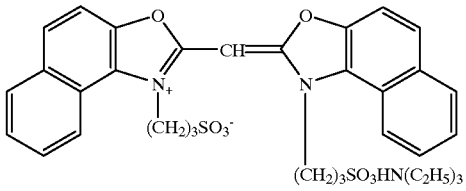

-continued
(1-32)
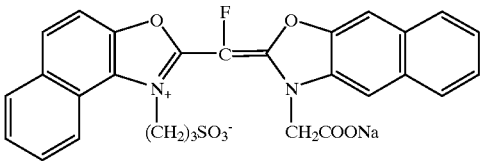
(1-33)
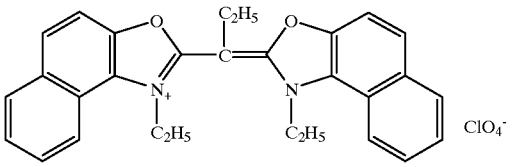
(1-34)
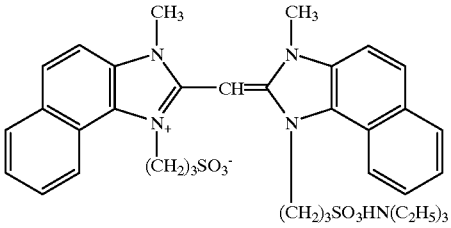
(1-35)
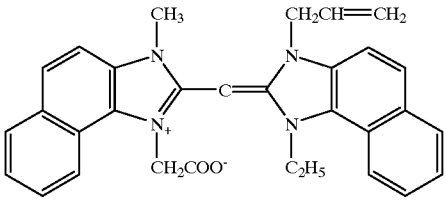
(1-36)
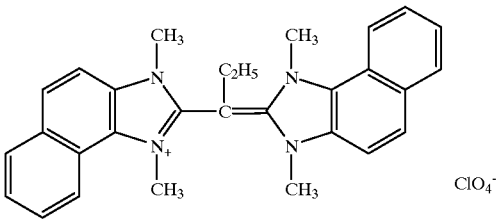
(1-37)
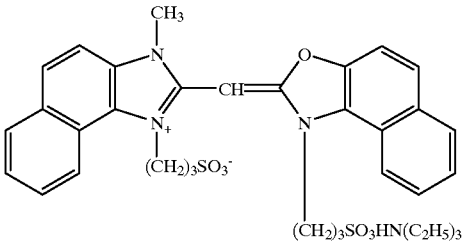
(1-38)
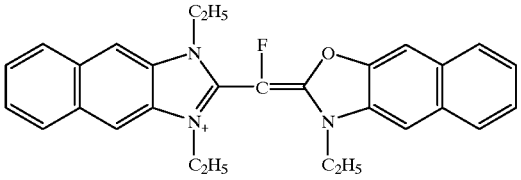
-continued
(1-39)
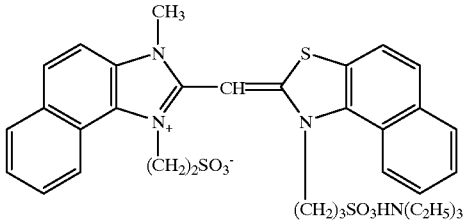
(1-40)
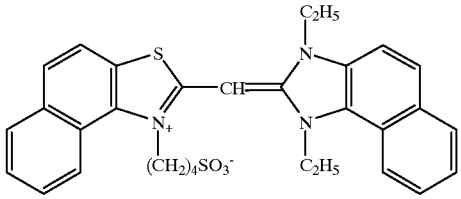
(1-41)
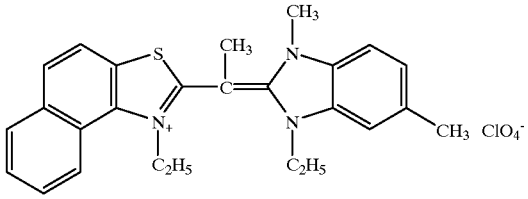
(1-42)
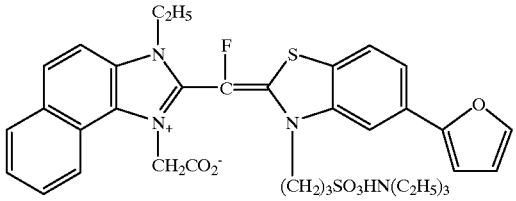
(1-43)
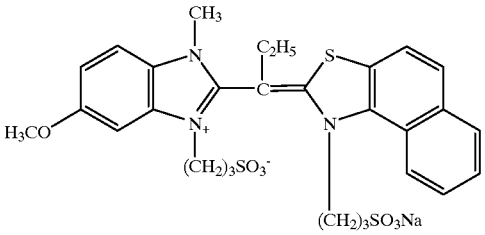
(1-44)
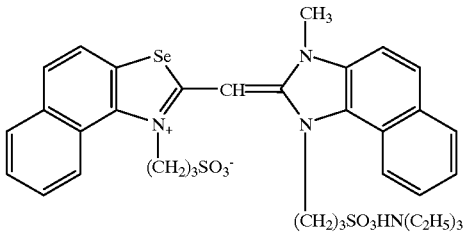

-continued
(1-45)
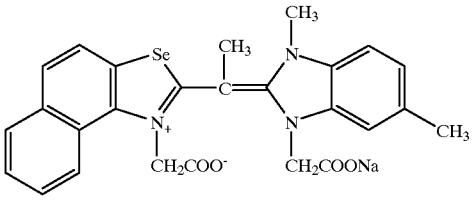
(2-1)
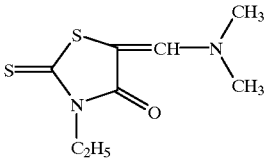
(2-2)
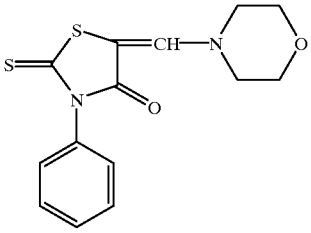
(2-3)
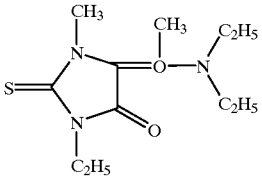
(2-4)
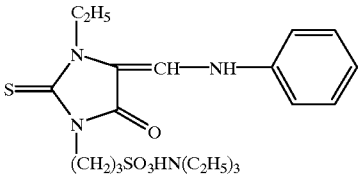
(2-5)
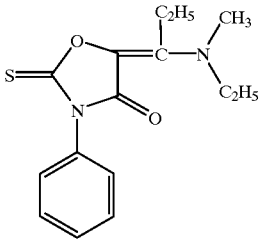
(2-6)
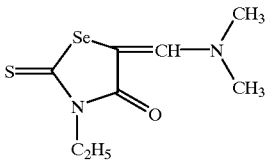
-continued
(2-7)
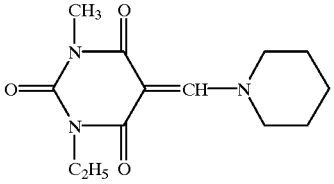
(2-8)
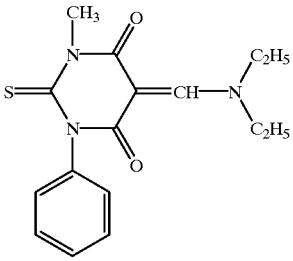
(2-9)
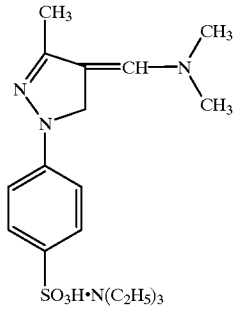
(3-1)
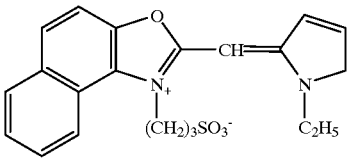
(3-2)
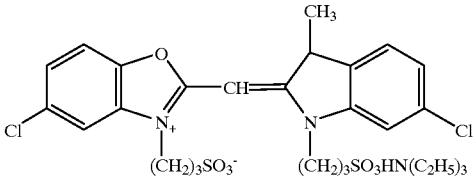
(3-3)
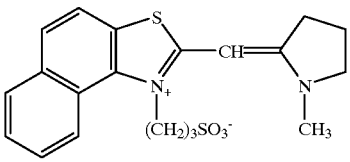
(3-4)
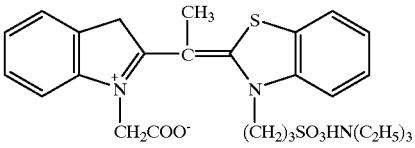

-continued
(3-5)
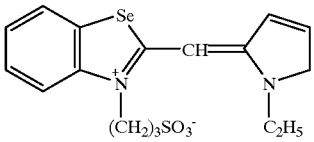
(3-6)
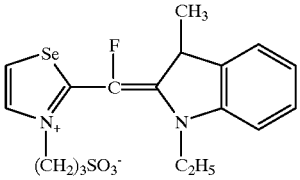
(3-7)
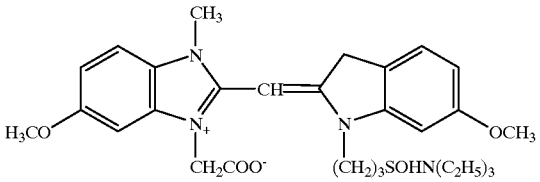
(3-8)
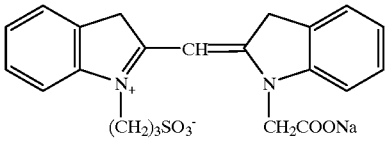
(3-9)
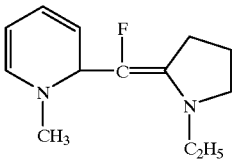
(4-1)
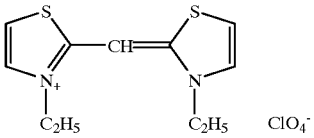
(4-2)
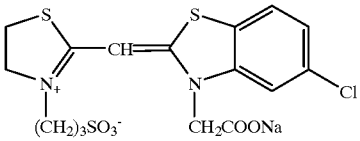
(4-3)
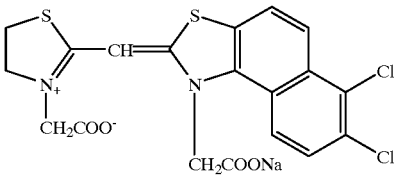
(4-4)
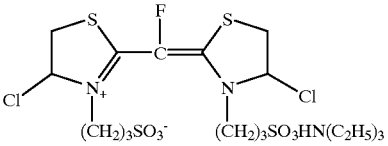
-continued
(4-5)
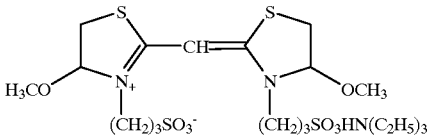
(5-1)
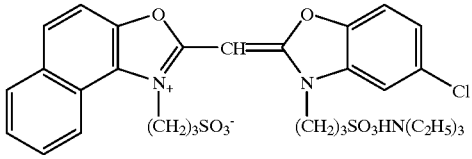
(5-2)
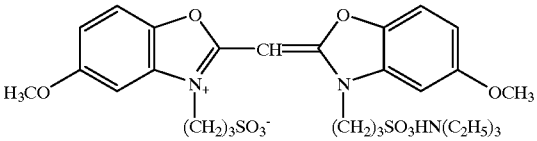
(5-3)
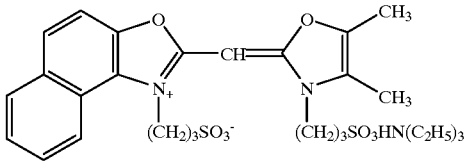
(5-4)
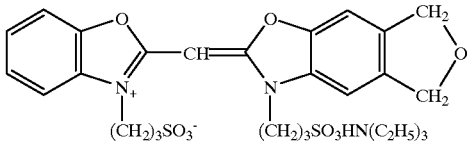
(5-5)
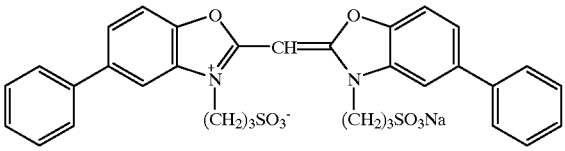
(5-6)
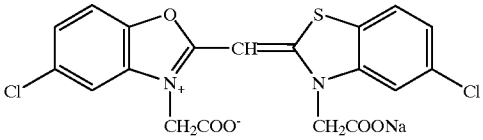
(5-7)
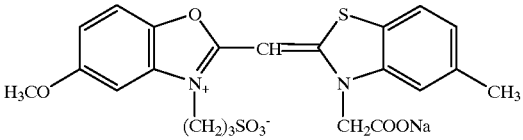
(5-8)
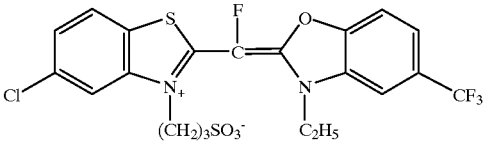

-continued
(5-9)
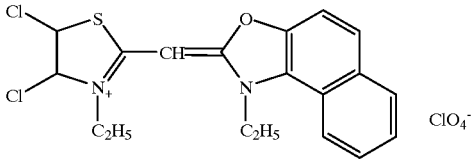
(5-10)
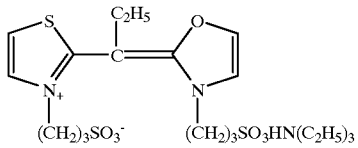
(5-11)
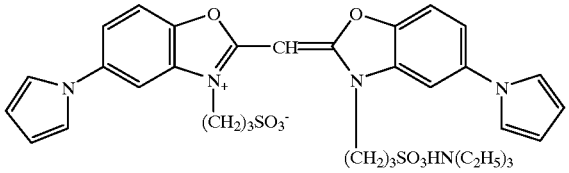
(5-12)
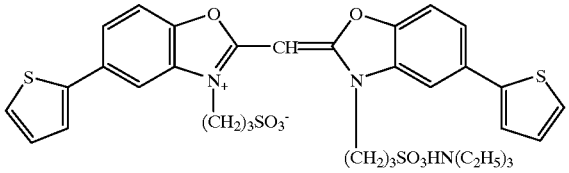
(5-13)
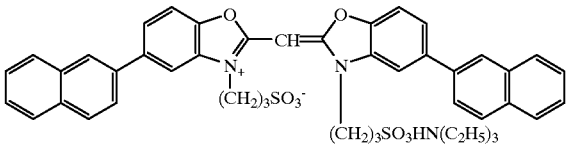
(6-1)
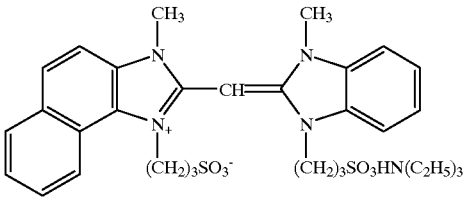
(6-2)
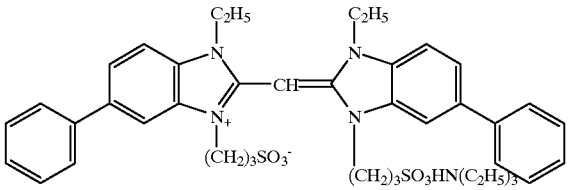
(6-3)
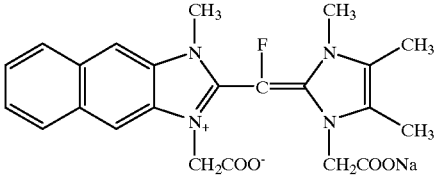
-continued
(6-4)
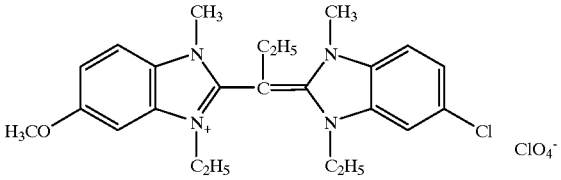
(6-5)
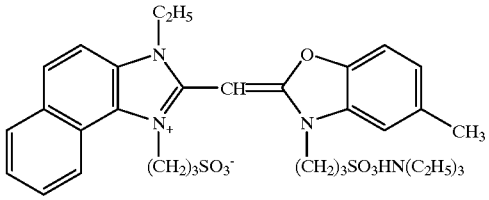
(6-6)
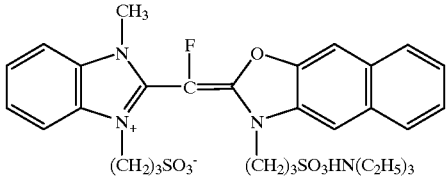
(6-7)
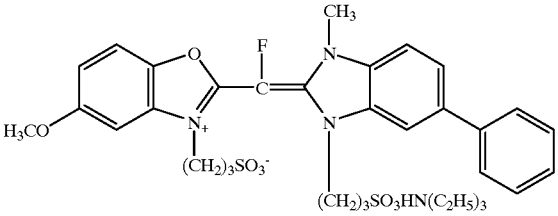
(6-8)
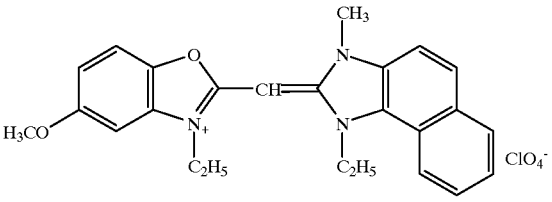
(6-9)
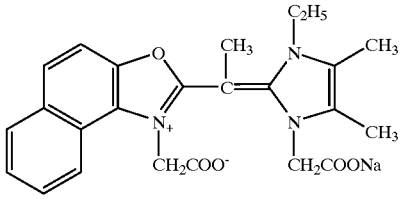
(6-10)
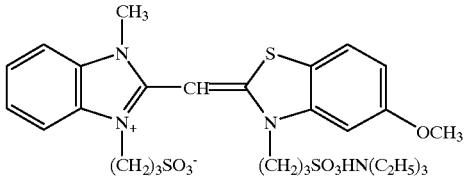

-continued
(6-11)
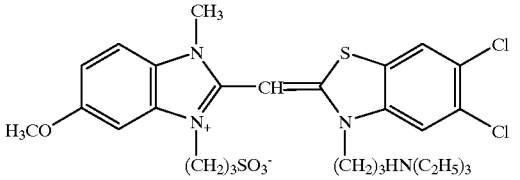
(6-12)
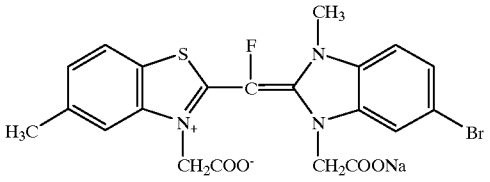
(6-13)
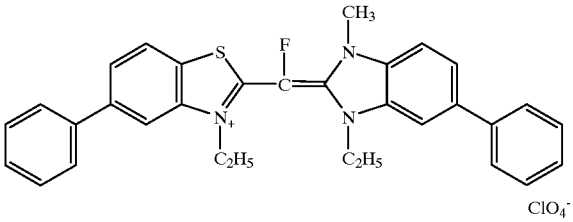
(6-14)
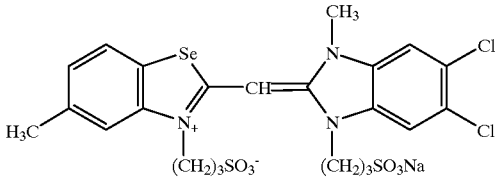
(6-15)
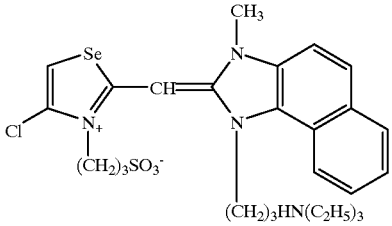
(6-16)
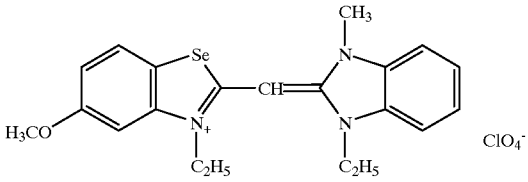
(6-17)
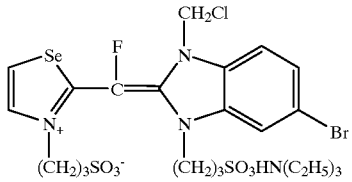
-continued
(7-1)
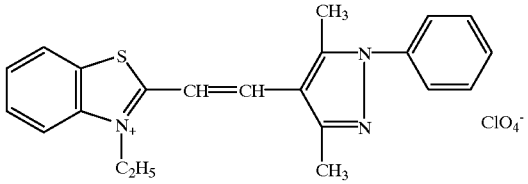
(7-2)
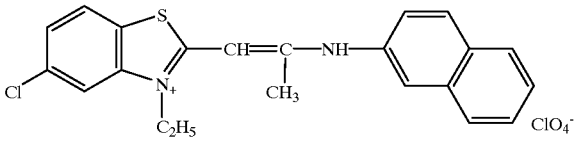
(7-3)
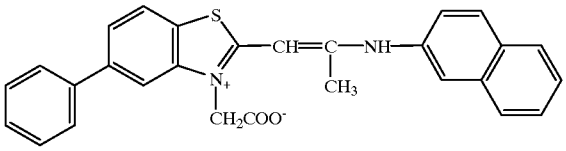
(7-4)
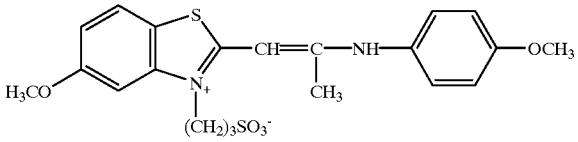
(7-5)
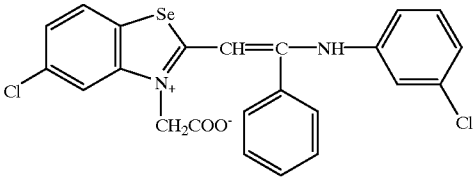
(7-6)
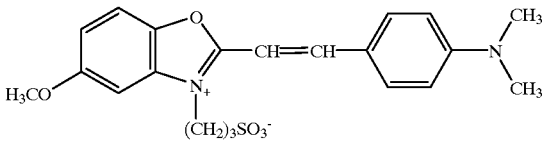
(7-7)
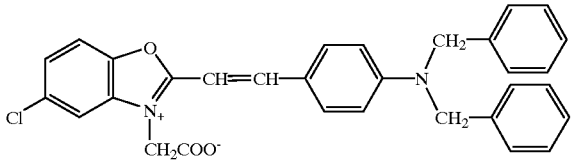
(7-8)
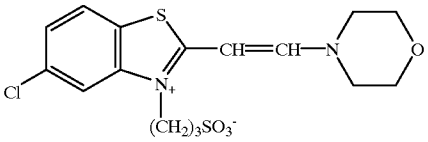

-continued
(7-9)
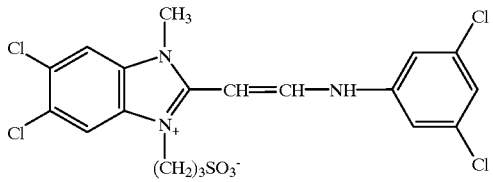
(7-10)
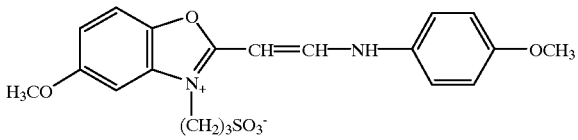
(7-11)
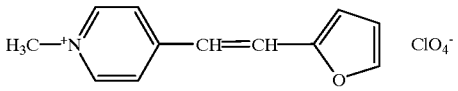
(7-12)
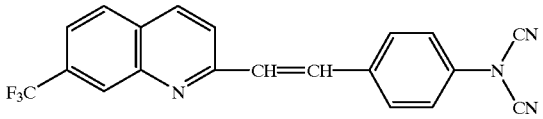
(7-13)
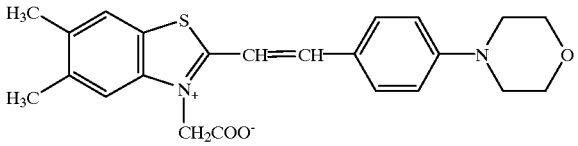
(7-14)
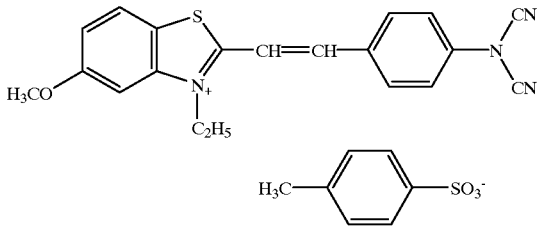
(8-1)
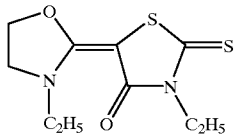
(8-2)
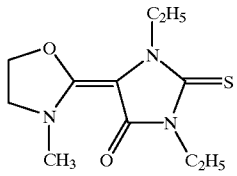
-continued
(8-3)
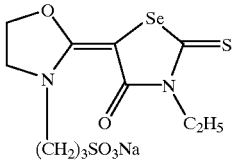
(8-4)
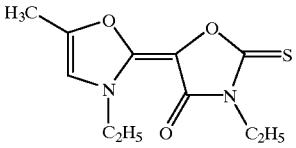
(8-5)
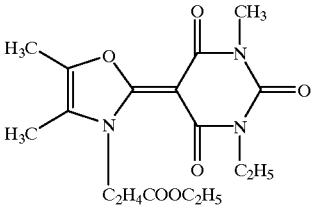
(8-6)
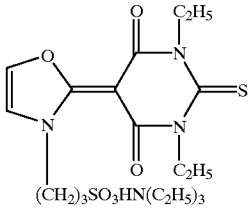
(8-7)
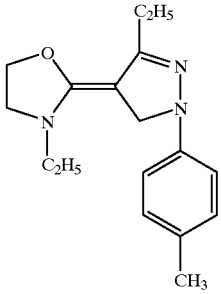
(8-8)
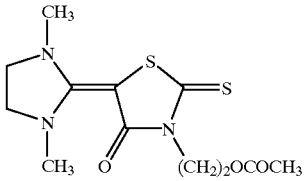
(8-9)
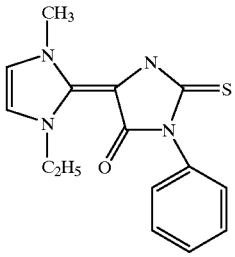

-continued
(8-10)
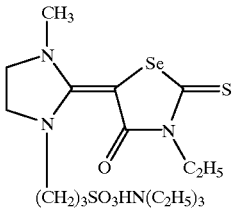
(8-11)
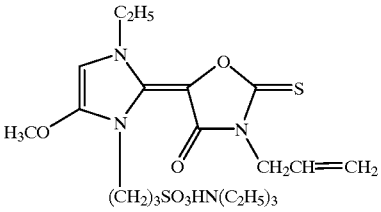
(8-12)
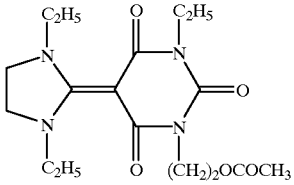
(8-13)
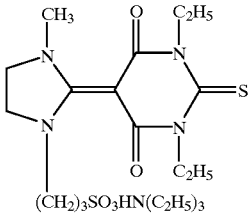
(8-14)
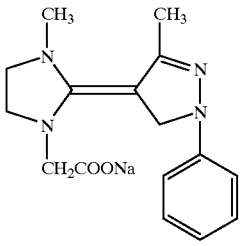
(8-15)
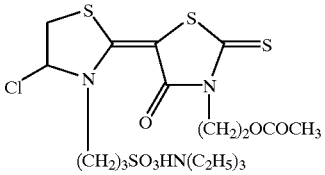
(8-16)
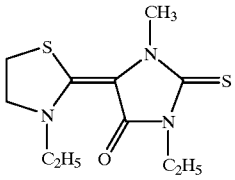
-continued
(8-17)
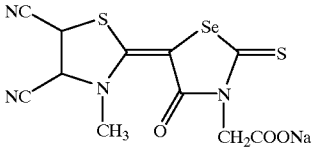
(8-18)
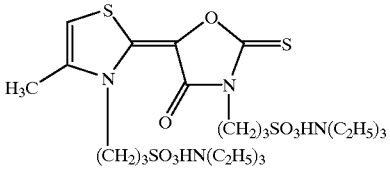
(8-19)
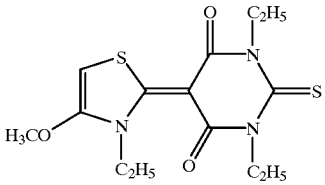
(8-20)
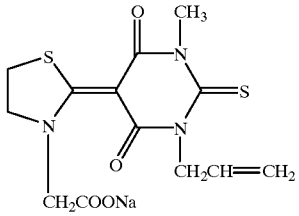
(8-21)
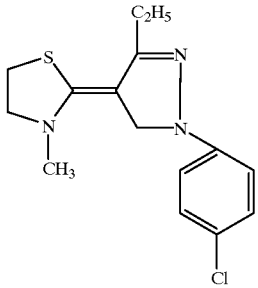
(8-22)
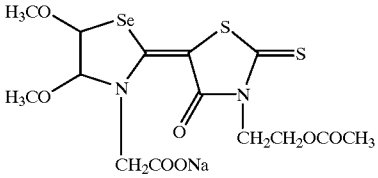
(8-23)
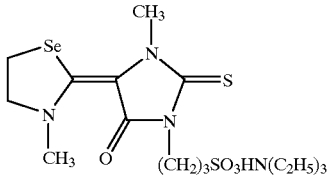

-continued
(8-24)
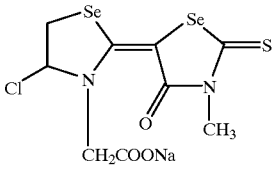
(8-25)
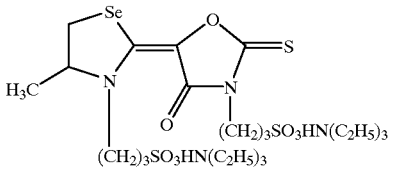
(8-26)
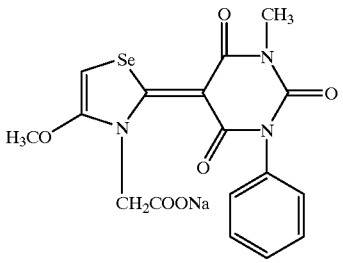
(8-27)
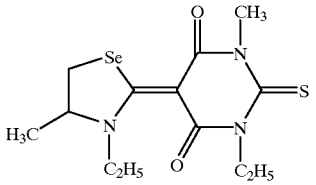
(8-28)
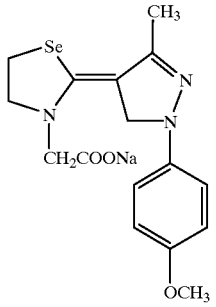
(8-29)
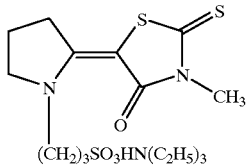
(8-30)
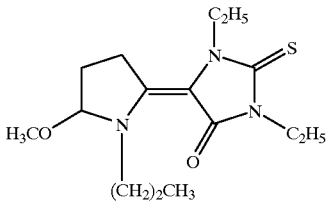
-continued
(8-31)
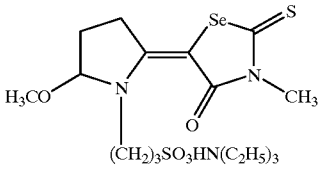
(8-32)
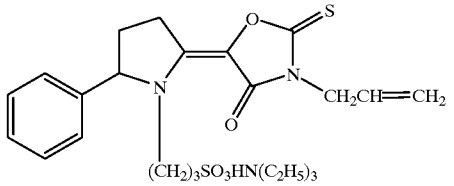
(8-33)
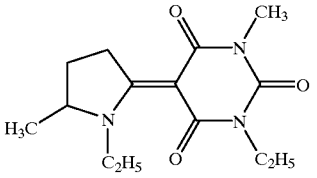
(8-34)
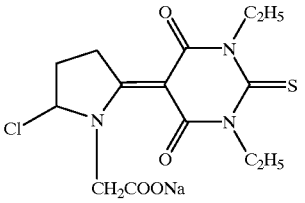
(8-35)
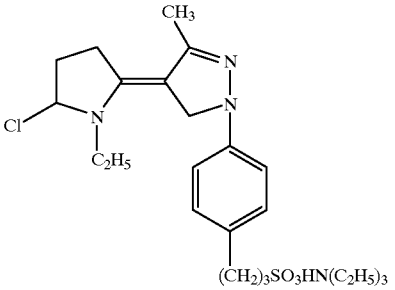
(9-1)
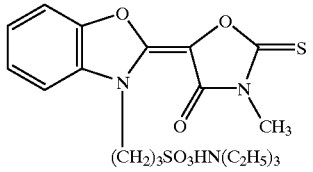
(9-2)
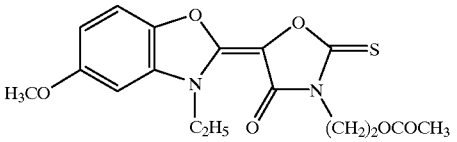

-continued
(9-3)
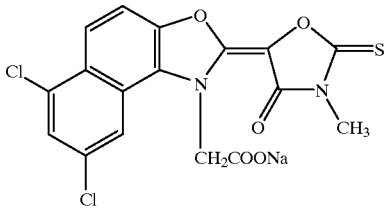
(9-4)
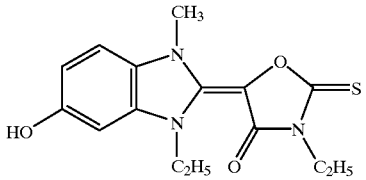
(9-5)
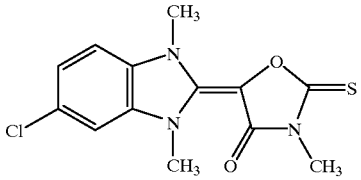
(9-6)
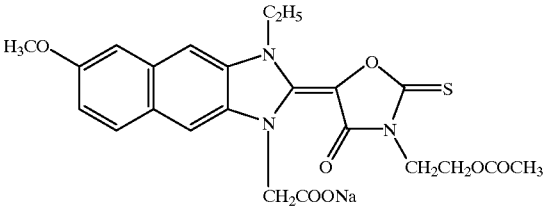
(9-7)
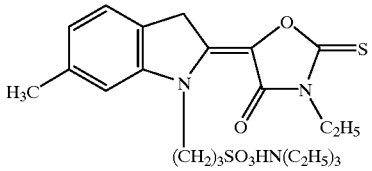
(9-8)
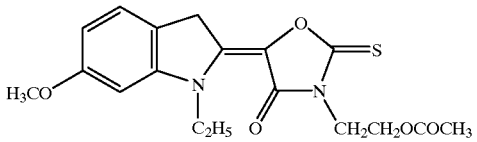
(9-9)
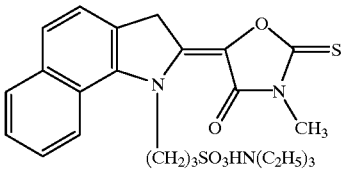
-continued
(9-10)
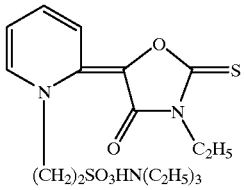
(9-11)
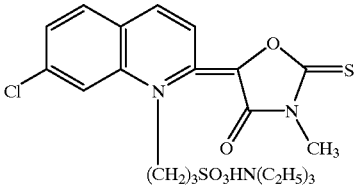
(10-1)
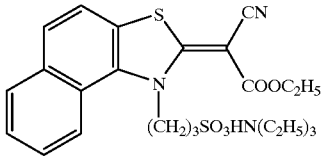
(10-2)
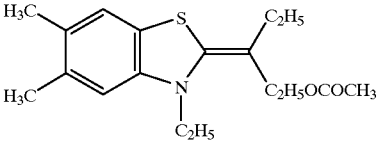
(10-3)
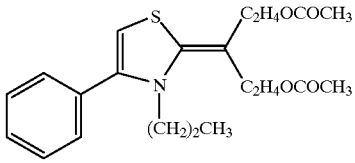
(10-4)
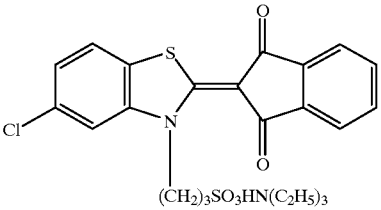
(10-5)
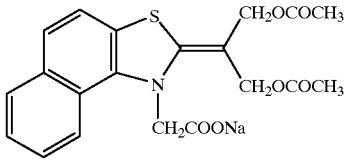
(10-6)
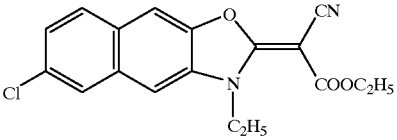

-continued
(10-7)
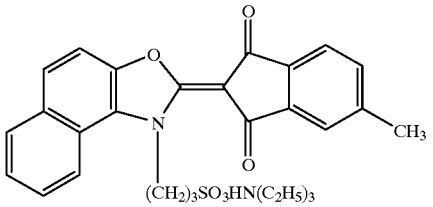
(10-8)
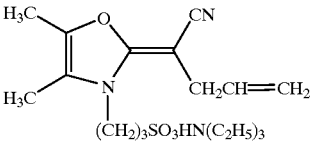
(10-9)
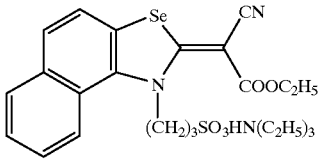
(10-10)
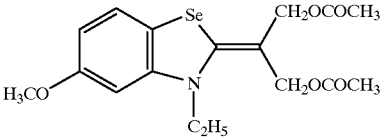
(10-11)
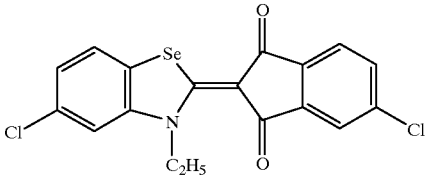
(10-12)
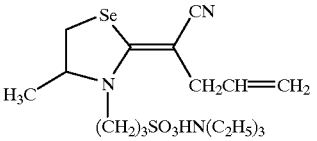
(10-13)
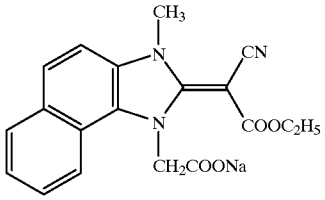
(10-14)
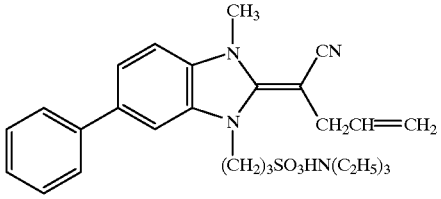
-continued
(10-15)
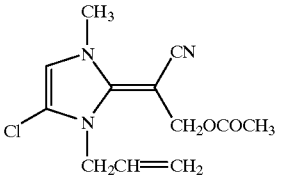
(10-16)
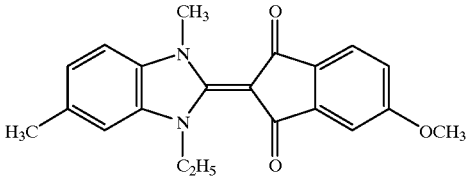
(10-17)
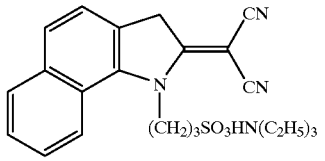
(10-18)
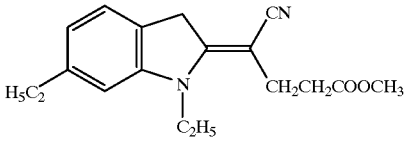
(10-19)
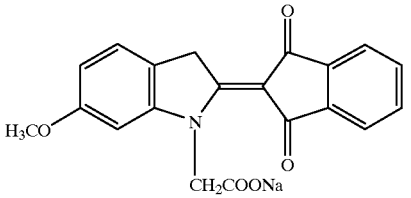
(10-20)
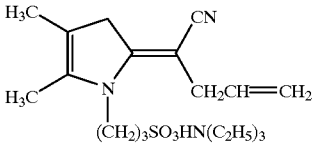
(10-21)
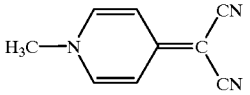
(10-22)
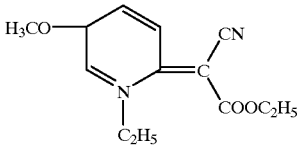
(10-23)
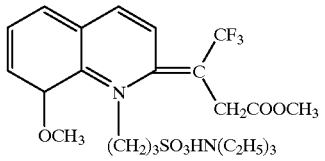

-continued (10-24)

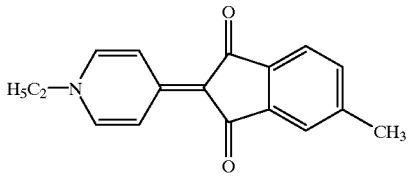

The dyes represented by Formula 1 to 9 or 10 can be synthesized referring the methods described in, for example, "The Chemistry of Heterocyclic Compounds" vol. 18, and "The Cyanine Dye and Related Compounds" edited by A. Weissberger, Interscience Co. New York, 1964.

In the light-sensitive material relating to the invention, a silver halide emulsion layer spectrally sensitized at a specific wavelength of from 380 to 900 nm combined with a yellow coupler, a magenta coupler or a cyan coupler. This silver halide emulsion may contains one or more kinds of sensitizing dye.

Although any known compounds may be used as the sensitizing dye for spectrally sensitizing the silver halide emulsion to light other than blue light, GS-1 through GS-5 described in JP O.P.I. No. 3-251840, page 28, are preferably used as a green sensitizing dye and RS-1 through RS-8 described on page 29 of the same publication are preferably used as a red-sensitizing dye. An infrared-sensitizing dye is necessary when the exposure is carried out using infrared rays by a semiconductor laser. IRS-1 through IRS-11 described on pages 6-8 of JP O.P.I. No. 4-285950 are preferably used as the infrared sensitizing dye. Moreover, it is preferred that such the infrared, red or green sensitizing dye is together with a supersensitizer such as SS-1 through SS-9 described on pages 8–9 and Compounds S-1 through S-17 described on pages 15–17 of JP O.P.I. No. 5-66515.

The optimal concentration of each of the sensitizing dyes can be decided according to the method known in the field of photographic industry. For example, a silver halide emulsion is divided into several parts and various amounts of a sensitizing dye are respectively added to each of the parts of the emulsion, and the sensitivity of the emulsions are determined to decide the optimal concentration of the sensitizing dye.

The adding amount of the sensitizing dye represented by Formula 2 to 9 or 10 is from ½ to 1/100, preferably from ⅓ to 1/20, of the amount of the sensitizing dye represented by Formula 1. These sensitizing dyes may be added to the emulsion at an optional time of from the step of silver halide grain formation to the step of finish of chemical sensitization.

These sensitizing dyes may be added in a form dissolved in a water-miscible solvent such as of methanol, ethanol, fluorinated alcohol and acetone or in water. The sensitizing dye may also added in a form of dispersion of solid particle. The addition in the form of solid particle dispersion is preferred since such the method is lower in the load on the environment. The adding method and the adding time of the dyes used in combination may be the same or different.

The image forming methods described in the above-mentioned 37 to 39 are described below.

The image forming methods according to the invention are characterized in that the light-sensitive material is imagewise exposed to at least three kinds of light according to digitized image data for a exposure time of not more than $10^{-3}$ seconds per pixel. Usually, an original image is divided to fine square and the density information of each of the square is digitized when image information is handled in digitized data. In this invention, the minimum unit of the divided square of the original image is defined as a pixel. Accordingly, the exposure time per pixel corresponds to the time-in which the intensity or the exposure time is controlled by the digitized data of the pixel. In the invention, the exposure time per pixel is preferably not more than $10^{-3}$ seconds, more preferably not more than $10^{-6}$ seconds, from the viewpoint of shortening the time for exposing step.

It is preferred in the light-sensitive material and the image forming method relating to the invention that the minimum density after processing is not more than (R,G,B)=(0.110; 0.110, 0.110) by Status A reflective density since a fine and complex image such as an image of fine line of character and a geometrical pattern can be clearly shown in the image having such the density. The minimum density is a density of light-sensitive material when the light-sensitive material substantially no exposed to light and processed. The determination of the density is repeated for sufficient times for removing the influence of fog caused by pressure or scratches and raising the precision of the measurement.

The silver halide emulsion to be used in the light-sensitive material relating to the invention may have an Eoptional composition such as silver chloride, silver bromide, silver chlorobromide, silver iodobromide, silver chloroiodobromide, and silver chloroiodide. Among them, silver chlorobromide having a silver chloride content of not less than 95 mole-% and substantially no silver iodide is preferable since the effect of the invention is enhanced. A silver halide emulsion having a silver chloride content of not less than 97 mole-% is more preferable and that having a silver chloride content of from 98 to 99.9 mole-% is further preferable from the viewpoint of rapid processing and stability of processing.

A silver halide emulsion which has a portion having a high silver bromide content is also preferably used in the light-sensitive material relating' to the invention for reducing lowering the contrast in the high density region of the characteristic curve formed by a high intensity short duration exposure. In such the case, the portion having a high silver bromide content may be bonded epitaxially onto the silver halide grain, or may also be in a form of core/shell grain. The bromide rich portion may be simply as a partial portion different in the silver bromide content Hwithout formation of complete continuous layer. The composition of silver halide may be varied continuously or discontinuously. It is particularly preferred that the silver bromide rich portion is exist on the surface of the silver halide grain or at the corner of the crystal grain.

In the light-sensitive material relating to the invention, a silver halide grain doped with a heavy metal ion for reducing the lowering contrast caused by the high-intensity shot duration exposure. Examples of the heavy metal ion usable for such the purpose include an ion of metal of Group 8 to 10 of periodic table such as iron, iridium, platinum, palladium, nickel, rhodium, osmium, ruthenium and cobalt, and that of transition metal of Group 12 such as cadmium, zinc and mercury, and that of lead, rhenium, molybdenum, tungsten, gallium and chromium. Among them an ion of iron, iridium, platinum, ruthenium, gallium and osmium are preferable. Such the metal ion may be added into the silver halide emulsion in a form of salt or complex salt.

When the heavy metal ion constitutes a complex, a cyanide ion, a thiocyanate ion, a cyanate ion, an isothiocyanate ion, a chloride ion, a bromide ion, an iodide ion, a nitrate ion, a carbonyl and ammonia are usable as the ligand compound or ion. Among them, a cyanide ion, thiocyanate ion, isothiocyanate ion, chloride ion and bromide ion are preferred.

The heavy metal compound may be added in optional process such as before the silver halide grain formation, in the course of silver halide grain formation, after formation of silver halide grain and the physical ripening process to be contained into the silver halide grain. The addition of the solution of the heavy metal compound may be carried out continuously so as to cover all or a part of the course the grain formation.

The amount of the heavy metal ion to be added to the silver halide emulsion is preferably from $1\times10^{-9}$ moles to 1 x 10-2 moles, more preferably from $1\times10^{-8}$ moles to $5\times10^{-5}$ moles, per mole of silver halide.

In the light-sensitive material relating to the invention, silver halide grains having an optional shape may be used. One of preferable example is a cubic grain having (100) face as the crystal surface. A octahedral grain, tetradecahedral grain or dodecahedral grain may also be used, which can be prepared according to the method described in US Patent Nos. 4,183,756, and 4,225,666, JP O.P.I. Nos. 55-26589, Japanese Patent Publication No. 55-42737, and The Journal of Photographic Science, 21, 39, 1973.

In the light-sensitive material relating to the invention, silver halide grains having an uniform shape are preferably used, and it is more preferable to add two or more kinds of silver halide emulsions in the same layer.

There is no limitation on the diameter of the silver halide grain, and it is preferable that the diameter of the grain is preferably from 0.1 to 1.2 $\mu$m, more preferably from 0.2 to 1.0 $\mu$m from the viewpoint of the suitability to the rapid processing and the light sensitivity.

The size of grain can be determined based on the projection area or the approximate diameter of the grains. The size distribution of the grains can be expressed with a high accuracy by the diameter or the projection area.

The silver halide grains to be used in the light-sensitive material relating to the invention is preferably a monodisperse emulsion having a variation coefficient of the diameter of not more than 0.22, more preferably not more than 0.15. It is particularly preferable that two or more kinds of monodisperse emulsions each having a variation coefficient of not more than 0.15 are used in the same layer. The variation coefficient is a coefficient expressing the width Of the grain size distribution, which is defined by the following equation, $$\text{Variation coefficient}=S/R.$$

In the equation S is the standard deviation of the distribution of grain diameter and R is the average diameter of the grains.

The grain size is the diameter of the grain when the grain is sphere, and the diameter of a circle having the area the same as the projection area of the grain when the grain has a cubic shape or a shape other than sphere.

Various apparatus and methods known in the field of photographic industry can be utilized for preparing the silver halide emulsion.

The silver halide emulsion to be used in the light-sensitive material relating to the invention may be any one prepared by an acid method, a neutral method and an ammoniacal method. The grains may be one grown by one step or one grown after preparation of a seed grain. The method for preparing the seed grain and that for growing the grain may be the same or different.

The method for reacting the water-soluble silver salt and the water-soluble halide salt may be any method such as a normal mixing method, a reverse mixing method, a double-jet mixing method and a combination thereof, and an emulsion prepared by the double-jet method is preferable. A pAg controlled double-jet method described in JP O.P.I. No. 54-48521 can also be utilized as a form of the double-jet method. An apparatus described in JP O.P.I. Nos. 57-92523 and 57-92524 in which a solution of the water-soluble silver salt and that of the water-soluble halide salt are supplied through an adding device arranged in the reaction mother liquid, an apparatus described in German OLS Patent No. 2,921,164 in which a solution of the water-soluble silver salt and that of the water-soluble halide salt are supplied while the concentration of the solution is continuously varied, or an apparatus described in JP O.P.I. No. 56-501776 in which silver halide grains are formed while the distance between the grains is constantly maintained by taking out the reaction mother liquid from the reaction vessel and concentrating the mother liquid by an ultra filtration method, may be utilized.

A silver halide solvent such as thioether may be used when it is necessary. Moreover, a compound such as that having a mercapto group, a nitrogen-containing heterocyclic compound or a sensitizing dye may be added to the emulsion at the time or after the grain formation.

A sensitizing method using a gold compound and that using a chalcogen sensitizer may be applied in combination to the silver halide emulsion to be used in the light-sensitive material relating to the invention. A sulfur sensitizer, a selenium sensitizer and a tellurium sensitizer can be applied to the silver halide emulsion as the chalcogen sensitizer. Among them, the sulfur sensitizer is preferred. Examples of the sulfur sensitizer include a thiosulfate, allylthiocarbamide thiourea, allylisothiocyanate, cystine, p-toluenethiosulfonate, rhodanine and elemental sulfur. The adding amount of the sulfur sensitizer is preferably from $5\times10^{-10}$ to $5\times10^{-5}$ moles, more preferably from $5\times10^{-8}$ to $3\times10^{-5}$ moles, per mole of silver halide even though it is preferable to change the amount depending on the kind of silver halide emulsion and the expected effect of the sensitizer.

The gold sensitizer can be added in a form of chloroaurate, gold sulfide and various gold complexes. Examples of the coordinate compound of the gold complex include dimethylrhodanine, thiocyanate, mercaptotetrazole and mercaptotriazole. The adding amount of the gold compound is preferably from $1\times10^{-8}$ to $5\times10^{-5}$ moles, more preferably from $5\times10^{-8}$ to $3\times10^{-5}$ moles, per mole of silver halide, even though the amount may be changed depending on the kind of silver halide, the kind of compound and the ripening condition.

A reduction sensitization may be applied for chemical sensitization of the silver halide emulsion relating to the invention. A known anti-foggant or a stabilizer can be added into the silver halide emulsion to be used in the light-sensitive material relating to the invention for preventing the fog formed in the producing process of the light-sensitive material, inhibiting the change in the characteristics during the storage period and preventing the fog formed in the developing process. Preferable examples of the compound usable for such the purpose include compounds represented by Formula (II) described in JP O.P.I. No. 2-146036, p. 7, lower column. Concrete examples of preferable compound are Compounds (IIa-1) to (IIa-8) and (IIb-1) to (IIb-7) described on page 8 of the above document, 1-(3-methoxyphenyl)-5-mercaptotetrazole, and 1-(4-ethoxyphenyl)-5-mercaptotetrazole. Such the compound is added to the silver halide emulsion at the grain formation process, the chemical sensitizing process, the end point of the chemical sensitizing process or the coating liquid preparation process, according to the purpose of the addition. The compound is preferably used in an amount of from $1\times10^{-5}$ moles to $5\times10^{-4}$ moles per mole of silver halide when the chemical sensitization is carried out in the presence of the compound. When the compound is added at the time of finishing the chemical sensitization, an amount of from $1\times10^{-6}$moles to $1\times10^{-2}$ moles per mole of silver halide is preferable and an amount of from $1\times10^{-5}$ moles to $5\times10^{-3}$ moles per mole of silver halide is more preferable. When the compound is added to the silver halide emulsion layer in the process of preparation of the coating liquid, an amount of from $1\times10^{-6}$ moles to $1\times10^{-1}$ moles per mole of silver halide is preferable and an amount of from $1\times10^{-5}$ moles to $1\times10^{-3}$ moles per mole of silver halide is more preferable. When the compound is added in a layer other than the silver halide emulsion layer, the preferable amount of the compound in the coated layer is from $1\times10^{-9}$ moles to $1\times10^{-3}$ moles per square meter.

In the light-sensitive material relating to the invention, a dye absorbing light of various wavelength to the purpose of anti-irradiation or anti-halation. Any of known compounds can be used for such the purpose. Particularly, Dye A-1 to A-11 described in JP O.P.I. No. 3-251840, p. 308, and a dye described in JP O.P.I. No. 6-3770 are preferably used as a dye absorbing visible light, and compounds represented by Formula (I), (II) or (III) described in JP O.P.I. No. 1-280750, p. 2, lower left column, are preferable as an infrared absorbing dye since the compounds each have suitable spectral absorption and little influence on the photographic characteristics and does not cause any stain by remaining color. Concrete examples of the compound include Exemplified Compounds (1) to (45) described in lower left column on page 3 through left lower column on page 5 of the above publication.

For raising the sharpness of the image in both of the cases that the exposure for extreme short duration by an extreme high-intensity light such as the exposure by a laser and the exposure for a short duration by a high-intensity light such as the exposure by LED, it is preferable embodiment that the silver halide photographic light-sensitive material has one maximum spectral sensitivity within the range of from 630 nm to 730 nm and the dye is added in an amount so that the reflection light amount at 670 nm is 10% of the amount of the incident light.

It is preferable for improving the background whiteness to add a fluorescent whitening agent into the light-sensitive material relating to the invention. Examples of compound preferably usable include the compounds represented by Formula II described in JP O.P.I. No. 2-232652.

When the light-sensitive material relating to the invention is used as a color photographic light-sensitive material, the light-sensitive material has silver halide emulsion layers respectively spectrally sensitized at a specified wavelength region within the range of from 400 nm to 900 nm in combination with a yellow coupler, a magenta coupler or a cyan coupler. The each of the silver halide emulsion layers is contains one ore more kinds of sensitizing dyes in combination.

Any compound capable of forming a coupling product having a spectral absorption maximum in a wavelength in the region of not less than 340 nm can be used as the coupler to be used in the light-sensitive material relating to the invention. Particularly, compounds known as yellow dye forming couplers each having a maximum absorption within the wavelength of from 350 to 500 nm, magenta dye forming couplers each having a maximum absorption within the wavelength of from 500 to 600 nm, and cyan dye forming couplers each having a maximum absorption within the wavelength of from 600 to 750 nm are typical examples of the coupler.

Examples of the cyan coupler preferably usable in the light-sensitive material relating to the invention include couplers represented by Formula (C-I) or (C-II) described on lower left column on page 5 of JP O.P.I. No. 4-114154. Concrete compounds is described as CC-1 through CC-9 in lower right column on page 5 through lower left column on page 6 of the same publication.

Examples of the magenta coupler preferably usable in the light-sensitive material relating to the invention include couplers represented by Formula (M-I) or (M-II) described on upper right column on page 4 of JP O.P.I. No. 4-114154. Concrete compounds is described as MC-1 through MC-11 in lower left column on page 4 through upper right column on page 5 of the same publication. Among such the magenta coupler, the couplers represented by Formula (M-I) described in upper right column on page. 4 of the same publication are preferable and the couplers in which RM of Formula (M-I) is a tertiary alkyl group are particularly preferable since such the couplers are excellent in the light fastness.

Examples of the yellow coupler preferably usable in the light-sensitive material relating to the invention include couplers represented by Formula (Y-I) described on upper right column on page 3 of JP O.P.I. No. 4-114154. Concrete compounds is described as YC-1 through YC-9 in lower left column on page 3 of the same publication. The couplers represented by Formula (Y-1) in which RY1 is an alkoxyl group and the couplers represented by Formula (I) described in JP .O.P.I. No. 6-67388 are preferable since preferable yellow color can be reproduced by such the coupler. Among them, YC-8 and YC-9 described in lower left column on page 4 of JP O.P.I. No. 4-114154 and Compounds Nos. (1) through (47) described on pages 13 through 14 of JP O.P.I. No. 6-67388 are particularly preferred examples. The most preferable compounds are the compounds represented by Formula (Y-1) described on pages 1 and 11 through 17 of JP O.P.I. No. 4-81847.

When an oil-in-water type dispersion method is applied for adding the coupler or an organic compound other than the coupler to be used in the light-sensitive material relating to the invention, the coupler or the compound is dissolved in a water-insoluble high-boiling organic solvent having a boiling point not less than 150° C., and a low-boiling and or water miscible organic solvent if it is necessary, and thus obtained solution is emulsified in a hydrophilic binder such as an aqueous gelatin solution in the presence of a surfactant. A stirrer, a homogenizer, a colloid mill, a flow-jet mixer and an ultrasonic dispersing apparatus can be used as the dispersing means. A process for removing the low-boiling solvent may be utilized at the same time or after the process of dispersion. Examples of the high-boiling solvent usable for dissolving and dispersing the coupler, a phthalic eater such as dioctyl phthalate, di-isodecyl phthalate and dibutyl phthalate, and a phosphoric ester such as tricresyl phosphate and trioctyl phosphate are preferably used. The dielectric constant of the high-boiling solvent is preferably within the range of from 3.5 to 7.0. Two or more kinds of the high-boiling solvent may be used in combination.

A method can be applied in which a polymer soluble in an organic solvent and in soluble in water is used in stead of the high-boiling solvent or together with the high-boiling solvent, and a low-boiling and or water-miscible organic solvent if it is necessary, and thus obtained solution is emulsified in a hydrophilic binder such as an aqueous gelatin by various dispersing means solution in the presence of a surfactant. An example of the polymer insoluble in water and soluble in an organic solvent is poly(N-t-butylacrylamide).

Examples of preferable compounds to be used as the surfactant for dispersing the photographic additives and controlling the surface tension of the coating liquid include ones containing a hydrophobic group having 8 to 30 carbon atoms and a sulfonic acid group or its salt in the molecular thereof. Concrete examples are Compounds A-1 through A-11 described in JP O.P.I. No. 64-26854. A surfactant in which a fluorine atom is substituted to the alkyl group thereof, is also preferably used. Such the dispersion is usually added into the coating liquid containing the silver halide emulsion, and the time from the finish of dispersion to addition to the coating liquid and the time from the addition to the coating liquid to the coating of the coating liquid are preferably short, preferably not more than 10 hours, more preferably not more than 3 hours, further preferably not more than 20 minutes.

A anti-decoloring agent is preferably used in combination with the coupler for preventing the discoloration of the formed dye-image caused by light, heat and humidity. Particularly preferred compounds are phenyl ether compounds represented by Formula I or II described on page 3 of JP O.P.I. No. 2-66541, phenol compounds represented by Formula IIIB described in JP O.P.I. No. 3-174150 and amine compounds represented by Formula A described in JP O.P.I. No. 64-90445, and the metal complexes represented by Formula XII, XIII, XIV or XV described in JP O.P.I. No. 62-182741 are particularly preferable for the magenta coupler. The compounds represented by Formula I described in JP O.P.I. No. 1-196049 and the compounds represented by Formula II described in JP O.P.I. No. 5-11417 are particularly preferable for the yellow and cyan coupler.

A compound such as Compound (d-11) described lower left column on page 9 of JP O.P.I. No. 4-114154 and Compound (A'-1) described in lower left column on page 10 of the same publication may be used for shifting the absorption wavelength of formed dye. Other than the above-mentioned, a fluorescent dye releasing compounds described in US Patent No. 4,774,187 may be used.

In the light-sensitive material relating to the invention, it is preferable to add a compound capable of reacting with the oxidation product of a developing agent into an interlayer arrange between the light-sensitive layers for preventing the color contamination or into the silver halide emulsion layer for improving the fog formation. A hydroquinone derivative is preferably as such the compound, and a dialkylhydroquinone such as 2,5-t-octylhydroquinone is more preferable. Particularly preferable compounds include the compounds represented by Formula II described in JP O.P.I. No. 4-133056 such as Compounds II-1 through II-14 described on Pages 13 and 14, and compound 1 described on page 17 of the same publication.

In the light-sensitive material relating to the invention, it is preferable to add an UV absorbent to prevent the static fog and to improve the light fastness of the formed dye by addition of an UV absorbent. A preferable UV absorbent is benzotriazole compounds. Examples of particularly preferable compound include the compounds represented by Formula III-3 described in JP O.P.I. No. 1-9 250944, the compounds represented by Formula III described in JP O.P.I. No. 64-66646, Compounds UV-1L through UV-27L described in JP O.P.I. No. 63-187240, the compound represented by Formula I described in JP O.P.I. No. 4-1633 and the compounds represented by Formula (I) or (II) described in JP O.P.I. No. 5-165144.

Gelatin is advantageously used as a binder in the light-sensitive material relating to the invention, and a hydrophilic colloid such as a gelatin derivative, a graftpolymer of gelatin with another polymer, a protein other than gelatin, a sugar derivative, a cellulose derivative and a synthesized hydrophilic homo- or co-polymer may also be usable.

A vinylsulfone-type hardener or a chlorotriazine-type hardener is preferably used solely or in combination for hardening such the binders. The compounds described in JP O.P.I. Nos. 61-249054 and JP O.P.I. No. 61-245153. It is preferable to add a preservative and an anti-molding agent such as those described in JP O.P.I. No. 61-245153 into the colloid layer to prevent breeding of a mold and a bacillus. Furthermore, it is preferable to add a slipping agent or a matting agent such as those described in JP O.P.I. Nos. 6-118543 and 2-73250 into the protective layer to improve the physical property of the surface the light sensitive material before or after the processing.

Any material may be used for the support of the light-sensitive material relating to the invention, and paper laminated with polyethylene or polyethylene terephthalate, paper made by natural pulp or synthesized pulp, a vinyl chloride sheet, a polypropylene or polyethylene phthalate support which may contain a white pigment and barita paper. Among them a support composed of raw paper having water resistive resin layers on both side thereof is preferred. The water resistive resin is preferably polyethylene, polyethylene terephthalate and a copolymer thereof.

As the white pigment, an inorganic and/or an organic white pigment, preferably the inorganic pigment, may be used. Examples of the white pigment are a sulfate of alkali-earth metal such as barium sulfate, a carbonate of alkali-earth metal such as calcium carbonate, silica such as finely powdered silicic acid and a synthesized silicate, calcium silicate, alumina, hydrated alumina, titanium oxide, zinc oxide, talk and clay. Preferable white pigment is barium sulfate and titanium oxide.

The amount of white pigment contained in the water resistive resin layer of the surface of the support is preferably not less than 13%, more preferably not less than 15%, by weight for improving the sharpness.

The dispersed degree of the white pigment in the water resistive resin layer of the paper support to be used in the light-sensitive material relating to the invention can be determined by the method described in JP O.P.I. No. 2-28640. When the dispersed degree is determined this method, the dispersed degree of the white pigment is preferably not more than 0.20, more preferably not more than 0.15, by the variation coefficient described in the same publication.

The center line-averaged roughness (SRa) of the support surface is preferably not more than 0.15 $\mu$m, more preferably not more than 0.12 $\mu$m. since the glossiness of the surface is raised. A little amount of blue or red tinting agent such as ultramarine or an oil-soluble dye is preferably added into the white pigment containing water resistive resin of the reflective support or the hydrophilic colloid layer coated on the support to control the spectral reflective density balance and to improve whiteness of the white background.

In the light-sensitive material relating to the invention, the hydrophilic colloid layer may be coated directly or through a subbing layer (one or more subbing layer for raising the properties of the support surface such as the adhessiveness, anti-static property, dimension stability, friction resistivity, hardness, anti-halation property, and friction property) on the support treated by corona discharge, UV irradiation or flame.

When the light-sensitive material relating to the invention is coated, a thickener may be used for raising the coating suitability of the coating liquid. An extrusion coating method and a curtain coating method are particularly * advantageous for coating by which two or more layers can be coated simultaneously.

The invention is preferably applied to a light-sensitive material containing no developing agent, and particularly preferably applied to a light-sensitive material to be directly observed by eyes such as color paper, reversal color paper, a light-sensitive material for directly forming positive image, a light-sensitive material for display and a light-sensitive material for making a color proof.

Known aromatic primary amine developing agents may be used in the image forming method relating to the invention. Example of such the compound are shown below.

CD-1: N,N-diethyl-p-phenylenediamine

CD-2: 2-amino-5-diethylaminotoluene

CD-3: 2-amino-5-(N-ethyl-N-laurylamino)toluene

CD-4: 4-(N-ethyl-N-(P-hydroxyethyl)amino)aniline

CD-5: 2-methyl-4-(N-ethyl-N-(P-hydroxyethyl)amino) aniline

CD-6: 4-amino-3-ethyl-N-ethyl-N-(P-(methanesulfonamido)ethyl) aniline

CD-7: 4-amino-3-methanesulfonamidoethyl-N,N-diethylaniline

CD-8: N,N-dimethyl-p-phenylenediamine

CD-9: 4-amino-3-methyl-N-ethyl-N-methoxyethylaniline

CD-10: 4-amino-3-methyl-N-ethyl-N-(D-ethoxyethyl) aniline

CD-11: 4-amino-3-methyl-N-ethyl-N-(y-hydroxypropyl) aniline

In the invention, a color developer containing the foregoing color developing agent may be used at an optional pH range, and the pH value is preferably within the range of from 9.5 to 13.0, more preferably from 9.8 to 12.0.

The treating temperature by the color developer relating to the invention is preferably within the range of from 35° C. to 70° C. A high temperature is preferable since the processing can be performed for a short time. However, an excessive high temperature is not preferred from the viewpoint of stability of the processing solution. Accordingly, the processing at a temperature of from 37° C. to 60° C. is preferred. The time for the color development is preferably not more than 45 seconds, more preferably not more than 30 seconds.

The time for development in the invention is preferably not more than 35 seconds, more preferably not more than 25 seconds, although the development is usually carried out for about 45 seconds. The duration between the scanning exposure and the start of development is preferably shorter from the viewpoint of raising the producibility. However, the latent image formed by the high-intensity short time exposure tends to be instable and the quality of printed character tend to be varied when a silver halide having a high silver chloride content. In the image forming method according to the invention, a good character image quality can be stably obtained even when the period of time from the finishing of scanning exposure to the start of the development is short. The period of time from the finishing of scanning exposure to the start of the development is preferably not more than 30 seconds, more preferably not more than 15 seconds.

A known component of developer may be added to the color developer additionally to the color developing agent. An alkaline agent having a buffering effect, a chloride ion, a development inhibitor such as benzotriazole, a preservant and a chelating agent are usually used. A method by which an image is formed by a so-called amplification development using a combination of the foregoing color developing agent and a oxidant such as hydrogen peroxide, and a method by which an image is formed by a so-called heat development in which the light-sensitive material previously containing the color developing agent (or its precursor) or a compound a capable of releasing a dye by a oxidation-reduction reaction is developed by heating after supplying a little amount of reaction aid such as water or overlapping with a treatment sheet, may be preferably applied.

The silver halide photographic light-sensitive material according to the invention is subjected to a bleaching treatment and a fixing treatment after the development. The bleaching treatment may be simultaneously performed with the fixing treatment. After the fixing treatment, a washing treatment is usually applied. A stabilizing treatment may be applied instead of the washing treatment. A roller transport type processing apparatus in which the light-sensitive material is transported by rollers arranged in the processing tank and an endless belt type processing apparatus in which the light-sensitive material is transported by an endless belt on which the light-sensitive material is fixed, may be used for processing the silver halide photographic light-sensitive material according to the invention. Moreover, a method using a processing tank having a slit-like form and the light-sensitive material is transported in the slit together with a processing solution flowing in the slit, a splay method by which a processing solution is splayed, a web method by which a carrying means immersed with a processing solution is contacted to the light-sensitive material and a method using a viscous processing solution are also usable. When a lot of light-sensitive material is processed, the processed is usually run using an automatic processor. In such the case, the amount of a replenishing solution is preferably smaller. The replenishing method most preferable from the viewpoint of the environment protection is a method by which the replenishing composition is supplied in a form of tablet. The method described in Journal of the Technical Disclosure No. 94-16935 is most preferable. In the case of the heat development, a method by which the image of dye is only transferred onto another sheet (dye receiving sheet) may be applied.

EXAMPLES

The invention is described below according to examples. However the invention is not limited thereto.

Example 1

Preparation of blue-sensitive silver halide emulsion EM-B1

Into 1 liter of a 2% aqueous solution of gelatin kept at 40° C., the following Solution A1 and Solution B1 were simultaneously added while the values of pAg and pH of the solution are maintained at 7.3 and 3.0, respectively. Furthermore, the following Solution C and Solution D were simultaneously added while the values of pAg and pH of the solution are maintained at 8.0 and 5.5, respectively. The control of the pAg was performed by the method described in JP O.P.I. No. 59-45437 and the control of the pH was carried out by using sulfuric acid or a solution of sodium hydroxide.

| | |
|---|---|
| (Solution A) | |
| Sodium chloride | 3.42 g |
| Potassium bromide | 0.03 g |
| Water to make | 200 ml |
| (Solution B) | |
| Silver nitrate | 10 g |
| Water to make | 200 ml |
| (Solution C) | |
| Sodium chloride | 102.7 g |
| Potassium hexachloroiridate (IV) | $4 \times 10^{-8}$ moles |
| Potassium ferrocyanate (II) | $2 \times 10^{-5}$ moles |
| Potassium bromide | 1.0 g |
| Water to make | 600 ml |
| (Solution D) | |
| Silver nitrate | 300 g |
| Water to make | 600 ml |

After the addition, the emulsion was desalted using a 5% aqueous solution of Demol N manufactured by Kao-Atlas Co., Ltd., and a 20% aqueous solution of magnesium sulfate, and mixed with a gelatin solution. Thus a monodisperse cubic emulsion EMP-1A having an average diameter of 0.70 μm, a variation coefficient of the grain distribution of 0.07 and a silver chloride content of 99.5 mol %.

A monodisperse cubic emulsion EMP-1B was prepared which had an average diameter of 0.65 μm, a variation coefficient of the grain distribution of 0.07 and a silver chloride content of 99.5 mol %.

The foregoing EMP-1A and EMP-1B were each subjected to optimal chemical sensitization at 60° C., respectively. Sensitized EMP-1A and EMP-1B were mixed in a ratio of 1:1 in amount of silver to prepare a blue-sensitive silver halide emulsion Em-B1.

| | |
|---|---|
| Sodium thiosulfate | 0.8 mg/mole of silver |
| Chloroauric acid | 0.5 mg/mole of silver |
| Stabilizing agent STAB-1 | $3 \times 10^{-4}$ moles/mole of silver |
| Stabilizing agent STAB-2 | $3 \times 10^{-4}$ moles/mole of silver |
| Stabilizing agent STAB-3 | $3 \times 10^{-4}$ moles/mole of silver |
| Sensitizing dye (1-1) | $1 \times 10^{-4}$ moles/mole of silver |
| Sensitizing dye (1-8) | $4 \times 10^{-4}$ moles/mole of silver |

STAB-1: 1-(3-acetoamidophenyl)-5-mercaptotetrazole
STAB-2: 1-phenyl-5-mercaptotetrazole
STAB-3: 1-(4-ethoxyphenyil)-5-mercaptotetrazole Preparation of green-sensitive silver halide emulsion Em-G1

A monodisperse cubic emulsion EMP-11A having an average diameter of 0.40 μm and a silver chloride content of 99.5 mol %, and a monodisperse cubic emulsion EMP-11B having an average diameter of 0.45 μm and a silver chloride content of 99.5 mol % were prepared in the same manner as in EMP-1A except that the adding time of Solutions A1 and B1 and that of Solutions C1 and D1 were changed.

The foregoing EMP-11A and EMP-111B were each subjected to optimal chemical sensitization at 60° C., respectively. Sensitized EMP-11A and EMP-11B were mixed in a ratio of 1:1 in amount of silver to prepare a blue-sensitive silver halide emulsion Em-G1.

| | |
|---|---|
| Sodium thiosulfate | 1.5 mg/mole of silver |
| Chloroauric acid | 1.0 mg/mole of silver |

-continued

| | |
|---|---|
| Sensitizing dye GS-1 | $4 \times 10^{-4}$ moles/mole of silver |
| Stabilizing agent STAB-1 | $3 \times 10^{-4}$ moles/mole of silver |
| Stabilizing agent STAB-2 | $3 \times 10^{-4}$ moles/mole of silver |
| Stabilizing agent STAB-3 | $3 \times 10^{-4}$ moles/mole of silver |

<Preparation of red-sensitive silver halide emulsion Em-R1>

A monodisperse cubic emulsion EMP-21A having an average diameter of 0.38 Jim and a silver chloride content of 99.5 mol %, and a monodisperse cubic emulsion EMP-21B having an average diameter of 0.42 μm and a silver chloride content of 99.5 mol % were prepared in the same manner as in EMP-1A except that the adding time of Solutions A1 and B1 and that of Solutions C1 and D1 were changed.

The foregoing EMP-21A and EMP-21B were each subjected to optimal chemical sensitization at 60° C., respectively. Sensitized EMP-21A and EMP-21B were mixed in a ratio of 1:1 in amount of silver to prepare a blue-sensitive silver halide emulsion Em-R1.

| | |
|---|---|
| Sodium thiosulfate | 1.8 mg/mole of silver |
| Chloroauric acid | 2.0 mg/mole of silver |
| Sensitizing dye RS-1 | $1 \times 10^{-4}$ moles/mole of silver |
| Sensitizing dye RS-2 | $1 \times 10^{-4}$ moles/mole of silver |
| Supersensitizer SS-1 | $2 \times 10^{-4}$ moles/mole of silver |
| Stabilizing agent STAB-1 | $3 \times 10^{-4}$ moles/mole of silver |
| Stabilizing agent STAB-2 | $3 \times 10^{-4}$ moles/mole of silver |
| Stabilizing agent STAB-3 | $3 \times 10^{-4}$ moles/mole of silver |

The structure of additives used for preparation of Em-B1, Em-G1 and Em-R1 are shown below.

(1-8)

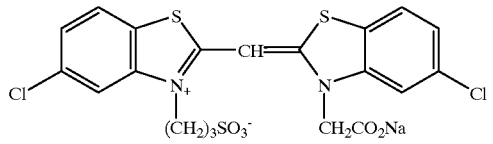

(1-1)

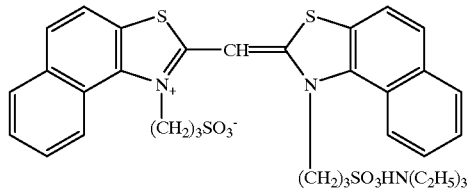

Preparation of Light-sensitive Materials 101 through 108

A paper support was prepared by laminating high density polyethylene on both sides of raw paper having a weight of 180 g/m$^m$. Surface treated anatase type titanium oxide was dispersed in an amount of 15% by weight in the fused polyethylene laminated on the surface of the paper on which the emulsion layer to be coated. Thus prepared reflective support was subjected to corona discharge treatment, and a subbing layer was provided on the support. The following layers were coated on the support to prepare a multi-layered Light-sensitive Material 101.

In the preparation of the light-sensitive material, coating liquids of each layer were prepared so that the coating amount of each components were the followings, and hardener H-1 and H-2 were added. Surfactant SU-1, SU-2 and SU-3 were added as the coating aid to control the surface tension of the coating liquid. Furthermore, anti-mold agent F-1 was added each of the layers so that the total amount was become to 0.04/m$^2$. The constitution of the each layers is shown below.

| | Added amount |
|---|---|
| 7th layer (Protective layer) | |
| Gelatin | 1.00 g/m$^2$ |
| High-boiling solvent (DIDP) | 0.002g/m$^2$ |
| High-boiling solvent (DBP) | 0.002g/m$^2$ |
| Silicon dioxide | 0.003g/m$^2$ |
| 6th layer (UV absorbing layer) | |
| gelatin | 0.40 g/m$^2$ |
| Anti-irradiation dye (AI-1) | 0.01 g/m$^2$ |
| UV absorbent (UV-1) | 0.12 g/m$^2$ |
| UV absorbent (UV-2) | 0.04 g/m$^2$ |
| UV absorbent (UV-3) | 0.16 g/m$^2$ |
| Stain preventing agent (HQ-5) | 0.04 g/m$^2$ |
| PVP | 0.03 g/m$^2$ |
| 5th layer (Red-sensitive layer) | |
| Gelatin | 1.30 g/m$^2$ |
| Red-sensitive emulsion (Em-R1) | 0.21 g/m$^2$ |
| Cyan coupler (C-1) | 0.28 g/m$^2$ |
| Cyan coupler (C-2) | 0.03 g/m$^2$ |
| Dye image stabilizing agent (ST-1) | 0.10 g/m$^2$ |
| Stain preventing agent (HQ-1) | 0.004g/m$^2$ |
| High-boiling solvent (DBP) | 0.10 g/m$^2$ |
| High-boiling solvent (DOP) | 0.20 g/m$^2$ |
| 4th layer (UV absorbing layer) | |
| Gelatin | 0.94 g/m$^2$ |
| UV absorbent (UV-1) | 0.28 g/m$^2$ |
| UV absorbent (UV-2) | 0.09 g/m$^2$ |
| UV absorbent (UV-3) | 0.38 g/m$^2$ |
| Anti-irradiation dye (AI-1) | 0.02 g/m$^2$ |
| Stain preventing agent (HQ-5) | 0.10 g/m$^2$ |
| 3rd layer (Green-sensitive layer) | |
| Gelatin | 1.30 g/m$^2$ |
| Anti-irradiation dye (AI-2) | 0.01 g/m$^2$ |
| Green-sensitive emulsion (Em-G1) | 0.15 g/m$^2$ |
| Magenta coupler (M-1) | 0.20 g/m$^2$ |
| Dye image stabilizing agent (ST-3) | 0.20 g/m$^2$ |
| Dye image stabilizing agent (ST-4) | 0.17 g/m$^2$ |
| High-boiling solvent (DIDP) | 0.13 g/m$^2$ |
| High-boiling solvent (DBP) | 0.13 g/m$^2$ |
| 2nd layer (Interlayer) | |
| Gelatin | 1.20 g/m$^2$ |

-continued

| | Added amount |
|---|---|
| Anti-irradiation dye (AI-3) | 0.01g/m$^2$ |
| Stain preventing agent (HQ-2) | 0.03g/m$^2$ |
| Stain preventing agent (HQ-3) | 0.03g/m$^2$ |
| Stain preventing agent (HQ-4) | 0.05g/m$^2$ |
| Stain preventing agent (HQ-5) | 0.23g/m$^2$ |
| High-boiling solvent (DIDP) | 0.04g/m$^2$ |
| High-boiling solvent (DBP) | 0.02g/m$^2$ |
| Fluorescent whitening agent (W-1) | 0.10g/m$^2$ |
| 1st layer (Blue-sensitive layer) | |
| Gelatin | 1.20g/m$^2$ |
| Blue-sensitive emulsion (Em-B1) | 0.29g/m$^2$ |
| Yellow coupler (Y-1) | 0.70g/m$^2$ |
| Dye image stabilizing agent (ST-1) | 0.10g/m$^2$ |
| Dye image stabilizing agent (ST-2) | 0.10g/m$^2$ |
| Dye image stabilizing agent (ST-5) | 0.10g/m$^2$ |
| Stain preventing agent (HQ-1) | 0.01g/m$^2$ |
| Image stabilizing agent A | 0.15g/m$^2$ |
| High-boiling solvent (DBP) | 0.10g/m$^2$ |
| High-boiling solvent (DNP) | 0.05g/m$^2$ |

The structures of the additives used in the light-sensitive material are shown below.

SU-1: Sodium tri-i-propylnaphthalenesulfonate

SU-2: Sodium salt of di(2-ethylhexyl) sulfosuccinate

SU-3: Sodium salt of di(2,2,3,3,4,4,5,5-octafluoropentyl) sulfosuccinate

H-1: Tetrakis(vinylsulfonylmethyl)methane

H-2: Sodium salt of 2,4-dichloro-6-hydroxy-6-s-triazine

DBP: Dibutyl phthalate

DIDP: Diisodecyl phthalate

DOP: Dioctyl phthalate

DNP: Dinonyl phthalate

PVP: polyvinylpyrrolidone

HQ-1: 2,5-di-t-octylhydroquinone

HQ-2: 2,5-di-sec-dodecylhydroquinone

HQ-3: 2,5-di-sec-tetradecylhydroquinone

HQ-4: 2-sec-dodecyl-5-sec-tetradecylhydroquinone

HQ-5: 2,5-di(1,1-dimethyl-4-hexyloxycarbonyl) butylhydroquinone

Image stabilizing agent A: p-t-octylphenol

GS-1

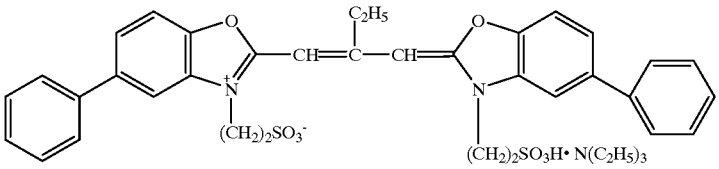

RS-1

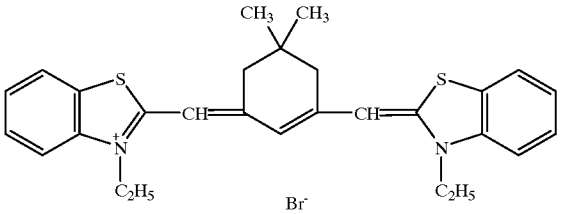

-continued
RS-2
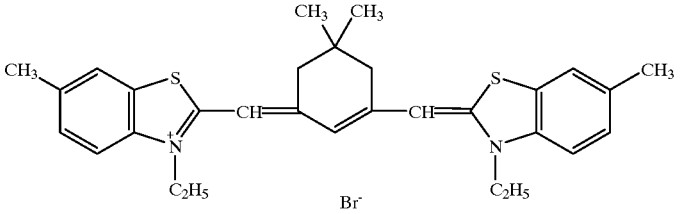
SS-1
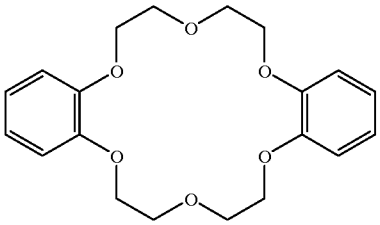
M-1
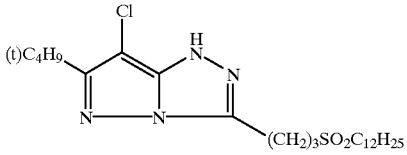
ST-3
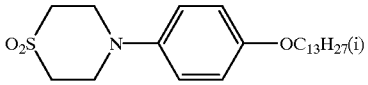
ST-4
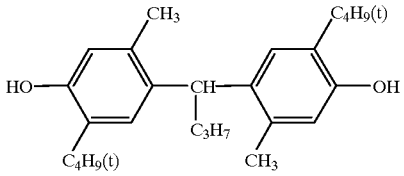
F-1
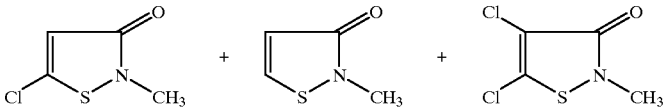
(50%) (46%) (4%) Molar ratio
Mixture, molar ratio of 50:46:4
ST-1
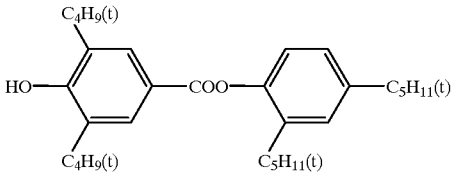
C-1
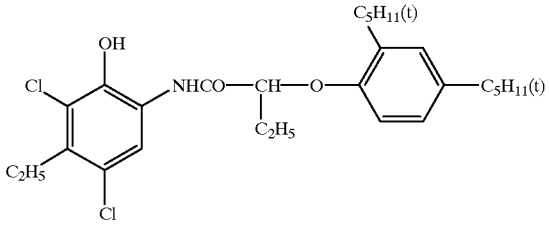
Y-1
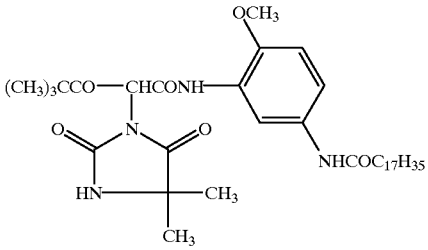
ST-2
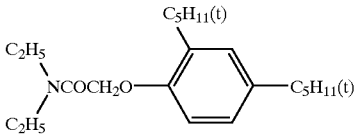

-continued
ST-5
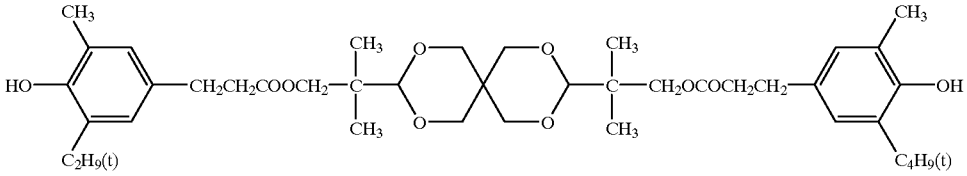
UV-1
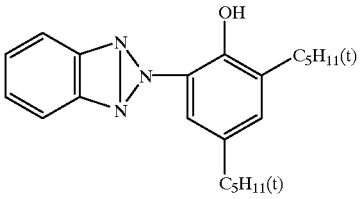
UV-2
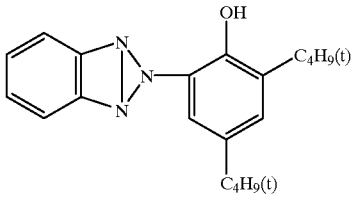
UV-3
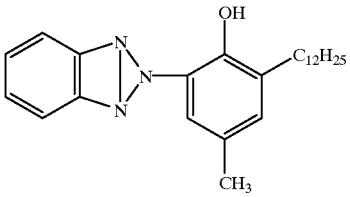
W-1
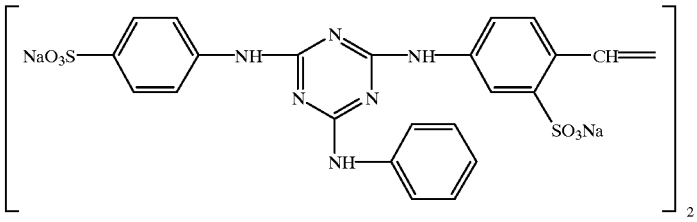
Al-1
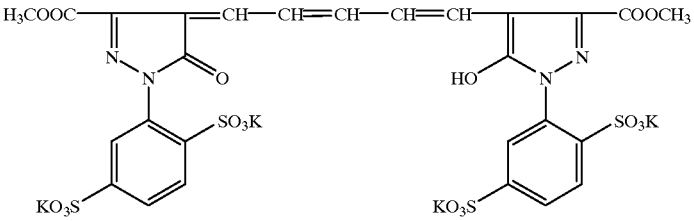
Al-2
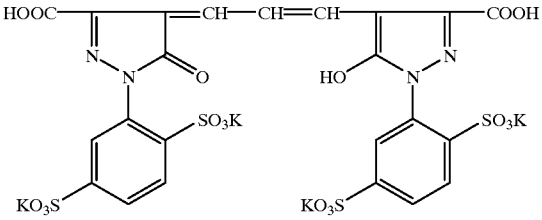
Al-3
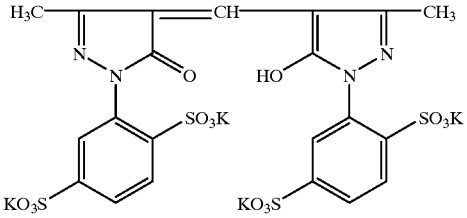

-continued

C-2

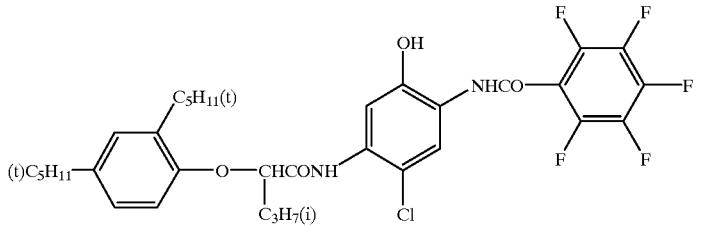

Light-sensitive Material 102 through 108 were prepared in the same manner as in Light-sensitive Material 101 except that the emulsions were replaced by those in which potassium hexachlororhodate (III) was added in the amount shown in Table 1.

Thus prepared light-sensitive material Samples 101 to 108 were subjected to the scanning exposure and processing under the following conditions. The exposure was performed using a semiconductor laser emitting light of 650 nm, a He—Ne gas laser emitting light of 544 nm and an Ar gas laser emitting light of 458 nm as the light sources. The light beams emitted from each of the light sources are reflected by a polygon mirror and scanned on the light-sensitive material for principal scanning while the light-sensitive material was transported in the perpendicular direction to the principal scanning for sub-scanning. It was confirmed by a beam monitor that the diameter of the blue-, green- and red-light beams were each 100 $\mu$m.

A gray patch was output on the light-sensitive material according to image data in which the objective value of maximum density (the objective value on the print according to the image data of (R,G,B)=(0,0,0) prepared by PhotoShop 5.0 of Adobe Systems Co. Ltd.) was set at (R,G,B)=(2.30, 2.17, 1.97), and the density from the minimum density to the maximum density was divided into 21 steps. Then the light-sensitive material was processed by the following Process 1. The calibration operation for rewriting the conversion table for controlling (C-LUT) was repeated for three times according to the densitometry results of the gray patch. After the calibration of three times, it was confirmed that the difference of the density of the gray practically printed patch to the objective density set in the conversion table, in which the image data was related to the objective density, was within the range of 5% on average. The light amount necessary to form the maximum density was read from the conversion table for control after the calibration to determinate the maximum exposure light amount ($E_{max}$).

The light-sensitive material was exposed to light by scanning according to the image date prepared by PhotoShop 5.0 after the finish of the setting of the objective density and the calibration, and processed by the following Processing 1. The image data used -in the test was prepared with a resolution of 300 dpi and composed of a black line of one pixel width ((R,G,B)=(0, 0, 0)), images of 2 point and 4 point text written by the three kind of black color ((R,G,B)=(0, 0, 0), (R,G,B)=(13, 13, 13), (R,G,B)=(26, 26, 26)), an image of white character ((R,G,B)=(225, 225, 225)) on a black background ((R,G,B)=(0, 0, 0)), groups of gray patches, yellow patches, magenta patches and cyan patches in each of the group the RGB image data was changed little by little, and a wedding photograph containing a man wearing a black tuxedo and a woman wearing a white wedding dress.

In thus obtained printed images, the density of the gray patch group was measured by a reflective spectral colorimeter/densitometer X-Rite 938, manufacture by X-Rite Co., Ltd., and the light amount forming a reflective density of 0.3 ($E_{0.3}$) in each of the color forming layers was determined according to the image data of the patch image having a Status A reflective density of (R,G,B)=(0.30, 0.30, 0.30) and the conversion table for control. With respect to thus obtained printed image, the reproducibility of fine line such as the contrast in each color and the sharpness of edge of image, that of character image such as color blur at the outline of the character and the density raising in a small white area on black background, and that of the scene image particularly the continuity of density and the color reproducibility in the intermediate to high density region, were evaluated by 20 observers. The printed image was evaluated by marking out of 100 according to higher quality of the image. A higher average point by the 20 observer shows that higher effects of the invention that the blur of fine line image is inhibited while maintaining the color reproducibility in a high and medium density region. The results are shown in Table 46.

| Processing | Temperature | Time |
|---|---|---|
| Processing 1 | | |
| Color developer CD-1 | 37.0 ± 0.5° C. | 45 seconds |
| Bleach-fixer BF-1 | 35.0 ± 2.5° C. | 45 seconds |
| Stabilizer | 35–39° C. | 45 seconds |
| Drying | 60–80° C. | 30 seconds |
| Color developer (CD-1) | | |
| Purified water | | 800 ml |
| Triethylenediamine | | 2 g |
| Diethylene glycol | | 10 g |
| Potassium bromide | | 0.02 g |
| Sodium chloride | | 4.5 g |
| Potassium sulfite | | 0.25 g |
| N-ethyl-N-(β-methanesulfonamidoethyl)-3-methyl-4-aminoaniline sulfate | | 4.0 g |
| N,N-dihydroxylamine | | 5.6 g |
| Triethanolamine | | 10.0 g |
| Sodium diethylenetriaminepentaacetate | | 2.0 g |
| Potassium carbonate | | 30 g |
| Water to make | | 1 l |

Adjust pH to 10.1 by sulfuric acid or potassium hydroxide.

| Bleach-fixer (BF-1) | |
|---|---|
| Purified water | 700 ml |
| Ferric ammonium diethylenetriamine-pentaacetate dihydrate | 65 g |
| Diethylenetriaminepentaacetic acid | 3 g |
| Ammonium thiosulfate (70% aqueous solution) | 100 ml |
| 2-amino-5-mercapto-1,3,4-thiadiazole | 2.0 g |

-continued

| Bleach-fixer (BF-1) | |
|---|---|
| Ammonium sulfite (40% aqueous solution) | 27.5 ml |
| Water to make | 1 l |

Adjust pH to 5.0 using potassium carbonate or glacial acetic acid.

| Stabilizer | |
|---|---|
| Purified water | 800 ml |
| o-phenylphenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent whitening agent (Cinopal SFP) | 2.0 g |
| 1-hydroxyethylidene-1,1-disulfonic acid | 1.8 g |
| Magnesium sulfate heptahydrate | 0.2 g |
| Polyvinylpyrrolidone | 1.0 g |
| Trisodium nitrilotriacetate | 1.5 g |
| Water to make | 1 l |

Adjust pH to 7.5 using sulfuric acid or potassium hydroxide.

TABLE 1

| Light-sensitive material | Added amount of $K_3[RhCl_6]$ (moles/mole of Ag) Red light-sensitive layer | Green light-sensitive layer | Glue light-sensitive layer | Difference of exposure light amount R | G | B | Image quality evaluation | Remarks |
|---|---|---|---|---|---|---|---|---|
| 101 | — | — | — | 0.92 | 0.85 | 0.73 | 50 | Comp. |
| 102 | $0.5 \times 10^{-8}$ | $1.2 \times 10^{-8}$ | $0.5 \times 10^{-8}$ | 0.85 | 0.55 | 0.65 | 55 | Comp. |
| 103 | $1.2 \times 10^{-8}$ | $1.2 \times 10^{-8}$ | — | 0.58 | 0.55 | 0.73 | 45 | Comp. |
| 104 | $1.2 \times 10^{-8}$ | $1.2 \times 10^{-8}$ | $1.2 \times 10^{-8}$ | 0.58 | 0.55 | 0.54 | 85 | Inv. |
| 105 | $5.2 \times 10^{-8}$ | $1.2 \times 10^{-8}$ | $5.2 \times 10^{-8}$ | 0.53 | 0.55 | 0.47 | 95 | Inv. |
| 106 | $9.8 \times 10^{-8}$ | $5.2 \times 10^{-8}$ | $1.2 \times 10^{-8}$ | 0.45 | 0.51 | 0.54 | 90 | Inv. |
| 107 | $1.5 \times 10^{-7}$ | $5.2 \times 10^{-8}$ | $5.2 \times 10^{-8}$ | 0.32 | 0.51 | 0.47 | 65 | Comp. |
| 108 | $1.5 \times 10^{-7}$ | $1.5 \times 10^{-7}$ | $1.5 \times 10^{-7}$ | 0.32 | 0.34 | 0.34 | 55 | Comp. |

Comp.; Comparative,
Inv.; Inventive

The results in Table 1 show that the difference of the logarithm of the exposure light amounts exceeds 0.6.in the yellow-, magenta- and cyan-image forming layers of the light sensitive-material Sample 101, and in the yellow- and cyan-image forming layers of light-sensitive material Sample 102, and the essential requirement of the invention are not satisfied in these light-sensitive materials. Accordingly, the evaluation score of these light-sensitive materials are low since the edge of the fine line image and the character image is blurred and the lines are grown even though the reproducibility of the scene image is good. Although Light-sensitive Material 103 satisfies the requirements of the invention other than the yellow-image forming layer, the evaluation score of the light sensitive material is lowest since yellow blurring of the fine line is occurred. Besides, The difference of the logarithm of light amounts is not more than 0.35 in all the cyan-image forming layer of Light-sensitive Material 107 and all the image forming layers. The evaluation score of each of these light-sensitive material is low since the smooth reproducibility of in the region from middle to high density of the scene image is lacked even-though the edge of the fine line and character image is sharply reproduced. In contrast, The evaluation scores of light sensitive material Samples 104 through 106 each satisfying the requirements of the invention in all the yellow-, magenta- and cyan-image forming layers, since the edge of the fine line and character image is sharply reproduced and-the middle and high density of the scene is naturally and smoothly reproduced in these light-sensitive materials.

Example 2

A yellow fine line with the width of one pixel and a solid yellow patch of 1 $cm^2$ square were output on light-sensitive material Samples 101 and 104 prepared in Example 1 by various exposure light amounts, and the light-sensitive material were process in the same manner as in Example 1. The density of the solid yellow patch image thus obtained was measured by a reflection spectral colorimeter/densitometer X-Rite 938, manufactured by X-Rite co., Ltd., and the density profile of the fine line image was measured by a micro densitometer PDM-5AR, manufactured by Konica Corporation, attached with blue filter, Kodak Wratten Filter No. 47B, by scanning under the following conditions: an allover magnification of 50 times, an aperture size of 40×4 $\mu$m and an interval of 4 $\mu$m. The scanning was carried out in the direction perpendicular to the direction of-the fine line. The half width value of the fine line was determined by the distance between the points of a density of ½ of the maximum density, and a graph was prepared, in which the half width value of the fine line image was plotted with respect to the density of the patch. The density of the solid yellow patch at the turning point of the graph (limiting $D_{max}$ ($LD_{max}$)) was determined.

Light-sensitive material Samples 101 and 104 were subjected to an exposure, processing and evaluation in the same manner as in Example 10 except that the conversion table (D-LUT) relating the image data and the objective density in each of the image forming layers were optionally _adjusted so that the maximum density of the yellow-image forming layer become to that shown in Table 47. The adjusting was carried out so that the maximum density of the cyan-image forming layer and that of the magenta-image forming layer were proportionally changed to the change of the maximum density of the yellow-image forming layer. Results are shown in Table 2.

TABLE 2

| run | Light-sensitive material | Yellow image-forming layer L Dmax | Yellow image-forming layer Dmax | Image quality evaluation | Remarks |
|---|---|---|---|---|---|
| 201 | 101 | 1.45 | 1.40 | 75 | Inv. |
| 202 | 101 | 1.45 | 1.52 | 55 | Comp. |
| 203 | 101 | 1.45 | 1.60 | 50 | Comp. |
| 204 | 101 | 1.45 | 1.68 | 50 | Comp. |
| 205 | 101 | 1.45 | 1.83 | 30 | Comp. |
| 206 | 104 | 1.78 | 1.42 | 75 | Inv. |
| 207 | 104 | 1.78 | 1.53 | 80 | Inv. |
| 208 | 104 | 1.78 | 1.61 | 85 | Inv. |
| 209 | 104 | 1.78 | 1.72 | 95 | Inv. |
| 210 | 104 | 1.78 | 1.84 | 45 | Comp. |

Comp.; Comparative, Inv.; Inventive

The results in Table 2 show that the yellow image density formed by exposure with the light amount $E_{max}$ is higher that the limiting $D_{max}$ ($LD_{max}$) in the images obtained in Run 202 through Run 205. The evaluation scores of these samples are low since the edge of the fine line and the character image blurred into the yellow image even though the reproducibility of the scene image was good. Among the examples of the invention, the samples obtained in Run 208 and Run 209 each get a high evaluation score since the blur in the fine line and the character image and the density of the image is wholly high and the reproducibility is good.

Example 3

Light-sensitive Material Samples 301 through 308 were prepared in the same manner as in Light-sensitive Material 102 in Example 1 except that the amount of the stabilizer used for the preparation of the silver halide emulsions used in each of the layers.

With respect to Light-sensitive Material 301 through 308 thus obtained, the limiting $D_{max}$ ($LD_{max}$) in the yellow-image forming layer was determined by the procedure described in Example 11. Then the limiting density $D_{max}$ ($LD_{max}$) of the magenta-image forming layer and that of cyan-image forming layer were determined in the same manner as in Example 11 except that the image data to be used for exposure were changed to the image data of magenta- or cyan-image and the filter to be used for microdensitometry were changed to a green filter, Kodak Wratten Filter No. 99 or a red filter, Kodak Wratten Filter No. 29. Moreover, the exposure light amount necessary to form $LD_{max}$ was read from the conversion table for control to determine the $LE_{max}$.

Besides, the density of the solid colored patch image when the light sensitive material exposed to light amount larger by 0.1 in logarithm than $LE_{max}$ was determined using the conversion table and an average gradation between such the two points or an shoulder gradation was determined.

Light-sensitive material Samples 301 through 308 were subjected to the image exposure, processing and evaluation in the same manner as in Example 1. Results are also shown in Table 3.

TABLE 3

| Light-sensitive material | Amount of stabilizing agent added in each emulsion (moles/mole of AgX) STAB-1 | STAB-2 | STAB-3 | Layer in which the amount of stabilizing agent is varied |
|---|---|---|---|---|
| 301 | $3 \times 10^{-4}$ | $3 \times 10^{-4}$ | $3 \times 10^{-4}$ | — |
| 302 | $3 \times 10^{-4}$ | $3 \times 10^{-4}$ | $6 \times 10^{-5}$ | All layers |
| 303 | $3 \times 10^{-4}$ | $8 \times 10^{-5}$ | $3 \times 10^{-4}$ | All layers |
| 304 | $3 \times 10^{-4}$ | $8 \times 10^{-5}$ | $6 \times 10^{-5}$ | All layers |
| 305 | $3 \times 10^{-4}$ | $8 \times 10^{-5}$ | $6 \times 10^{-5}$ | 1st layer |
| 306 | $3 \times 10^{-4}$ | $8 \times 10^{-5}$ | $6 \times 10^{-5}$ | 3rd layer |
| 307 | $3 \times 10^{-4}$ | $8 \times 10^{-5}$ | $6 \times 10^{-5}$ | 3rd and 5th layers |
| 308 | $3 \times 10^{-4}$ | $8 \times 10^{-5}$ | $6 \times 10^{-5}$ | 5th layer |

| Light-sensitive material | LDmax R | LDmax G | LDmax B | Shoulder gradation R | Shoulder gradation G | Shoulder gradation B | Image quality evaluation | Remarks |
|---|---|---|---|---|---|---|---|---|
| 301 | 1.64 | 1.51 | 1.45 | 1.41 | 1.38 | 1.25 | 55 | Comp. |
| 302 | 1.72 | 1.57 | 1.54 | 2.00 | 2.09 | 1.82 | 80 | Inv. |
| 303 | 1.71 | 1.57 | 1.55 | 2.06 | 1.99 | 1.85 | 80 | Inv. |
| 304 | 1.84 | 1.63 | 1.62 | 2.78 | 2.65 | 2.51 | 85 | Inv. |
| 305 | 1.64 | 1.51 | 1.61 | 1.41 | 1.36 | 2.43 | 55 | Comp. |
| 306 | 1.63 | 1.63 | 1.44 | 1.43 | 2.60 | 1.25 | 50 | Comp. |
| 307 | 1.85 | 1.65 | 1.44 | 2.78 | 2.64 | 1.23 | 30 | Comp. |
| 308 | 1.84 | 1.50 | 1.43 | 2.76 | 1.41 | 1.23 | 40 | Comp. |

Comp.; Comparative
Inv.; Inventive

In Table 3, the evaluation score of the light sensitive material Sample 301 is low since the edge of the fine line and the character is grown by blurring even though the reproducibility of the scene image. The evaluation scores of light-sensitive material samples 305 to 308 are low the color blur is formed around the character image even though the reproducibility in the scene image is good and the growing of the fine line and the character image are a little. Samples 302 to 304 in each of which the average gradation between the limiting $D_{max}$ ($LD_{max}$) and the density obtained by the exposure of larger by 0.1 in logarithm value that the light amount ($LE_{max}$) necessary to for the density $LE_{max}$ is within the range of from 1.5 to 4.0 each obtained high evaluation score since the scene image and the blur in the fine line and character images are good.

Example 4

Light-sensitive Material samples 401 through 405 were prepared in the same manner as in light-sensitive material Sample 104 in Example 1 except that the amount of the stabilizing agent using for the preparation of silver hailed emulsion of the fifth layer was changed as shown in Table 49. With respect to thus prepared Light-sensitive Materials 401 through 405, The limiting $D_{max}$ ($LD_{max}$) of the cyan-image forming layer and the light amount necessary to form the $LD_{max}$ were read from the conversion table for control to determine the $LD_{max}$ (in Table 49, $LE_{max}$ is shown by the relative value in logarithm to E necessary to form the maximum density).

Then light-sensitive material samples 401 through 405 were subjected to the image exposure, the processing and the evaluation in the same manner as in Example 1 except that conversion table (D-LUT) relating the image data and the objective density in each of the image forming layers were optionally adjusted so that the maximum density of the yellow-image forming layer and that of the magenta-image forming layer were proportionally changed to the change of the maximum density of the cyan-image forming layer. Moreover, the ratio of an average gradation (γH) between $L_{max}$ and $E_{max}$ to an average gradation (γL) between the exposure light amount (LhE) necessary to form a density of ½ of $LD_{max}$ and $LE_{max}$ in the cyan-image forming layer was determined using values in the conversion table for control. Results are shown in Table 4.

TABLE 4

| Light-sensitive material | Added amount of stabilizing agent in 5th layer (moles/mole of AgX) STAB-1 | STAB-2 | STAB-3 | Cyan image-forming layer LDmax | LEmax | γH/γL | Image quality evaluation | Remarks |
|---|---|---|---|---|---|---|---|---|
| 401 | $8 \times 10^{-5}$ | $8 \times 10^{-5}$ | $6 \times 10^{-5}$ | 2.21 | +0.03 | 0.68 | 95 | Comp. |
| 402 | $3 \times 10^{-4}$ | $8 \times 10^{-5}$ | $6 \times 10^{-5}$ | 2.16 | −0.02 | 1.21 | 55 | Comp. |
| 403 | $3 \times 10^{-4}$ | $8 \times 10^{-5}$ | $3 \times 10^{-5}$ | 2.14 | −0.04 | 0.83 | 90 | Inv. |
| 404 | $3 \times 10^{-4}$ | $8 \times 10^{-5}$ | $6 \times 10^{-5}$ | 2.11 | −0.06 | 0.41 | 85 | Inv. |
| 405 | $3 \times 10^{-4}$ | $3 \times 10^{-4}$ | $3 \times 10^{-5}$ | 2.05 | −0.12 | 0.32 | 55 | Comp. |

Comp.; Comparative
Inv.; Inventive

Table 4 shows that the evaluation score of light-sensitive material Sample 402 is low since the γH/γL is larger than 0.9 and a faint blur is occurred around the character even though the growing the fine line and the character image are a little. The evaluation score of light-sensitive material is also low since the γH/γL is smaller that 0.35 and the image of the fine line and the character are grown by formation of cyan blurring. It is understood that Light-sensitive Materials 403 and 404 are the preferable embodiment of the invention since the scene image is finely reproduced and the blurring of the fine line and the character are little in these light-sensitive materials. These light-sensitive materials each gets a high evaluation score near that of Light-sensitive Material 401 exposed under a condition in which $LE_{max}$ is larger than $E_{max}$. Blurring of the fine line and the text character image are difficultly occurred under such the condition.

Example 5

Light-sensitive material Samples 501 through 508 were prepared in the same manner as in Light-sensitive Material 402 except that the amount of the stabilizing agent used for preparing the silver halide emulsion of each layers was changed as shown in Table 5.

With respect to each of Light-sensitive Materials 501 through 508, the limiting $D_{max}$ ($LD_{max}$) and the light amount necessary to form the $LD_{max}$ in the yellow-, magenta- and cyan-image forming layers were read from the conversion table for control to determine the $LE_{max}$ according to the procedure described in Example 3 (in Table 6, the $LE_{max}$ is given as the relative value in logarithm to the light amount light amount $E_{max}$ necessary to form the maximum density). Then light-sensitive material Samples 501 through 508 were subjected to the image exposure, the processing and the evaluation the same as in Example 1 except that the objective maximum density was set at (R,G,B)=(2.18, 1.92, 1.88) by optionally controlling the conversion table (D-LUT) by which the image data and the objective density in each of the layers.

Besides, using the conversion table for control, the average gradation (γL) between the light amount giving a density of ½ of $LD_{max}$ (LhE) and the $LE_{max}$ was determined regarding each of the yellow-, magenta and cyan-image forming layers. Then the ratio (γLY/γLM) of the average gradation (γLY) between the light amount giving a density of ½ of $LD_{max}$ (LhE) and the $LE_{max}$ in the yellow-image forming layer to the average gradation (γLM) between the light amount giving a density of ½ of $LD_{max}$ (LhE) and the $LE_{max}$ in the magenta-image forming layer, and the ratio (γLC/γLM) of the average gradation (γLM) between the light amount giving a density of ½ of $LD_{max}$ (LhE) and the $LE_{max}$ in the cyan-image forming layer to γLM were determined. Results are shown in Tables 5 and 6.

TABLE 5

| Light-sensitive material | Amount of stabilizing agent added in emulsion (moles/mole of AgX) STAB-1 | STAB-2 | STAB-3 | Layer in which the amount of stabilizing agent is varied |
|---|---|---|---|---|
| 501 | $3 \times 10^{-4}$ | $3 \times 10^{-4}$ | $3 \times 10^{-4}$ | 1st and 3rd layers |
| 502 | $8 \times 10^{-5}$ | $3 \times 10^{-4}$ | $3 \times 10^{-4}$ | 1st and 3rd layers |
| 503 | $3 \times 10^{-4}$ | $8 \times 10^{-5}$ | $6 \times 10^{-5}$ | 1st and 3rd layers |
| 505 | $8 \times 10^{-5}$ | $3 \times 10^{-4}$ | $3 \times 10^{-4}$ | 3rd layer |
| 506 | $3 \times 10^{-4}$ | $8 \times 10^{-5}$ | $6 \times 10^{-5}$ | 3rd layer |
| 507 | $8 \times 10^{-5}$ | $3 \times 10^{-4}$ | $3 \times 10^{-4}$ | 1st layer |
| 508 | $3 \times 10^{-4}$ | $3 \times 10^{-4}$ | $3 \times 10^{-4}$ | 5th layer |

TABLE 6

| Light-sensitive material | Cyan-image forming layer LDmax | LEmax | Magenta-image forming layer LDmax | LEmax | Yellow-image forming layer LDmax | LEmax |
|---|---|---|---|---|---|---|
| 501 | 2.16 | −0.02 | 1.80 | −0.08 | 1.78 | −0.07 |
| 502 | 2.16 | −0.02 | 1.85 | −0.04 | 1.81 | −0.04 |
| 503 | 2.17 | −0.02 | 1.89 | −0.01 | 1.85 | −0.01 |
| 505 | 2.16 | −0.02 | 1.85 | −0.04 | 1.78 | −0.07 |
| 506 | 2.17 | −0.02 | 1.89 | −0.01 | 1.78 | −0.07 |
| 507 | 2.17 | −0.02 | 1.80 | −0.08 | 1.81 | −0.04 |
| 508 | 1.94 | −0.09 | 1.81 | −0.08 | 1.85 | −0.01 |

| Light-sensitive material | γLY/γLM | γLC/γLM | Image quality evaluation | Remarks |
|---|---|---|---|---|
| 501 | 0.98 | 1.36 | 55 | Comp. |
| 502 | 0.98 | 1.26 | 80 | Inv. |
| 503 | 0.98 | 1.14 | 85 | Inv. |
| 505 | 0.92 | 1.26 | 90 | Inv. |
| 506 | 0.85 | 1.15 | 45 | Comp. |
| 507 | 1.06 | 1.36 | 50 | Comp. |
| 508 | 0.98 | 0.89 | 55 | Comp. |

Comp.; Comparative,
Inv.; Inventive

As is shown in Tables 5 and 6, Samples 501, 507 and 508 do not satisfy the requirements of the invention and the evaluation scores of them are low since a red blur is occurred at the edge of the fine line and character image in Samples 501 and 507, and the fine line and character image in Sample 508 are grown by cyan blurring. In light-sensitive 9 material Samples 502 through 505 satisfying the requirements a of the invention,. the scene image is finely reproduced and the blurring of the fine line and character images are little, and a high evaluation score is gotten.

Example 6

Light-sensitive material Sample 106 prepared in Example 1 was-subjected to the image exposure, the processing and the evaluation in the same manner as in Example 1 except that the objective maximum density was set as shown in Table 7 and the conversion table (D-LUT) for control, by which the image date was relates to the objective density in each of the image forming layers, was optionally controlled so that the gray balance of the image was made optimal. Results are shown in Table 7.

TABLE 7

| | Objective density | | | | | Image quality | |
|---|---|---|---|---|---|---|---|
| run | DmaxR | DmaxG | DmaxB | DmaxR/DmaxG | DmaxB/DmaxG | evaluation | Remarks |
| 601 | 2.30 | 2.17 | 1.97 | 1.06 | 0.91 | 90 | Inv. |
| 602 | 2.23 | 2.17 | 1.95 | 1.03 | 0.90 | 80 | Inv. |
| 603 | 2.15 | 2.17 | 1.92 | 0.99 | 0.88 | 45 | Comp. |
| 604 | 2.23 | 2.17 | 1.83 | 1.03 | 0.84 | 55 | Comp. |
| 605 | 2.35 | 2.07 | 1.92 | 1.14 | 0.93 | 80 | Inv. |
| 606 | 2.15 | 2.05 | 1.85 | 1.05 | 0.90 | 80 | Inv. |
| 607 | 2.35 | 1.98 | 1.85 | 1.19 | 0.93 | 55 | Comp. |
| 608 | 2.35 | 2.07 | 2.10 | 1.14 | 1.01 | 50 | Comp. |

Comp.; Comparative,
Inv.; Inventive

As is shown in Table 7, the black area of the scene image is colored a little in each of light-sensitive materials Samples 603, 604, 607 and 608 not satisfying the requirements of the invention, and regarding the fine line and character images a red blur is shown at the edge of in Light-sensitive Material 603, a blue blur is formed in Light-sensitive Materials 604 and 607, and a yellow blur is shown in Light-sensitive Material 608. Accordingly, the evaluation scores of them are low. In Light-sensitive Materials 601, 602, 605 and 606 satisfying the requirements of the invention, the scene image is finely reproduced and the blurring of the fine line and character images are little, and a high evaluation score was obtained.

Example 7

Light-sensitive material 105 prepared in Example 1 was subjected to the image exposure, the processing and the evaluation in the same manner as in Example 1 except that the objective maximum density in each of the image forming layers was set so that the values of L*, a* and b* in 1976 CIE L*a*b* color coordinate of the area of the black patch formed by the exposure according to the image data of (R,G,B)=(0, 0, 0) were become to those shown in Table 53 and the conversion table (D-LUT) for control, by which the image date was relates to the objective density in each of the image forming layers, was optionally controlled so that the gray balance of the image was made optimal. Results are shown in Table 8.

TABLE 8

| | Values of Black patch in L*a*b* color space | | | | Image quality | |
|---|---|---|---|---|---|---|
| run | L* | a* | b* | a* + b* | evaluation | Remarks |
| 701 | 12.6 | −2.0 | −2.8 | −4.8 | 40 | Comp. |
| 702 | 12.9 | 1.2 | −6.7 | −5.5 | 40 | Comp. |
| 703 | 13.4 | −0.8 | −7.1 | −7.9 | 60 | Comp. |
| 704 | 14.5 | −0.9 | −5.4 | −6.3 | 95 | Inv. |
| 705 | 14.7 | −2.1 | −3.3 | −5.4 | 90 | Inv. |
| 706 | 15.2 | −2.9 | −4.6 | −7.5 | 85 | Inv. |
| 707 | 15.3 | −3.4 | −3.5 | −6.9 | 60 | Comp. |
| 708 | 16.9 | −1.5 | −3.5 | −5.0 | 55 | Comp. |

Comp.; Comparative, Inv.; Inventive

As is shown in Table 8, Light-sensitive Materials 701 to 703, 707 and 708 do not satisfy the requirements of the invention, and the evaluation score of them are low since a magenta blur is shown at the edge of the images of the fine line and character in Light-sensitive Material 701, a magentra blur is shown at the edge in Light-sensitive Material 702, a blue blur is shown at the edge in Light-sensitive Material 703, and a green blur is shown at the edge in Light-sensitive Material 707. The contrast of the scene image in Light-sensitive Material 708, therefore, the evaluation score of it was low.

The Light-sensitive Materials 704 through 706 satisfying the requirements of the invention each gets a high evaluation score since the reproducibility in the area of maximum density (black) and a middle density is good and little blurring is shown in the images of fine line and character.

Example 8

Light-sensitive Materials 801 through 807 were prepared in the same manner as in Light-sensitive Material 302 except that the amount of potassium hexachloroiridate (IV) used for preparing the silver halide emulsions of the each layers was changed as shown in Table 54. With respect to each of Light-sensitive Materials 801 through 807, the limiting $D_{max}$ ($LD_{max}$) of the yellow-, magenta- and cyan-image forming layer were determined in the same procedure as in Example 11. The light-sensitive materials were subjected to the image exposure, the processing and the evaluation in the same manner as in Example 10 except that the objective maximum density was set at (R,G,B)=(2.10, 2.00, 1.90). Results are shown in Table 9.

TABLE 9

| Light-sensitive material | Added amount of $K_2[IrCl_6]$ in each emulsion (moles) | | | LDmax | | |
|---|---|---|---|---|---|---|
| | 1st layer | 3rd layer | 5th layer | R | G | B |
| 801 | $4 \times 10^{-8}$ | $4 \times 10^{-8}$ | $4 \times 10^{-8}$ | 1.72 | 1.57 | 1.54 |
| 802 | $1 \times 10^{-7}$ | $1 \times 10^{-7}$ | $1 \times 10^{-7}$ | 1.92 | 1.79 | 1.73 |
| 803 | $2 \times 10^{-7}$ | $2 \times 10^{-7}$ | $2 \times 10^{-7}$ | 2.13 | 1.93 | 1.85 |
| 804 | $4 \times 10^{-8}$ | $4 \times 10^{-8}$ | $2 \times 10^{-7}$ | 2.13 | 1.58 | 1.54 |
| 805 | $2 \times 10^{-7}$ | $4 \times 10^{-8}$ | $4 \times 10^{-8}$ | 1.72 | 1.57 | 1.85 |
| 806 | $4 \times 10^{-8}$ | $2 \times 10^{-7}$ | $2 \times 10^{-7}$ | 2.14 | 1.93 | 1.54 |
| 807 | $2 \times 10^{-7}$ | $2 \times 10^{-7}$ | $4 \times 10^{-8}$ | 1.72 | 1.94 | 1.85 |

| Light-sensitive material | Reflective density | | Image quality evaluation | Remarks |
|---|---|---|---|---|
| | LDmaxR/LDmaxG | LDmaxB/LDmaxG | | |
| 801 | 1.10 | 0.98 | 80 | Inv. |
| 802 | 1.07 | 0.97 | 85 | Inv. |
| 803 | 1.10 | 0.96 | 90 | Inv. |
| 804 | 1.35 | 0.97 | 45 | Comp. |
| 805 | 1.10 | 1.18 | 50 | Comp. |
| 806 | 1.11 | 0.80 | 50 | Comp. |
| 807 | 0.89 | 0.95 | 55 | Comp. |

Comp.; Comparative,
Inv.; Inventive

In Table 9, the evaluation scores of Light-sensitive Materials 804 through 807 not satisfying the requirements of the invention are low since a colored blur is observed at the the edge of the images of fine line and character.

The Light-sensitive Materials 801 through 803 satisfying the requirements of the invention each gets a high evaluation score since the reproducibility in the area of maximum density (black) and a middle density is good and little blur is shown in the images of fine line and character.

Example 9

Light-sensitive Materials 801 through 807 prepared in Example 8 were subjected to the image exposure, the processing and the evaluation in the same procedure as in Example 8 except that the objective maximum density was set at (R,G,B)=(2.15, 2.08, 1.95). Results are shown in Table 10.

TABLE 10

| Light-sensitive material | LDmax | | | Values of Black patch in L*a*b* color space | | | | Image quality evaluation | Remarks |
|---|---|---|---|---|---|---|---|---|---|
| | R | G | B | L* | a* | b* | a* + b* | | |
| 801 | 1.72 | 1.57 | 1.54 | 18.9 | −1.9 | −3.6 | −5.5 | 80 | Inv. |
| 802 | 1.92 | 1.79 | 1.73 | 17.5 | −1.4 | −3.8 | −5.2 | 85 | Inv. |
| 803 | 2.13 | 1.93 | 1.85 | 16.2 | −1.8 | −4.3 | −6.1 | 90 | Inv. |
| 804 | 2.13 | 1.58 | 1.54 | 18.0 | −5.6 | −6.1 | −11.7 | 45 | Comp. |
| 805 | 1.72 | 1.57 | 1.85 | 18.7 | −3.8 | 1.3 | −2.6 | 50 | Comp. |
| 806 | 2.14 | 1.93 | 1.54 | 16.6 | −0.3 | −8.3 | −8.6 | 55 | Comp. |
| 807 | 1.72 | 1.94 | 1.85 | 17.3 | 1.5 | −2.4 | −0.9 | 50 | Comp. |

Comp.; Comparative,
Inv.; Inventive

In Table 10, the evaluation scores of Light-sensitive Materials 804 through 807 not satisfying the requirements of the invention are low since a colored blur is observed at the edge of the images of fine line and character.

The Light-sensitive Materials 801 through 803 satisfying the requirements of the invention each gets a high evaluation score since the reproducibility in the area of maximum density (black) and a midscale density is good and little blurring is shown in the images of fine line and character.

Example 10

Light-sensitive Materials 1001 through 1004 were prepared in the same manner as in Light-sensitive Material 104 of Example 1, except that the kind and amount of the sensitizing dye for preparing the silver halide emulsion of the first layer. Thus prepared Light-sensitive Material 1001 through 1004 were subjected to the image exposure, the processing and the evaluation in the same procedure as in Example 1, except that the blue-light source was changed from the Ar gas laser to a light source emitting light of 425 nm which was composed of a combination of a semiconductor laser emitting light of 850 nm and a SHG crystal. Moreover, the density of the yellow patch having the highest maximum density among the group of yellow patches was measured by PDA-65 Densitometer, manufactured by Konica Corporation, to determine the ratio of the green-light reflection density to the blue-light reflection density (DG/DB). The smaller value of this ratio is preferred since the value of the ratio shows that an are shown can be formed. Results are shown in Table 11.

TABLE 11

| Light-sensitive material | Sensitizing dye in 1st layer Kind | Maximum wavelength | Added amount | Difference of exposed light amount R | G | B | DG/DB | Image quality evaluation | Remarks |
|---|---|---|---|---|---|---|---|---|---|
| 1001 | (1-8) | 468 | $4 \times 10^{-4}$ | 0.58 | 0.55 | 0.54 | 0.208 | 85 | Inv. |
| | (1-1) | 495 | $1 \times 10^{-4}$ | | | | | | |
| 1002 | (1-8) | 468 | $4 \times 10^{-4}$ | 0.58 | 0.55 | 0.54 | 0.202 | 85 | Inv. |
| | (9-5) | 410 | $2 \times 10^{-4}$ | | | | | | |
| 1003 | (1-8) | 468 | $4 \times 10^{-4}$ | 0.55 | 0.55 | 0.54 | 0.198 | 85 | Inv. |
| | (5-5) | 410 | $2 \times 10^{-4}$ | | | | | | |
| 1004 | (1-8) | 468 | $4 \times 10^{-4}$ | 0.55 | 0.53 | 0.53 | 0.197 | 90 | Inv. |
| | (1-1) | 495 | $1 \times 10^{-4}$ | | | | | | |
| | (5-5) | 410 | $2 \times 10^{-4}$ | | | | | | |

Comp.; Comparative,
Inv.; Inventive

As is shown in Table 11, Light-sensitive Materials 1002 through 1004, in each of which two or more kinds of sensitizing dye different by 40 nm or more in the maximum absorption wavelength from each other, each get a high evaluation score since a high reproducibility in the area of maximum density (black) and a middle density and little blur in the images of fine line and character are obtained, and a yellow image with no contamination was observed.

Example 11

Preparation of Light-sensitive Materials Samples 1101 to 1110

Light-sensitive material Samples 1101 to 1110 were prepared in the same manner as in light-sensitive material Sample 104 in Example 1, except that the sensitizing dye used in the blue-sensitive emulsion of the 1st layer was varied with respect to the kind and the amount, as shown in Table 12.

TABLE 12

| Sample | Sensitizing dye Kind | Added amount* | Kind | Added amount* |
|---|---|---|---|---|
| 1101 | BD-1 | $5 \times 10^{-4}$ | — | — |
| 1102 | BD-2 | $5 \times 10^{-4}$ | — | — |
| 1103 | BD-3 | $5 \times 10^{-4}$ | — | — |
| 1104 | BD-4 | $5 \times 10^{-4}$ | — | — |
| 1105 | BD-5 | $5 \times 10^{-4}$ | — | — |
| 1106 | BD-1 | $1 \times 10^{-4}$ | BD-6 | $4 \times 10^{-4}$ |
| 1107 | BD-1 | $1 \times 10^{-4}$ | BD-7 | $4 \times 10^{-4}$ |
| 1108 | BD-1 | $1 \times 10^{-4}$ | BD-8 | $4 \times 10^{-4}$ |
| 1109 | BD-1 | $1 \times 10^{-4}$ | BD-9 | $4 \times 10^{-4}$ |
| 1110 | BD-1 | $1 \times 10^{-4}$ | BD-10 | $4 \times 10^{-4}$ |

*moles/mole of AgX

The thus prepared Samples 101 through 110 were subjected to the following scanning exposure and processing. The scanning exposure was performed by red light of 680 nm emitted by a semiconductor laser, green light of 544 nm emitted by a He—Ne gas laser, and blue light of 454 nm and 477 nm emitted by an Ar gas laser, blue light of 430 nm taken out by a combination of a $LiSrAlF_6$ crystal solid laser and an SHG element or light having a principal wavelength of 410 nm. The light-sensitive material was fixed on the outer periphery surface of a cylindrical drum and the drum was rotated for main scanning while exposing to the light beam, intensity of which was modulated by an acousticooptical modulation element (AOM) according to the image information. Besides, the light source was moved in the direction perpendicular to the rotating direction of the drum for performing the sub-scanning. $D_{max}$ was set at (R,G,B)= (2.35, 2.25, 2.10) in Status A density. The time for exposure was $10^{-6}$ seconds per pixel. It was confirmed by a beam monitor that the beam diameter was 100 $\mu$m. The scanning exposure was performed with a resolution of 381 dpi while controlling the exposure light amount of the each of colors so that images of a gray, yellow, magenta and cyan patches of 1 cm×1 cm were reproduced. After scanning, the light-sensitive material was processed in the same manner as in Example 1. Each step of thus obtained color patched of the four color was subjected to densitometry by X-Rite densitometer. Besides, the light-sensitive material was exposed to a fine line image of a pixel width of each color in the stepwise light amount that same as in the patch image exposure in the direction of main scanning, and processed by Processing 1 to obtain a fine line image. Among thus obtained images, the fine line image obtained by exposing of the light amount the same as to that obtaining the $D_{max}$ was scanned by a microdensitometer PDM-5AR, manufactured by Konica Corporation, in the direction perpendicular to the direction of the fine line using an aperture of 2 $\mu$m×100 $\mu$m with a sampling pitch of 2 $\mu$m to obtain a density profile of the fine line. Out put images of a scene and portrait photographed by a digital camera, a rectangle wave pattern which was a repeating of fine line image, and a lattice image were added to the foregoing images of patch and fine line as a part of subjects of the examination by observers.

Blue light picked up at intervals of 10 nm in the range of from 390 nm to 490 nm by the combination of a light emission diode and an interference filter KL-39 to -48 or -49, manufactured by Toshiba Glass Plate Co., Ltd., was used as the blue light source, and glue light picked up at intervals of 10 nm in the range of from 510 nm to 570 nm by the combination of a light emission diode and an interference filter KL-51 to -56 or -57, manufactured by Toshiba Glass Plate Co., Ltd., was used as the green light source. Images of the yellow, magenta and cyan patch were output, and $S_\lambda$ and $SD_\lambda$ at each of the wavelength and the average values thereof $S_B$, $S_G$, $SD_B$ and $SD_G$ were determined.

The $S_\lambda$ was a relative value expressed by the difference to $S_{470}$ Of Sample 1106.

The printed images thus obtained were evaluated according to the half width vale of the density profile of fine line image, blue-, green- and red-density of the yellow patch image with the maximum density, the density of unexposed area, and the sensuous evaluation by 30 observers. The half width vale of density profile is expressed by the distance of the points having a density of ½ of the peak density on the density profile prepared by the above-mentioned procedure. When the half value width is smaller, expansion of the fine line is small and the outline of the image is cleared, as a result, the image is reproduced with a high sharpness. The reproducibility of fine line such as the contrast in each color and the sharpness of edge of image, and that of character image such as color blur at the outline of the character and the density raising in a small white area on black ground were particularly evaluated in the sensuous evaluation by the observers. The printed image was evaluated by marking out of 100 according to higher quality of the image and the average value thereof was calculated. The shoulder spectral sensitivity $S_\lambda$, and its average value $S_B$, $SD_\lambda$ and its average value $SD_B$, the width of the fine line and the evaluation by the observers obtained by each of the exposing procedure are listed in Table 13.

.Samples 101 through 110 when exposed to light at 454 nm or 477 nm. Specifically, Samples 1106 to 1110, which satisfy the preferred requirements of the invention with respect to various exposure procedure each different in the wavelength of the exposing light, exhibited superior results. Furthermore, the sharpness of the yellow image and that of the magenta image are suitably matched and reproducibility and the stability of the black fine image are also considerably raised by setting the $S_B/S_G$ and $SD_B/SD_G$ so that the requirements of the invention are satisfied.

Such facts are certainly reflected to the evaluation result by the observers. These results shows that Samples 1106 through 1110 give stably a high print quality with respect to various digital exposing apparatus and that the samples are more preferable embodiments of the invention.

Example 12

Light-sensitive material Samples 1201 to 1209 were prepared in the same manner as in Sample 104 of Example 1, except that the sensitizing dye used in the silver halide emulsion in the 1st layer was varied with respect to the kind and the amount, as shown in Table 14.

TABLE 13

| | LED: 410 nm | | | | SHG: 430 nm | | | |
|---|---|---|---|---|---|---|---|---|
| Sample No. | $S_\lambda$ | $SD_\lambda$ | Half value width | Score | $S_\lambda$ | $SD_\lambda$ | Half value width | Score |
| 1101(Inv.) | −1.477 | −0.983 | 166 | 35 | −0.996 | −0.679 | 111 | 54 |
| 1102(Inv.) | −1.424 | −0.930 | 154 | 39 | −0.997 | −0.679 | 109 | 61 |
| 1103(Inv.) | −1.357 | −0.863 | 137 | 47 | −0.902 | −0.584 | 106 | 68 |
| 1104(Inv.) | −1.295 | −0.801 | 124 | 45 | −0.821 | −0.504 | 102 | 74 |
| 1105(Inv.) | −1.301 | −0.807 | 126 | 53 | −0.819 | −0.501 | 100 | 76 |
| 1106(Inv.) | −1.000 | −0.506 | 101 | 79 | −0.779 | −0.461 | 98 | 82 |
| 1107(Inv.) | −1.010 | −0.516 | 102 | 79 | −0.768 | −0.451 | 97 | 83 |
| 1108(Inv.) | −0.991 | −0.497 | 99 | 81 | −0.794 | −0.476 | 98 | 81 |
| 1109(Inv.) | −0.967 | −0.474 | 98 | 83 | −0.792 | −0.475 | 99 | 79 |
| 1110(Inv.) | −0.989 | −0.496 | 98 | 84 | −0.773 | −0.456 | 96 | 85 |

| | Ar: 454 nm | | | | Ar: 477 nm | | | |
|---|---|---|---|---|---|---|---|---|
| Sample No. | $S_\lambda$ | $SD_\lambda$ | Half value width | Score | $S_\lambda$ | $SD_\lambda$ | Half value width | Score |
| 1101(Inv.) | −0.282 | 0.027 | 90 | 89 | −0.430 | −0.197 | 91 | 89 |
| 1102(Inv.) | −0.285 | 0.024 | 89 | 92 | −0.486 | −0.252 | 93 | 88 |
| 1103(Inv.) | −0.229 | 0.080 | 90 | 91 | −0.601 | −0.367 | 99 | 78 |
| 1104(Inv.) | −0.167 | 0.142 | 89 | 93 | −0.898 | −0.665 | 110 | 64 |
| 1105(Inv.) | −0.167 | 0.142 | 91 | 90 | −0.869 | −0.635 | 108 | 66 |
| 1106(Inv.) | −0.248 | 0.061 | 90 | 92 | −0.446 | −0.212 | 92 | 88 |
| 1107(Inv.) | −0.239 | 0.070 | 91 | 88 | −0.466 | −0.232 | 92 | 87 |
| 1108(Inv.) | −0.251 | 0.058 | 89 | 94 | −0.440 | −0.206 | 91 | 89 |
| 1109(Inv.) | −0.245 | 0.064 | 91 | 91 | −0.465 | −0.231 | 91 | 91 |
| 1110(Inv.) | −0.254 | 0.055 | 89 | 92 | −0.435 | −0.201 | 90 | 89 |

| | $S_\lambda$ | | | $SD_\lambda$ | | |
|---|---|---|---|---|---|---|
| Sample No. | Max-Min | $S_{470}$-$S_B$ | $S_B/S_G$ | Max-Min | $S_{470}$-$S_B$ | $S_B/S_G$ |
| 1101(Inv.) | 1.763 | 0.754 | 0.631 | 1.329 | 0.691 | 0.466 |
| 1102(Inv.) | 1.755 | 0.755 | 0.635 | 1.273 | 0.692 | 0.473 |
| 1103(Inv.) | 1.524 | 0.629 | 0.601 | 1.118 | 0.566 | 0.421 |
| 1104(Inv.) | 1.444 | 0.563 | 0.603 | 1.044 | 0.500 | 0.424 |
| 1105(Inv.) | 1.431 | 0.565 | 0.595 | 1.055 | 0.502 | 0.412 |
| 1106(Inv.) | 1.118 | 0.524 | 0.464 | 0.810 | 0.461 | 0.213 |
| 1107(Inv.) | 1.143 | 0.508 | 0.466 | 0.803 | 0.445 | 0.214 |
| 1108(Inv.) | 1.172 | 0.532 | 0.470 | 0.803 | 0.469 | 0.221 |
| 1109(Inv.) | 1.169 | 0.521 | 0.469 | 0.796 | 0.458 | 0.220 |
| 1110(Inv.) | 1.184 | 0.526 | 0.468 | 0.797 | 0.463 | 0.219 |

As can be seen from the results in Table 13, the fine line width is stably a small value and an image expression with a good sharpness and little blurring can be attained in

TABLE 14

| Sample | Sensitizing dye Kind | Added amount* | Kind | Added amount* | Kind | Added amount* |
|---|---|---|---|---|---|---|
| 1201 | (1-1) | $5 \times 10^{-4}$ | — | — | — | — |
| 1202 | (1-1) | $5.5 \times 10^{-4}$ | — | — | — | — |
| 1203 | (1-1) | $1 \times 10^{-4}$ | (1-8) | $4 \times 10^{-4}$ | — | — |
| 1204 | (1-1) | $1.1 \times 10^{-4}$ | (1-8) | $4.4 \times 10^{-4}$ | — | — |
| 1205 | (1-1) | $1 \times 10^{-4}$ | (1-8) | $4 \times 10^{-4}$ | (5-6) | $5 \times 10^{-5}$ |
| 1206 | (1-1) | $1 \times 10^{-4}$ | (1-8) | $4 \times 10^{-4}$ | (5-1) | $5 \times 10^{-5}$ |
| 1207 | (1-1) | $1 \times 10^{-4}$ | (1-8) | $4 \times 10^{-4}$ | (5-2) | $5 \times 10^{-5}$ |
| 1208 | (1-1) | $1 \times 10^{-4}$ | (1-8) | $4 \times 10^{-4}$ | (5-4) | $5 \times 10^{-5}$ |
| 1209 | (1-1) | $1 \times 10^{-4}$ | (1-8) | $4 \times 10^{-4}$ | (5-5) | $5 \times 10^{-5}$ |

*moles/mole of AgX

The thus obtained samples 1201 to 1209 were subjected to scanning exposure by the apparatus the same as in Example 20 while the exposure light amount of R. G, B were each stepwise controlled to form similar output images. Then the samples were processed according to the foregoing processing procedure. The thus obtained printed samples were evaluated in the same manner as in Example 11. Results are listed in Table 62. The $S_\lambda$ is a relative value expressed by the difference to $S_{470}$ of Sample 1203.

As can be seen from the results in Table 15, the fine line width is stably a small value and an image expression with a good sharpness and little blurring can be attained in Samples 1201 through 1209 when exposed to light at 454 nm or 477 nm. Specifically, Samples 1203 to 1209, which satisfy the preferred requirements of the invention realize image expression with a high sharpness and little. Particularly, it is understood that samples 1205 through 1209 are the preferable embodiment of the invention since in which an excellent fine line reproducibility and fine image expressing ability are stably obtained with respect to the yellow and black images.

Example 13

Preparation of Light-sensitive Material Samples 1301 to 1310

Light-sensitive material samples 1301 through 1310 were prepared in a manner similar to Sample 104 in Example 1, except that the sensitizing dye used in the 1st layer was varied with respect to the kind and amount, as shown in Table 16.

The thus prepared light-sensitive material Samples 1301 to 1310 were each exposed to light by scanning and processed under the following conditions. The scanning expo-

TABLE 15

| Sample No. | LED: 410 nm $S_\lambda$ | $SD_\lambda$ | Half value width | Score | SHG: 430 nm $S_\lambda$ | $SD_\lambda$ | Half value width | Score |
|---|---|---|---|---|---|---|---|---|
| 1201(Inv.) | −1.467 | −0.973 | 163 | 37 | −1.042 | −0.725 | 117 | 52 |
| 1202(Inv.) | −1.442 | −0.948 | 157 | 38 | −0.992 | −0.675 | 109 | 64 |
| 1203(Inv.) | −1.001 | −0.507 | 101 | 75 | −0.758 | −0.440 | 98 | 82 |
| 1204(Inv.) | −0.989 | −0.495 | 100 | 77 | −0.718 | −0.400 | 97 | 83 |
| 1205(Inv.) | −0.870 | −0.376 | 96 | 85 | −0.611 | −0.294 | 94 | 87 |
| 1206(Inv.) | −0.864 | −0.370 | 96 | 86 | −0.678 | −0.361 | 96 | 82 |
| 1207(Inv.) | −0.858 | −0.364 | 95 | 87 | −0.629 | −0.311 | 95 | 86 |
| 1208(Inv.) | −0.870 | −0.376 | 95 | 86 | −0.654 | −0.337 | 95 | 87 |
| 1209(Inv.) | −0.883 | −0.389 | 97 | 84 | −0.708 | −0.391 | 97 | 83 |

| Sample No. | Ar: 454 nm $S_\lambda$ | $SD_\lambda$ | Half value width | Score | Ar: 477 nm $S_\lambda$ | $SD_\lambda$ | Half value width | Score |
|---|---|---|---|---|---|---|---|---|
| 1201(Inv.) | −0.282 | 0.027 | 89 | 91 | −0.430 | −0.197 | 91 | 89 |
| 1202(Inv.) | −0.285 | 0.033 | 91 | 90 | −0.434 | −0.200 | 90 | 90 |
| 1203(Inv.) | −0.247 | 0.062 | 90 | 91 | −0.442 | −0.208 | 91 | 88 |
| 1204(Inv.) | −0.236 | 0.073 | 90 | 90 | −0.418 | −0.184 | 91 | 90 |
| 1205(Inv.) | −0.229 | 0.080 | 89 | 92 | −0.429 | −0.196 | 92 | 89 |
| 1206(Inv.) | −0.237 | 0.072 | 90 | 90 | −0.440 | −0.206 | 90 | 91 |
| 1207(Inv.) | −0.244 | 0.065 | 90 | 91 | −0.438 | −0.205 | 90 | 90 |
| 1208(Inv.) | −0.246 | 0.063 | 89 | 91 | −0.445 | −0.211 | 91 | 90 |
| 1209(Inv.) | −0.249 | 0.060 | 90 | 90 | −0.441 | −0.207 | 91 | 89 |

| Sample No. | $S_\lambda$ Max-Min | $S_{470}$-$S_B$ | $S_B/S_G$ | $SD_\lambda$ Max-Min | $S_{470}$-$S_B$ | $S_B/S_G$ |
|---|---|---|---|---|---|---|
| 1201(Inv.) | 1.755 | 0.755 | 0.629 | 1.322 | 0.692 | 0.464 |
| 1202(Inv.) | 1.743 | 0.745 | 0.621 | 1.297 | 0.682 | 0.451 |
| 1203(Inv.) | 1.118 | 0.523 | 0.464 | 0.811 | 0.461 | 0.212 |
| 1204(Inv.) | 1.138 | 0.546 | 0.452 | 0.836 | 0.483 | 0.193 |
| 1205(Inv.) | 1.015 | 0.467 | 0.408 | 0.687 | 0.404 | 0.126 |
| 1206(Inv.) | 1.010 | 0.477 | 0.413 | 0.686 | 0.414 | 0.134 |
| 1207(Inv.) | 0.990 | 0.475 | 0.418 | 0.685 | 0.412 | 0.142 |
| 1208(Inv.) | 0.979 | 0.477 | 0.425 | 0.698 | 0.414 | 0.153 |
| 1209(Inv.) | 0.976 | 0.486 | 0.431 | 0.719 | 0.424 | 0.161 |

sure was performed by red light of 680 nm emitted by a semiconductor laser, green light of 544 nm emitted by a He—Ne gas laser, and blue light of 454 nm and 477 nm emitted by an Ar gas laser, blue light of 430 nm taken out by a combination of a $LiSrAlF_6$ crystal solid laser and an SHG element or light having a principal wavelength of 410 nm. The light-sensitive material was fixed on the outer surface of a cylindrical drum and the drum was rotated for main scanning while exposing to the light beam, intensity of which was modulated by an acoustic-optical modulation element (AOM) according to the image information. Besides, the light source was moved in the direction perpendicular to the rotating direction of the drum for performing the sub-scanning. $D_{max}$ was set at (R,G,B)=(2.35, 2.30, 2.20) in Status A density. The time for exposure was $10^{-6}$ seconds per pixel. It was confirmed by a beam monitor that the beam diameter was 100 $\mu$m. The scanning exposure was performed with a resolution of 381 dpi while controlling the exposure light amount of the each of colors so that images of a gray, yellow, magenta and cyan patches of 1 cm×1 cm were reproduced. After the scanning, the light-sensitive material was processed according the same procedure as in Example 1. Each step of thus obtained color patched of the four color was subjected to densitometry by X-Rite densitometer. Besides, the light-sensitive material was exposed to a fine line image of a pixel width of each color in the stepwise light amount that same as in the patch image exposure in the direction of main scanning, and similarly processed to obtain a fine line image. Among the thus obtained images, the fine line image obtained by exposing of the light amount the same as to that obtaining the $D_{max}$ was scanned by a microdensitometer PDM-5AR, manufactured by Konica Corporation, in the direction perpendicular to the direction of the fine line using an aperture of 2 $\mu$m×100 $\mu$m with a sampling pitch of 2 $\mu$m to obtain a density profile of the fine line. Output images of a scene and portrait photographed by a digital camera, a rectangle wave pattern which was a repeating of fine line image, and a lattice image were added to the foregoing images of patch and fine line as a part of subjects of the examination by observers.

The printed images thus obtained were evaluated with respect to the half width value of the density profile of fine line image, blue-, green- and red-densities of the yellow patch image with the maximum density, the density of unexposed area, and the sensuous evaluation by 30 observers. The half width vale of density profile is expressed by the distance of the points having a density of ½ of the peak density on the density profile prepared by the above-mentioned procedure. When the half value width is smaller, expansion of the fine line is small and the outline of the image is cleared, as a result, the image is expressed with a high sharpness. The reproducibility of fine line such as the contrast in each color and the sharpness of edge of image, and that of character image such as color blur at the outline of the character and the density raising in a small white area on black background were particularly evaluated in the sensuous evaluation by the observers. The printed image was evaluated by marking out of 100 according to higher quality of the image and the average value thereof was calculated. The results obtained by each of the exposure procedures, the sensitivity of the blue-sensitive layer, the blue-, green- and red-densities of the yellow patch with the maximum density, the half value width, the density of the unexposed area and evaluation by the observers are listed in Tables 16 to 18. The sensitivity of the blue-sensitive layer is expressed by a value of product of −1 and the logarithm of light amount necessary to form a yellow image having a density of 0.8. The difference between the such a value of each of the light-sensitive material and the value of light-sensitive material Sample 1301 to the blue-light of 454 nm emitted from the Ar gas laser was calculated to the relative value of the blue-light sensitivity listed in Tables 16 to 18.

TABLE 16

| | LED: 410 nm | | | | | | SHG: 430 nm | | | | | |
|---|---|---|---|---|---|---|---|---|---|---|---|---|
| Sample | Sensitivity of blue-sensitive layer | Density of yellow patch | | | Half value width of fine line | Score by observers | Sensitivity of blue-sensitive layer | Density of yellow patch | | | Half value width of fine line | Score by observers |
| | | Blue | Green | Red | | | | Blue | Green | Red | | |
| 1301 | −0.720 | 2.08 | 1.21 | 0.26 | 112 | 62 | −0.400 | 2.08 | 0.62 | 0.13 | 98 | 87 |
| 1302 | −0.799 | 2.07 | 1.37 | 0.30 | 117 | 53 | −0.495 | 2.06 | 0.69 | 0.14 | 101 | 82 |
| 1303 | −0.672 | 2.06 | 1.12 | 0.24 | 109 | 64 | −0.352 | 2.08 | 0.59 | 0.12 | 95 | 90 |
| 1304 | −0.569 | 2.06 | 0.91 | 0.19 | 106 | 72 | −0.233 | 2.08 | 0.51 | 0.10 | 93 | 94 |
| 1305 | −0.418 | 2.07 | 0.61 | 0.12 | 97 | 84 | −0.158 | 2.06 | 0.45 | 0.09 | 92 | 97 |
| 1306 | −0.291 | 2.07 | 0.35 | 0.06 | 92 | 95 | −0.061 | 2.07 | 0.39 | 0.08 | 88 | 98 |
| 1307 | −0.435 | 2.07 | 0.64 | 0.13 | 99 | 85 | −0.175 | 2.07 | 0.47 | 0.09 | 92 | 94 |
| 1308 | −0.317 | 2.07 | 0.40 | 0.07 | 93 | 93 | −0.087 | 2.05 | 0.41 | 0.08 | 90 | 96 |
| 1309 | −0.465 | 2.05 | 0.70 | 0.14 | 101 | 83 | −0.205 | 2.08 | 0.49 | 0.10 | 93 | 95 |
| 1310 | −0.362 | 2.06 | 0.49 | 0.09 | 97 | 90 | −0.132 | 2.07 | 0.44 | 0.09 | 90 | 95 |

TABLE 17

| Sample | Ar: 454 nm Sensitivity of blue-sensitive layer | Density of yellow patch Blue | Green | Red | Half value width of fine line | Score by observers | Ar: 477 nm Sensitivity of blue-sensitive layer | Density of yellow patch Blue | Green | Red | Half value width of fine line | Score by observers |
|---|---|---|---|---|---|---|---|---|---|---|---|---|
| 1301 | 0.000 | 2.06 | 0.48 | 0.11 | 90 | 94 | −0.210 | 2.05 | 0.56 | 0.11 | 93 | 92 |
| 1302 | −0.115 | 2.06 | 0.52 | 0.12 | 91 | 96 | −0.315 | 2.06 | 0.66 | 0.13 | 96 | 91 |
| 1303 | −0.021 | 2.07 | 0.49 | 0.11 | 88 | 96 | −0.300 | 2.07 | 0.64 | 0.13 | 95 | 94 |
| 1304 | 0.084 | 2.06 | 0.45 | 0.10 | 91 | 96 | −0.240 | 2.06 | 0.59 | 0.12 | 94 | 92 |
| 1305 | 0.098 | 2.07 | 0.45 | 0.10 | 91 | 93 | −0.271 | 2.07 | 0.62 | 0.12 | 95 | 94 |
| 1306 | 0.158 | 2.06 | 0.42 | 0.09 | 90 | 96 | −0.256 | 2.05 | 0.60 | 0.12 | 92 | 91 |
| 1307 | 0.081 | 2.06 | 0.45 | 0.10 | 92 | 95 | −0.287 | 2.07 | 0.63 | 0.13 | 94 | 92 |
| 1308 | 0.132 | 2.06 | 0.43 | 0.09 | 92 | 97 | −0.280 | 2.08 | 0.62 | 0.13 | 94 | 92 |
| 1309 | 0.051 | 2.05 | 0.46 | 0.10 | 88 | 95 | −0.300 | 2.05 | 0.64 | 0.13 | 93 | 94 |
| 1310 | 0.087 | 2.05 | 0.45 | 0.10 | 90 | 97 | −0.300 | 2.05 | 0.64 | 0.13 | 92 | 92 |

TABLE 18

| Sample | Density of unexposed area Blue | Green | Red | Remarks |
|---|---|---|---|---|
| 1301 | 0.073 | 0.114 | 0.085 | Inv. |
| 1302 | 0.072 | 0.113 | 0.085 | Inv. |
| 1303 | 0.075 | 0.113 | 0.084 | Inv. |
| 1304 | 0.073 | 0.119 | 0.083 | Inv. |
| 1305 | 0.073 | 0.116 | 0.087 | Inv. |
| 1306 | 0.071 | 0.115 | 0.083 | Inv. |
| 1307 | 0.073 | 0.114 | 0.084 | Inv. |
| 1308 | 0.072 | 0.117 | 0.083 | Inv. |
| 1309 | 0.072 | 0.117 | 0.082 | Inv. |
| 1310 | 0.072 | 0.116 | 0.084 | Inv. |

Inv.; Inventive

As can be seen from the results in Tables 16 to 18, the fine line width is stably a small value and an image expression with a good sharpness and little blurring can be attained in Samples 1301 through 1310 when exposed to light at 454 nm or 477 nm. Specifically, Samples 1305 to 1310, which satisfy the preferred requirements of the invention exhibited superior results even though no specific difference in the density of the unexposed area with respect to the various exposing procedure particularly when a relatively short wavelength blue-light such as 410 nm and 430 nm is used. It is understood that the green-density and red-density of the yellow patch image having the maximum density are stably low and a clear yellow image with little color contamination is reproduced in the high density region. Such the results are certainly reflected in the evaluation results by the observers. It is understood the foregoing results that light-sensitive materials 1305 to 1310 are preferable embodiment of the invention since a high print quality can be stably obtained by the various digital exposing apparatus.

Example 14

Light-sensitive material Samples 1401 through 1410 were prepared in a manner similar to Sample 104 in Example 1, except that the sensitizing dye used in the 1st layer was varied with respect to the kind and amount, as shown in Table 19.

TABLE 19

| Sample | Kind of sensitizing dye | Added amount moles/mole of AgX | Kind of sensitizing dye | Added amount moles/mole of AgX | Kind of sensitizing dye | Added amount moles/mole of AgX |
|---|---|---|---|---|---|---|
| 1401 | 1-1 | $1 \times 10^{-4}$ | 1-8 | $4 \times 10^{-4}$ | — | — |
| 1402 | 1-1 | $2 \times 10^{-4}$ | 1-8 | $3 \times 10^{-4}$ | — | — |
| 1403 | 1-1 | $5 \times 10^{-5}$ | 1-8 | $4.5 \times 10^{-4}$ | — | — |
| 1404 | 1-1 | $1 \times 10^{-4}$ | 1-8 | $5 \times 10^{-4}$ | — | — |
| 1405 | 1-1 | $1 \times 10^{-4}$ | 1-8 | $4 \times 10^{-4}$ | 3-2 | $2 \times 10^{-5}$ |
| 1406 | 1-1 | $1 \times 10^{-4}$ | 1-8 | $4 \times 10^{-4}$ | 3-2 | $5 \times 10^{-5}$ |
| 1407 | 1-1 | $1 \times 10^{-4}$ | 1-8 | $4 \times 10^{-4}$ | 3-3 | $5 \times 10^{-5}$ |
| 1408 | 1-1 | $1 \times 10^{-4}$ | 1-8 | $4 \times 10^{-4}$ | 3-3 | $1 \times 10^{-4}$ |
| 1409 | 1-1 | $1 \times 10^{-4}$ | 1-8 | $4 \times 10^{-4}$ | 3-7 | $2 \times 10^{-5}$ |
| 1410 | 1-1 | $1 \times 10^{-4}$ | 1-8 | $4 \times 10^{-4}$ | 3-7 | $5 \times 10^{-5}$ |

The light-sensitive material samples were exposed by scanning by the R, G and B light beams while the light amount was controlled stepwise so that images similar to those obtained in Example 13. Then the light-sensitive material were processed by Processing 1. The printed samples thus obtained were evaluated in the same manner as in Example 13. The results are shown in Tables 8 to 10. The sensitivity of the blue-sensitive layer is expressed by a value of product of −1 and the logarithm of light amount necessary to form a yellow image having a density of 0.8. The difference between the such the value of each of the light-sensitive material and the value of light-sensitive material Sample 1401 to the blue-light of 454 nm emitted from the Ar gas laser was calculated to the relative value of the blue-light sensitivity listed in Tables 20 to 22.

TABLE 20

| Sample | LED: 410 nm Sensitivity of blue-sensitive layer | Density of yellow patch Blue | Green | Red | Half value width of fine line | Score by observers | SHG: 430 nm Sensitivity of blue-sensitive layer | Density of yellow patch Blue | Green | Red | Half value width of fine line | Score by observers |
|---|---|---|---|---|---|---|---|---|---|---|---|---|
| 1401 | −0.720 | 2.06 | 1.21 | 0.26 | 113 | 60 | −0.400 | 2.05 | 0.62 | 0.13 | 96 | 86 |
| 1402 | −0.799 | 2.06 | 1.37 | 0.30 | 116 | 54 | −0.495 | 2.06 | 0.69 | 0.14 | 100 | 86 |
| 1403 | −0.672 | 2.06 | 1.12 | 0.24 | 109 | 63 | −0.352 | 2.07 | 0.59 | 0.12 | 97 | 90 |
| 1404 | −0.569 | 2.08 | 0.91 | 0.19 | 106 | 74 | −0.233 | 2.08 | 0.51 | 0.10 | 91 | 91 |
| 1405 | −0.424 | 2.07 | 0.62 | 0.12 | 97 | 85 | −0.134 | 2.07 | 0.44 | 0.09 | 90 | 97 |
| 1406 | −0.300 | 2.06 | 0.37 | 0.06 | 94 | 93 | −0.025 | 2.06 | 0.36 | 0.07 | 86 | 100 |
| 1407 | −0.470 | 2.06 | 0.71 | 0.14 | 102 | 80 | −0.210 | 2.06 | 0.49 | 0.10 | 94 | 95 |
| 1408 | −0.369 | 2.07 | 0.51 | 0.10 | 94 | 90 | −0.139 | 2.07 | 0.44 | 0.09 | 89 | 96 |
| 1409 | −0.455 | 2.06 | 0.68 | 0.14 | 98 | 81 | −0.195 | 2.05 | 0.48 | 0.10 | 93 | 94 |
| 1410 | −0.347 | 2.06 | 0.46 | 0.09 | 96 | 91 | −0.117 | 2.06 | 0.43 | 0.08 | 90 | 98 |

TABLE 21

| Sample | Ar: 454 nm Sensitivity of blue-sensitive layer | Density of yellow patch Blue | Green | Red | Half value width of fine line | Score by observers | Ar: 477 nm Sensitivity of blue-sensitive layer | Density of yellow patch Blue | Green | Red | Half value width of fine line | Score by observers |
|---|---|---|---|---|---|---|---|---|---|---|---|---|
| 1401 | 0.000 | 2.08 | 0.48 | 0.11 | 92 | 95 | −0.060 | 2.08 | 0.57 | 0.11 | 89 | 94 |
| 1402 | −0.115 | 2.07 | 0.52 | 0.12 | 92 | 94 | −0.172 | 2.05 | 0.67 | 0.13 | 89 | 93 |
| 1403 | −0.021 | 2.06 | 0.49 | 0.11 | 92 | 97 | −0.150 | 2.06 | 0.65 | 0.13 | 90 | 94 |
| 1404 | 0.084 | 2.07 | 0.45 | 0.10 | 89 | 96 | −0.083 | 2.06 | 0.59 | 0.12 | 89 | 97 |
| 1405 | 0.122 | 2.07 | 0.44 | 0.09 | 90 | 93 | −0.082 | 2.07 | 0.59 | 0.12 | 90 | 96 |
| 1406 | 0.194 | 2.08 | 0.41 | 0.09 | 90 | 97 | −0.048 | 2.06 | 0.56 | 0.11 | 88 | 95 |
| 1407 | 0.046 | 2.08 | 0.47 | 0.10 | 92 | 96 | −0.158 | 2.08 | 0.66 | 0.13 | 89 | 95 |
| 1408 | 0.079 | 2.06 | 0.45 | 0.10 | 91 | 96 | −0.162 | 2.05 | 0.66 | 0.13 | 91 | 95 |
| 1409 | 0.061 | 2.07 | 0.46 | 0.10 | 92 | 97 | −0.143 | 2.07 | 0.64 | 0.13 | 92 | 96 |
| 1410 | 0.102 | 2.07 | 0.45 | 0.10 | 88 | 96 | −0.140 | 2.07 | 0.64 | 0.13 | 92 | 93 |

TABLE 22

| Sample | Density of unexposed area Blue | Green | Red | Remarks |
|---|---|---|---|---|
| 1401 | 0.071 | 0.116 | 0.088 | Inv. |
| 1402 | 0.073 | 0.115 | 0.086 | Inv. |
| 1403 | 0.074 | 0.116 | 0.081 | Inv. |
| 1404 | 0.072 | 0.116 | 0.087 | Inv. |
| 1405 | 0.072 | 0.117 | 0.087 | Inv. |
| 1406 | 0.074 | 0.116 | 0.089 | Inv. |
| 1407 | 0.073 | 0.112 | 0.084 | Inv. |
| 1408 | 0.072 | 0.115 | 0.088 | Inv. |
| 1409 | 0.072 | 0.119 | 0.089 | Inv. |
| 1410 | 0.072 | 0.117 | 0.088 | Inv. |

Inv.; Inventive

As can be seen from the results in Tables 20 to 22, the fine line width is stably a small value and an image expression with a good sharpness and little blurring can be attained in Samples 1401 through 1410 when exposed to light at 454 nm or 477 nm. Specifically, Samples 1405 to 1410, which satisfy the preferred requirements of the invention exhibited superior results even though no specific difference in the density of the unexposed area with respect to the various exposing procedure particularly when a relatively short wavelength blue-light such as 410 nm and 430 nm is used. It is understood that the green density and red density of the yellow patch image having the maximum density are stably low and a clear yellow image with little color contamination is reproduced in the high density region. Such the results are certainly reflected in the evaluation results by the observers. It is understood the foregoing results that Sample 1405 to 1410 are preferable embodiments of the invention since a high print quality can be stably obtained by the various digital exposing apparatus.

Example 15

Light-sensitive material Samples 1501 through 1508 were prepared in a manner similar to Sample 104 in Example 1, except that the sensitizing dye used in the 1st layer was varied with respect to the kind amount, as shown in Table 23.

TABLE 23

| Emulsion | Kind of sensitizing dye | Added amount moles/mole of AgX | Kind of sensitizing dye | Added amount moles/mole of AgX | Kind of sensitizing dye | Added amount moles/mole of Agx |
|---|---|---|---|---|---|---|
| 1501 | 1-1 | $1 \times 10^{-4}$ | 1-8 | $4 \times 10^{-4}$ | | |
| 1502 | 1-1 | $2 \times 10^{-4}$ | 1-8 | $3 \times 10^{-4}$ | | |
| 1503 | 1-1 | $5 \times 10^{-5}$ | 1-8 | $4.5 \times 10^{-4}$ | | |
| 1504 | 1-1 | $1 \times 10^{-4}$ | 1-8 | $5 \times 10^{-4}$ | | |
| 1505 | 1-1 | $1 \times 10^{-4}$ | 1-8 | $4 \times 10^{-4}$ | 4-1 | $5 \times 10^{-5}$ |
| 1506 | 1-1 | $1 \times 10^{-4}$ | 1-8 | $4 \times 10^{-4}$ | 4-1 | $1 \times 10^{-4}$ |
| 1507 | 1-1 | $1 \times 10^{-4}$ | 1-8 | $4 \times 10^{-4}$ | 4-5 | $5 \times 10^{-5}$ |
| 1508 | 1-1 | $1 \times 10^{-4}$ | 1-8 | $4 \times 10^{-4}$ | 4-5 | $1 \times 10^{-4}$ |

The light-sensitive material samples were exposed by scanning by the R, G and B light beams while the light amount was controlled stepwise so that images similar to those obtained in Example 13. Then the light-sensitive material samples were processed in the same manner as in Example 1. The printed samples thus obtained were evaluated in the same manner as in Example 13. The results are shown in Tables 24 to 26. The sensitivity of the blue-sensitive layer is expressed by a value of product of −1 and the logarithm of light amount necessary to form a yellow image having a density of 0.8. The difference between the such the value of each of the light-sensitive materials and the value of Light-sensitive Material 1501 to the blue-light of 454 nm emitted from the Ar gas laser was calculated to the relative value of the blue-light sensitivity listed in Tables 24 to 26.

TABLE 24

| | LED: 410 nm | | | | | | SHG: 430 nm | | | | | |
|---|---|---|---|---|---|---|---|---|---|---|---|---|
| Sample | Sensitivity of blue-sensitive layer | Density of yellow patch | | | Half value width of fine line | Score by observers | Sensitivity of blue-sensitive layer | Density of yellow patch | | | Half value width of fine line | Score by observers |
| | | Blue | Green | Red | | | | Blue | Green | Red | | |
| 1501 | −0.720 | 2.05 | 1.21 | 0.26 | 112 | 61 | −0.400 | 2.07 | 0.62 | 0.13 | 97 | 87 |
| 1502 | −0.799 | 2.07 | 1.37 | 0.30 | 116 | 54 | −0.495 | 2.07 | 0.69 | 0.14 | 98 | 84 |
| 1503 | −0.672 | 2.07 | 1.12 | 0.24 | 108 | 64 | −0.352 | 2.07 | 0.59 | 0.12 | 97 | 90 |
| 1504 | −0.569 | 2.07 | 0.91 | 0.19 | 104 | 71 | −0.233 | 2.06 | 0.51 | 0.10 | 94 | 93 |
| 1505 | −0.424 | 2.05 | 0.62 | 0.12 | 98 | 86 | −0.164 | 2.08 | 0.46 | 0.09 | 92 | 96 |
| 1506 | −0.300 | 2.05 | 0.37 | 0.06 | 92 | 96 | −0.070 | 2.08 | 0.39 | 0.08 | 90 | 97 |
| 1507 | −0.470 | 2.06 | 0.71 | 0.14 | 100 | 83 | −0.210 | 2.06 | 0.49 | 0.10 | 90 | 94 |
| 1508 | −0.369 | 2.07 | 0.51 | 0.10 | 98 | 90 | −0.139 | 2.05 | 0.44 | 0.09 | 91 | 96 |

TABLE 25

| | Ar: 454 nm | | | | | | Ar: 477 nm | | | | | |
|---|---|---|---|---|---|---|---|---|---|---|---|---|
| Sample | Sensitivity of blue-sensitive layer | Density of yellow patch | | | Half value width of fine line | Score by obser-vers | Sensitivity of blue-sensitive layer | Density of yellow patch | | | Half value width of fine line | Score by obser-vers |
| | | Blue | Green | Red | | | | Blue | Green | Red | | |
| 1501 | 0.000 | 2.06 | 0.48 | 0.11 | 90 | 94 | −0.060 | 2.07 | 0.57 | 0.11 | 91 | 95 |
| 1502 | −0.115 | 2.05 | 0.52 | 0.12 | 90 | 94 | −0.172 | 2.07 | 0.67 | 0.13 | 90 | 94 |
| 1503 | −0.021 | 2.06 | 0.49 | 0.11 | 91 | 94 | −0.150 | 2.07 | 0.65 | 0.13 | 92 | 94 |
| 1504 | 0.084 | 2.08 | 0.45 | 0.10 | 89 | 96 | −0.083 | 2.08 | 0.59 | 0.12 | 91 | 97 |
| 1505 | 0.092 | 2.06 | 0.45 | 0.10 | 90 | 93 | −0.112 | 2.08 | 0.62 | 0.12 | 90 | 94 |
| 1506 | 0.149 | 2.07 | 0.43 | 0.09 | 91 | 93 | −0.093 | 2.05 | 0.60 | 0.12 | 88 | 97 |
| 1507 | 0.046 | 2.08 | 0.47 | 0.10 | 89 | 97 | −0.150 | 2.06 | 0.65 | 0.13 | 93 | 94 |
| 1508 | 0.079 | 2.06 | 0.45 | 0.10 | 91 | 95 | −0.150 | 2.07 | 0.65 | 0.13 | 92 | 96 |

TABLE 26

| Sample | Density of unexposed area Blue | Green | Red | Remarks |
|---|---|---|---|---|
| 1501 | 0.071 | 0.119 | 0.086 | Inv. |
| 1502 | 0.072 | 0.115 | 0.086 | Inv. |
| 1503 | 0.073 | 0.115 | 0.087 | Inv. |
| 1504 | 0.073 | 0.118 | 0.087 | Inv. |
| 1505 | 0.072 | 0.119 | 0.084 | Inv. |
| 1506 | 0.071 | 0.117 | 0.084 | Inv. |
| 1507 | 0.074 | 0.115 | 0.088 | Inv. |
| 1508 | 0.072 | 0.114 | 0.082 | Inv. |

Inv.; Inventive

As can be seen from the results in Tables 24 to 26, the fine line width is stably a small value and an image expression with a good sharpness and little blurring can be attained in Samples 1501 through 1508 when exposed to light at 454 nm or 477 nm. Specifically, Samples 1505 to 1508, which satisfy the preferred requirements of the invention exhibited superior results even though no specific difference in the density of the unexposed area with respect to the various exposing procedure particularly when a relatively short wavelength blue-light such as 410 nm and 430 nm is used. It is understood that the green density and red density of the yellow patch image having the maximum density are stably low and a clear yellow image with little color contamination is reproduced in the high density region. Such the results are certainly reflected in the evaluation results by the observers. It is understood the foregoing results that light-sensitive material Samples 1505 to 1508 are preferable embodiment of the invention since a high print quality can be stably obtained by the various digital exposing apparatus.

Example 16

Light-sensitive material Samples 1601 through 1610 were prepared in a manner similar to Sample 104 in Example 1, except that the sensitizing dye used in the 1st layer was varied with respect to the kind and amount, as shown in Table 27.

TABLE 27

| Sample | Kind of sensitizing dye | Added amount moles/mole of AgX | Kind of sensitizing dye | Added amount moles/mole of AgX | Kind of sensitizing dye | Added amount moles/mole of Agx |
|---|---|---|---|---|---|---|
| 1601 | 1-1 | $1 \times 10^{-4}$ | 1-8 | $4 \times 10^{-4}$ | | |
| 1602 | 1-1 | $2 \times 10^{-4}$ | 1-8 | $3 \times 10^{-4}$ | | |
| 1603 | 1-1 | $5 \times 10^{-5}$ | 1-8 | $4.5 \times 10^{-4}$ | | |
| 1604 | 1-1 | $1 \times 10^{-4}$ | 1-8 | $5 \times 10^{-4}$ | | |
| 1605 | 1-1 | $1 \times 10^{-4}$ | 1-8 | $4 \times 10^{-4}$ | 5-1 | $5 \times 10^{-5}$ |
| 1606 | 1-1 | $1 \times 10^{-4}$ | 1-8 | $4 \times 10^{-4}$ | 5-1 | $1 \times 10^{-4}$ |
| 1607 | 1-1 | $1 \times 10^{-4}$ | 1-8 | $4 \times 10^{-4}$ | 5-5 | $5 \times 10^{-5}$ |
| 1608 | 1-1 | $1 \times 10^{-4}$ | 1-8 | $4 \times 10^{-4}$ | 5-5 | $1 \times 10^{-4}$ |
| 1609 | 1-1 | $1 \times 10^{-4}$ | 1-8 | $4 \times 10^{-4}$ | 5-6 | $5 \times 10^{-5}$ |
| 1610 | 1-1 | $1 \times 10^{-4}$ | 1-8 | $4 \times 10^{-4}$ | 5-6 | $1 \times 10^{-4}$ |

The light-sensitive material samples were exposed by scanning by the R, G and B light beams while the light amount was controlled stepwise so that images similar to those obtained in Example 13. Then the light-sensitive material were processed by Processing 1 in Example 1. The printed samples thus obtained were evaluated in the same manner as in Example 13. The results are shown in Tables 18 to 20. The sensitivity of the blue-sensitive layer is expressed by a value of product of −1 and the logarithm of light amount necessary to form a yellow image having a density of 0.8. The difference between the such the value of each of the light-sensitive material and the value of Light-sensitive Material 1601 to the blue-light of 454 nm emitted from the Ar gas laser was calculated to the relative value of the blue-light sensitivity listed in Tables 28 to 30.

TABLE 28

| Sample | LED: 410 nm Sensitivity of blue-sensitive layer | Density of yellow patch Blue | Green | Red | Half value width of fine line | Score by observers | SHG: 430 nm Sensitivity of blue-sensitive layer | Density of yellow patch Blue | Green | Red | Half value width of fine line | Score by observers |
|---|---|---|---|---|---|---|---|---|---|---|---|---|
| 1601 | −0.720 | 2.06 | 1.21 | 0.26 | 112 | 63 | −0.400 | 2.06 | 0.62 | 0.13 | 95 | 85 |
| 1602 | −0.799 | 2.07 | 1.37 | 0.30 | 116 | 54 | −0.495 | 2.06 | 0.69 | 0.14 | 100 | 82 |
| 1603 | −0.672 | 2.08 | 1.12 | 0.24 | 111 | 65 | −0.352 | 2.07 | 0.59 | 0.12 | 95 | 87 |
| 1604 | −0.569 | 2.05 | 0.91 | 0.19 | 103 | 73 | −0.233 | 2.06 | 0.51 | 0.10 | 93 | 93 |
| 1605 | −0.418 | 2.06 | 0.61 | 0.12 | 97 | 86 | −0.164 | 2.07 | 0.46 | 0.09 | 89 | 95 |
| 1606 | −0.291 | 2.06 | 0.35 | 0.06 | 90 | 96 | −0.070 | 2.06 | 0.39 | 0.08 | 88 | 96 |
| 1607 | −0.444 | 2.06 | 0.66 | 0.13 | 100 | 84 | −0.214 | 2.06 | 0.49 | 0.10 | 93 | 92 |
| 1608 | −0.330 | 2.06 | 0.43 | 0.08 | 92 | 92 | −0.145 | 2.08 | 0.45 | 0.09 | 90 | 94 |
| 1609 | −0.428 | 2.05 | 0.63 | 0.12 | 99 | 86 | −0.124 | 2.05 | 0.43 | 0.09 | 90 | 97 |
| 1610 | −0.306 | 2.06 | 0.38 | 0.07 | 91 | 95 | −0.010 | 2.06 | 0.35 | 0.07 | 85 | 98 |

TABLE 29

| Sample | Ar: 454 nm Sensitivity of blue-sensitive layer | Density of yellow patch Blue | Green | Red | Half value width of fine line | Score by observers | Ar: 477 nm Sensitivity of blue-sensitive layer | Density of yellow patch Blue | Green | Red | Half value width of fine line | Score by observers |
|---|---|---|---|---|---|---|---|---|---|---|---|---|
| 1601 | 0.000 | 2.06 | 0.48 | 0.11 | 88 | 94 | −0.060 | 2.06 | 0.57 | 0.11 | 87 | 95 |
| 1602 | −0.115 | 2.08 | 0.52 | 0.12 | 89 | 94 | −0.172 | 2.06 | 0.67 | 0.13 | 92 | 94 |
| 1603 | −0.021 | 2.07 | 0.49 | 0.11 | 89 | 94 | −0.150 | 2.05 | 0.65 | 0.13 | 89 | 93 |
| 1604 | 0.084 | 2.06 | 0.45 | 0.10 | 89 | 96 | −0.083 | 2.06 | 0.59 | 0.12 | 89 | 97 |
| 1605 | 0.049 | 2.08 | 0.46 | 0.10 | 91 | 95 | −0.150 | 2.07 | 0.65 | 0.13 | 92 | 95 |
| 1606 | 0.084 | 2.06 | 0.45 | 0.10 | 91 | 94 | −0.150 | 2.07 | 0.65 | 0.13 | 91 | 95 |
| 1607 | 0.010 | 2.05 | 0.48 | 0.11 | 89 | 95 | −0.150 | 2.08 | 0.65 | 0.13 | 90 | 94 |
| 1608 | 0.026 | 2.06 | 0.47 | 0.10 | 92 | 95 | −0.150 | 2.06 | 0.65 | 0.13 | 89 | 95 |
| 1609 | 0.095 | 2.06 | 0.45 | 0.10 | 89 | 93 | −0.133 | 2.05 | 0.63 | 0.13 | 88 | 94 |
| 1610 | 0.153 | 2.06 | 0.43 | 0.09 | 89 | 97 | −0.124 | 2.05 | 0.63 | 0.13 | 90 | 93 |

TABLE 30

| Sample | Density of unexposed area Blue | Green | Red | Remarks |
|---|---|---|---|---|
| 1601 | 0.075 | 0.112 | 0.084 | Inv. |
| 1602 | 0.071 | 0.118 | 0.085 | Inv. |
| 1603 | 0.074 | 0.119 | 0.083 | Inv. |
| 1604 | 0.074 | 0.114 | 0.081 | Inv. |
| 1605 | 0.072 | 0.119 | 0.083 | Inv. |
| 1606 | 0.071 | 0.120 | 0.088 | Inv. |
| 1607 | 0.074 | 0.116 | 0.082 | Inv. |
| 1608 | 0.074 | 0.119 | 0.084 | Inv. |
| 1609 | 0.072 | 0.114 | 0.082 | Inv. |
| 1610 | 0.074 | 0.113 | 0.084 | Inv. |

Inv.; Inventive

As can be seen from the results in Tables 28 to 30, the fine line width is stably a small value and an image expression with a good sharpness and little blurring can be attained in Samples 1601 through 1610 when exposed to light at 454 nm or 477 nm. Specifically, Samples 1605 to 1610, which satisfy the preferred requirements of the invention exhibited superior results even though no specific difference in the density of the unexposed area with respect to the various exposing procedure particularly when a relatively short wavelength blue-light such as 410 nm and 430 nm is used. It is understood that the green density and red density of the yellow patch image having the maximum density are stably low and a clear yellow image with little color contamination is reproduced in the high density region. Such the results are certainly reflected in the evaluation results by the observers. It is understood the foregoing results that Light-sensitive Materials 1605 to 1610 are preferable embodiment of the invention since a high print quality can be stably obtained by the various digital exposing apparatus.

Example 17

Light-sensitive material Samples 1701 through 1710 were prepared in a manner similar to Sample 104 in Example 1, except that the sensitizing dye used in the 1st layer was varied with respect to the kind and amount, as shown in Table 31.

TABLE 31

| Sample | Kind of sensitizing dye | Added amount moles/mole of AgX | Kind of sensitizing dye | Added amount moles/mole of AgX | Kind of sensitizing dye | Added amount moles/mole of Agx |
|---|---|---|---|---|---|---|
| 1701 | 1-1 | $1 \times 10^{-4}$ | 1-8 | $4 \times 10^{-4}$ | | |
| 1702 | 1-1 | $2 \times 10^{-4}$ | 1-8 | $3 \times 10^{-4}$ | | |
| 1703 | 1-1 | $5 \times 10^{-5}$ | 1-8 | $4.5 \times 10^{-4}$ | | |
| 1704 | 1-1 | $1 \times 10^{-4}$ | 1-8 | $5 \times 10^{-4}$ | | |
| 1705 | 1-1 | $1 \times 10^{-4}$ | 1-8 | $4 \times 10^{-4}$ | 6-2 | $5 \times 10^{-5}$ |
| 1706 | 1-1 | $1 \times 10^{-4}$ | 1-8 | $4 \times 10^{-4}$ | 6-2 | $1 \times 10^{-4}$ |
| 1707 | 1-1 | $1 \times 10^{-4}$ | 1-8 | $4 \times 10^{-4}$ | 6-7 | $5 \times 10^{-5}$ |
| 1708 | 1-1 | $1 \times 10^{-4}$ | 1-8 | $4 \times 10^{-4}$ | 6-7 | $1 \times 10^{-4}$ |
| 1709 | 1-1 | $1 \times 10^{-4}$ | 1-8 | $4 \times 10^{-4}$ | 6-10 | $5 \times 10^{-5}$ |
| 1710 | 1-1 | $1 \times 10^{-4}$ | 1-8 | $4 \times 10^{-4}$ | 6-10 | $1 \times 10^{-4}$ |

The light-sensitive material samples were exposed by scanning by the R, G and B light beams while the light amount was controlled stepwise so that images similar to those obtained in Example 13. Then the light-sensitive material were processed by Processing 1 in Example 1. The printed samples thus obtained were evaluated in the same manner as in Example 13. The results are shown in Tables 23 to 25. The sensitivity of the blue-sensitive layer is expressed by a value of product of −1 and the logarithm of light amount necessary to form a yellow image having a density of 0.8. The difference between the such the value of each of the light-sensitive material and the value of Light-sensitive Material 1701 to the blue-light of 454 nm emitted from the Ar gas laser was calculated to the relative value of the blue-light sensitivity listed in Tables 32 to 34.

TABLE 32

| | LED: 410 nm | | | | | | SHG: 430 nm | | | | | |
|---|---|---|---|---|---|---|---|---|---|---|---|---|
| Sample | Sensitivity of blue-sensitive layer | Density of yellow patch | | | Half value width of fine line | Score by observers | Sensitivity of blue-sensitive layer | Density of yellow patch | | | Half value width of fine line | Score by observers |
| | | Blue | Green | Red | | | | Blue | Green | Red | | |
| 1701 | −0.720 | 2.06 | 1.21 | 0.26 | 110 | 63 | −0.400 | 2.07 | 0.62 | 0.13 | 95 | 88 |
| 1702 | −0.799 | 2.05 | 1.37 | 0.30 | 117 | 54 | −0.495 | 2.07 | 0.69 | 0.14 | 99 | 86 |
| 1703 | −0.672 | 2.05 | 1.12 | 0.24 | 110 | 64 | −0.352 | 2.06 | 0.59 | 0.12 | 95 | 89 |
| 1704 | −0.569 | 2.07 | 0.91 | 0.19 | 104 | 71 | −0.233 | 2.06 | 0.51 | 0.10 | 93 | 92 |
| 1705 | −0.438 | 2.06 | 0.65 | 0.13 | 100 | 83 | −0.124 | 2.05 | 0.43 | 0.09 | 91 | 96 |
| 1706 | −0.321 | 2.07 | 0.41 | 0.07 | 95 | 91 | −0.010 | 2.07 | 0.35 | 0.07 | 87 | 99 |
| 1707 | −0.444 | 2.07 | 0.66 | 0.13 | 98 | 81 | −0.214 | 2.06 | 0.49 | 0.10 | 91 | 93 |
| 1708 | −0.330 | 2.05 | 0.43 | 0.08 | 95 | 94 | −0.145 | 2.06 | 0.45 | 0.09 | 92 | 94 |
| 1709 | −0.428 | 2.05 | 0.63 | 0.12 | 97 | 86 | −0.124 | 2.06 | 0.43 | 0.09 | 89 | 97 |
| 1710 | −0.306 | 2.06 | 0.38 | 0.07 | 91 | 95 | −0.010 | 2.07 | 0.35 | 0.07 | 89 | 101 |

TABLE 33

| | Ar: 454 nm | | | | | | Ar: 477 nm | | | | | |
|---|---|---|---|---|---|---|---|---|---|---|---|---|
| Sample | Sensitivity of blue-sensitive layer | Density of yellow patch | | | Half value width of fine line | Score by observers | Sensitivity of blue-sensitive layer | Density of yellow patch | | | Half value width of fine line | Score by observers |
| | | Blue | Green | Red | | | | Blue | Green | Red | | |
| 1701 | 0.000 | 2.07 | 0.48 | 0.11 | 91 | 95 | −0.060 | 2.08 | 0.57 | 0.11 | 90 | 97 |
| 1702 | −0.115 | 2.07 | 0.52 | 0.12 | 91 | 95 | −0.172 | 2.08 | 0.67 | 0.13 | 91 | 96 |
| 1703 | −0.021 | 2.07 | 0.49 | 0.11 | 89 | 95 | −0.150 | 2.08 | 0.65 | 0.13 | 90 | 95 |
| 1704 | 0.084 | 2.06 | 0.45 | 0.10 | 91 | 94 | −0.083 | 2.08 | 0.59 | 0.12 | 90 | 96 |
| 1705 | 0.095 | 2.06 | 0.45 | 0.10 | 90 | 96 | −0.133 | 2.06 | 0.63 | 0.13 | 89 | 94 |
| 1706 | 0.153 | 2.08 | 0.43 | 0.09 | 89 | 96 | −0.124 | 2.05 | 0.63 | 0.13 | 90 | 94 |
| 1707 | 0.010 | 2.06 | 0.48 | 0.11 | 90 | 95 | −0.150 | 2.08 | 0.65 | 0.13 | 89 | 95 |
| 1708 | 0.026 | 2.07 | 0.47 | 0.10 | 91 | 96 | −0.150 | 2.05 | 0.65 | 0.13 | 91 | 95 |

TABLE 33-continued

| Sample | Ar: 454 nm Sensitivity of blue-sensitive layer | Density of yellow patch Blue | Green | Red | Half value width of fine line | Score by observers | Ar: 477 nm Sensitivity of blue-sensitive layer | Density of yellow patch Blue | Green | Red | Half value width of fine line | Score by observers |
|---|---|---|---|---|---|---|---|---|---|---|---|---|
| 1709 | 0.095 | 2.07 | 0.45 | 0.10 | 88 | 94 | −0.133 | 2.06 | 0.63 | 0.13 | 89 | 93 |
| 1710 | 0.153 | 2.07 | 0.43 | 0.09 | 88 | 95 | −0.124 | 2.08 | 0.63 | 0.13 | 91 | 94 |

TABLE 34

| Sample | Density of unexposed area Blue | Green | Red | Remarks |
|---|---|---|---|---|
| 1701 | 0.075 | 0.119 | 0.089 | Inv. |
| 1702 | 0.074 | 0.120 | 0.087 | Inv. |
| 1703 | 0.071 | 0.119 | 0.082 | Inv. |
| 1704 | 0.073 | 0.117 | 0.085 | Inv. |
| 1705 | 0.075 | 0.118 | 0.089 | Inv. |
| 1706 | 0.071 | 0.113 | 0.083 | Inv. |
| 1707 | 0.075 | 0.113 | 0.083 | Inv. |
| 1708 | 0.074 | 0.115 | 0.084 | Inv. |
| 1709 | 0.071 | 0.118 | 0.083 | Inv. |
| 1710 | 0.072 | 0.112 | 0.081 | Inv. |

Inv.; Inventive

As can be seen from the results in Tables 32 to 341 the fine line width is stably a small value and an image expression with a good sharpness and little blurring can be attained in Sample 1701 through 1710 when exposed to light at 454 nm or 477 nm. Specifically, Samples 1705 to 1710, which satisfy the preferred requirements of the invention exhibited superior results even though no specific difference in the density of the unexposed area with respect to the various exposing procedure particularly when a relatively short wavelength blue-light such as 410 nm and 430 nm is used. It is understood that the green density and red density of the yellow patch image having the maximum density are stably low and a clear yellow image with little color contamination is reproduced in the high density region. Such the results are certainly reflected in the evaluation results by the observers.

It is understood the foregoing results that Light-sensitive Materials 1705 to 1710 are preferable embodiment of the invention since a high print quality can be stably obtained by the various digital exposing apparatus.

Example 18

Light-sensitive material Samples 1801 through 1810 were prepared in a manner similar to Sample 104 in Example 1, except that the sensitizing dye used in the 1st layer was varied with respect to the kind and amount, as shown in Table 35.

TABLE 35

| Sample | Kind of sensitizing dye | Added amount moles/mole of AgX | Kind of sensitizing dye | Added amount moles/mole of AgX | Kind of sensitizing dye | Added amount moles/mole of Agx |
|---|---|---|---|---|---|---|
| 1801 | 1-1 | $1 \times 10^{-4}$ | 1-8 | $4 \times 10^{-4}$ | | |
| 1802 | 1-1 | $2 \times 10^{-4}$ | 1-8 | $3 \times 10^{-4}$ | | |
| 1803 | 1-1 | $5 \times 10^{-5}$ | 1-8 | $4.5 \times 10^{-4}$ | | |
| 1804 | 1-1 | $1 \times 10^{-4}$ | 1-8 | $5 \times 10^{-4}$ | | |
| 1805 | 1-1 | $1 \times 10^{-4}$ | 1-8 | $4 \times 10^{-4}$ | 7-2 | $5 \times 10^{-5}$ |
| 1806 | 1-1 | $1 \times 10^{-4}$ | 1-8 | $4 \times 10^{-4}$ | 7-2 | $1 \times 10^{-4}$ |
| 1807 | 1-1 | $1 \times 10^{-4}$ | 1-8 | $4 \times 10^{-4}$ | 7-5 | $5 \times 10^{-5}$ |
| 1808 | 1-1 | $1 \times 10^{-4}$ | 1-8 | $4 \times 10^{-4}$ | 7-5 | $1 \times 10^{-4}$ |
| 1809 | 1-1 | $1 \times 10^{-4}$ | 1-8 | $4 \times 10^{-4}$ | 7-7 | $5 \times 10^{-5}$ |
| 1810 | 1-1 | $1 \times 10^{-4}$ | 1-8 | $4 \times 10^{-4}$ | 7-7 | $1 \times 10^{-4}$ |

The light-sensitive materials were exposed by scanning by the R, G and B light beams while the light amount was controlled stepwise so that images similar to those obtained in Example 13. Then the light-sensitive material were processed by Processing 1 in Example 1. The printed samples thus obtained were evaluated in the same manner as in Example 13. The results are shown in Tables 28 to 30. The sensitivity of the blue-sensitive layer is expressed by a value of product of -1 and the logarithm of light amount necessary to form a yellow image having a density of 0.8. The difference between the such the value of each of the light-sensitive material and the value of Light-sensitive Material 601 to the blue-light of 454 nm emitted from the Ar gas laser was calculated to the relative value of the blue-light sensitivity listed in Tables 36 to 38.

TABLE 36

| Sample | LED: 410 nm Sensitivity of blue-sensitive layer | Density of yellow patch Blue | Green | Red | Half value width of fine line | Score by observers | SHG: 430 nm Sensitivity of blue-sensitive layer | Density of yellow patch Blue | Green | Red | Half value width of fine line | Score by observers |
|---|---|---|---|---|---|---|---|---|---|---|---|---|
| 1801 | −0.720 | 2.05 | 1.21 | 0.26 | 111 | 61 | −0.400 | 2.08 | 0.62 | 0.13 | 95 | 88 |
| 1802 | −0.799 | 2.06 | 1.37 | 0.30 | 118 | 54 | −0.495 | 2.06 | 0.69 | 0.14 | 100 | 84 |
| 1803 | −0.672 | 2.07 | 1.12 | 0.24 | 110 | 66 | −0.352 | 2.06 | 0.59 | 0.12 | 97 | 89 |
| 1804 | −0.569 | 2.08 | 0.91 | 0.19 | 104 | 72 | −0.233 | 2.07 | 0.51 | 0.10 | 91 | 90 |
| 1805 | −0.428 | 2.07 | 0.63 | 0.12 | 99 | 86 | −0.164 | 2.06 | 0.46 | 0.09 | 91 | 96 |
| 1806 | −0.306 | 2.06 | 0.38 | 0.07 | 91 | 96 | −0.070 | 2.06 | 0.39 | 0.08 | 90 | 99 |
| 1807 | −0.434 | 2.07 | 0.64 | 0.13 | 97 | 85 | −0.214 | 2.07 | 0.49 | 0.10 | 93 | 93 |
| 1808 | −0.315 | 2.08 | 0.40 | 0.07 | 93 | 95 | −0.145 | 2.08 | 0.45 | 0.09 | 89 | 97 |
| 1809 | −0.444 | 2.08 | 0.66 | 0.13 | 100 | 84 | −0.196 | 2.06 | 0.48 | 0.10 | 91 | 92 |
| 1810 | −0.330 | 2.06 | 0.43 | 0.08 | 92 | 91 | −0.118 | 2.06 | 0.43 | 0.08 | 88 | 96 |

TABLE 37

| Sample | Ar: 454 nm Sensitivity of blue-sensitive layer | Density of yellow patch Blue | Green | Red | Half value width of fine line | Score by observers | Ar: 477 nm Sensitivity of blue-sensitive layer | Density of yellow patch Blue | Green | Red | Half value width of fine line | Score by observers |
|---|---|---|---|---|---|---|---|---|---|---|---|---|
| 1801 | 0.000 | 2.07 | 0.48 | 0.11 | 92 | 94 | −0.060 | 2.08 | 0.57 | 0.11 | 90 | 96 |
| 1802 | −0.115 | 2.05 | 0.52 | 0.12 | 90 | 95 | −0.172 | 2.06 | 0.67 | 0.13 | 93 | 93 |
| 1803 | −0.021 | 2.06 | 0.49 | 0.11 | 91 | 94 | −0.150 | 2.06 | 0.65 | 0.13 | 90 | 92 |
| 1804 | 0.084 | 2.06 | 0.45 | 0.10 | 90 | 95 | −0.083 | 2.06 | 0.59 | 0.12 | 91 | 94 |
| 1805 | 0.049 | 2.06 | 0.46 | 0.10 | 90 | 95 | −0.150 | 2.08 | 0.65 | 0.13 | 90 | 93 |
| 1806 | 0.084 | 2.08 | 0.45 | 0.10 | 89 | 96 | −0.148 | 2.07 | 0.66 | 0.14 | 90 | 94 |
| 1807 | 0.010 | 2.07 | 0.48 | 0.11 | 91 | 94 | −0.149 | 2.06 | 0.65 | 0.13 | 89 | 93 |
| 1808 | 0.026 | 2.08 | 0.47 | 0.10 | 89 | 94 | −0.150 | 2.07 | 0.65 | 0.13 | 92 | 95 |
| 1809 | 0.030 | 2.06 | 0.47 | 0.10 | 89 | 94 | −0.150 | 2.07 | 0.64 | 0.12 | 89 | 96 |
| 1810 | 0.056 | 2.06 | 0.46 | 0.10 | 89 | 94 | −0.146 | 2.07 | 0.65 | 0.13 | 90 | 95 |

TABLE 38

| Sample | Density of unexposed area Blue | Green | Red | Remarks |
|---|---|---|---|---|
| 1801 | 0.073 | 0.112 | 0.082 | Inv. |
| 1802 | 0.072 | 0.114 | 0.087 | Inv. |
| 1803 | 0.074 | 0.114 | 0.083 | Inv. |
| 1804 | 0.074 | 0.117 | 0.081 | Inv. |
| 1805 | 0.071 | 0.114 | 0.085 | Inv. |
| 1806 | 0.074 | 0.117 | 0.083 | Inv. |
| 1807 | 0.073 | 0.116 | 0.083 | Inv. |
| 1808 | 0.075 | 0.120 | 0.082 | Inv. |
| 1809 | 0.073 | 0.118 | 0.087 | Inv. |
| 1810 | 0.074 | 0.114 | 0.081 | Inv. |

Inv.; Inventive

As can be seen from the results in Tables 36 to 38, the fine line width is sably a small value and an image expression with a good sharpness and little blurring can be attained in Samples 1801 through 1810 when exposed to light at 454 nm or 477 nm. Specifically, Samples 1805 to 1808, which satisfy the preferred requirements of the invention exhinited superior results even though no specific difference in the density of the unexposed area with respect to the various exposing procedure particularly when a relatively short wavelength blue-light such as 410 nm and 430 nm is used. It is understood that the green density and red density of the yellow patch image having the maximum density are stably low and a clear yellow image with little color contamination is reproduced in the high density region. Such the results are certainly reflected in the evaluation results by the observers. It is understood the foregoing results that Light-sensitive Materials 1805 to 1810 are preferable embodiment of the invention since a high print quality can be stably obtained by the various digital exposing apparatus.

Example 19

Light-sensitive material Samples 1901 through 1910 were prepared in a manner similar to Sample 104 in Example 1, except that the sensitizing dye used in the 1st layer was varied with respect to the kind and amount, as shown in Table 39.

TABLE 39

| Sample | Kind of sensitizing dye | Added amount moles/mole of AgX | Kind of sensitizing dye | Added amount moles/mole of AgX | Kind of sensitizing dye | Added amount moles/mole of AgX |
|---|---|---|---|---|---|---|
| 1901 | 1-1 | $1 \times 10^{-4}$ | 1-8 | $4 \times 10^{-4}$ | | |
| 1902 | 1-1 | $2 \times 10^{-4}$ | 1-8 | $3 \times 10^{-4}$ | | |
| 1903 | 1-1 | $5 \times 10^{-5}$ | 1-8 | $4.5 \times 10^{-4}$ | | |
| 1904 | 1-1 | $1 \times 10^{-4}$ | 1-8 | $5 \times 10^{-4}$ | | |
| 1905 | 1-1 | $1 \times 10^{-4}$ | 1-8 | $4 \times 10^{-4}$ | 8-1 | $5 \times 10^{-5}$ |
| 1906 | 1-1 | $1 \times 10^{-4}$ | 1-8 | $4 \times 10^{-4}$ | 8-1 | $1 \times 10^{-4}$ |
| 1907 | 1-1 | $1 \times 10^{-4}$ | 1-8 | $4 \times 10^{-4}$ | 8-8 | $5 \times 10^{-5}$ |
| 1908 | 1-1 | $1 \times 10^{-4}$ | 1-8 | $4 \times 10^{-4}$ | 8-8 | $1 \times 10^{-4}$ |
| 1909 | 1-1 | $1 \times 10^{-4}$ | 1-8 | $4 \times 10^{-4}$ | 8-25 | $5 \times 10^{-5}$ |
| 1910 | 1-1 | $1 \times 10^{-4}$ | 1-8 | $4 \times 10^{-4}$ | 8-25 | $1 \times 10^{-4}$ |

The light-sensitive materials were exposed by scanning by the R, G and B light beams while the light amount was controlled stepwise so that images similar to those obtained in Example 13. Then the light-sensitive material were processed by Processing 1 in Example 1. The printed samples thus obtained were evaluated in the same manner as in Example 13. The results are shown in Tables 40 to 42. The sensitivity of the blue-sensitive layer is expressed by a value of product of -1 and the logarithm of light amount necessary to form a yellow image having a density of 0.8. The difference between the such the value of each of the light-sensitive material and the value of Light-sensitive Material 1901 to the blue-light of 454 nm emitted from the Ar gas laser was calculated to the relative value of the blue-light sensitivity listed in Tables 40 to 42.

TABLE 40

| | LED: 410 nm | | | | | | SHG: 430 nm | | | | | |
|---|---|---|---|---|---|---|---|---|---|---|---|---|
| Sample | Sensitivity of blue-sensitive layer | Density of yellow patch | | | Half value width of fine line | Score by observers | Sensitivity of blue-sensitive layer | Density of yellow patch | | | Half value width of fine line | Score by observers |
| | | Blue | Green | Red | | | | Blue | Green | Red | | |
| 1901 | −0.720 | 2.08 | 1.21 | 0.26 | 110 | 61 | −0.400 | 2.06 | 0.62 | 0.13 | 99 | 89 |
| 1902 | −0.799 | 2.06 | 1.37 | 0.30 | 115 | 55 | −0.495 | 2.05 | 0.69 | 0.14 | 99 | 84 |
| 1903 | −0.672 | 2.07 | 1.12 | 0.24 | 112 | 66 | −0.352 | 2.08 | 0.59 | 0.12 | 97 | 89 |
| 1904 | −0.569 | 2.07 | 0.91 | 0.19 | 107 | 75 | −0.233 | 2.05 | 0.51 | 0.10 | 93 | 92 |
| 1905 | −0.444 | 2.07 | 0.66 | 0.13 | 100 | 85 | −0.196 | 2.07 | 0.48 | 0.10 | 92 | 92 |
| 1906 | −0.330 | 2.07 | 0.43 | 0.08 | 96 | 92 | −0.118 | 2.07 | 0.43 | 0.08 | 90 | 95 |
| 1907 | −0.434 | 2.05 | 0.64 | 0.13 | 100 | 83 | −0.214 | 2.05 | 0.49 | 0.10 | 92 | 94 |
| 1908 | −0.315 | 2.05 | 0.40 | 0.07 | 94 | 92 | −0.145 | 2.08 | 0.45 | 0.09 | 90 | 96 |
| 1909 | −0.431 | 2.06 | 0.63 | 0.13 | 99 | 82 | −0.196 | 2.06 | 0.48 | 0.10 | 91 | 95 |
| 1910 | −0.310 | 2.06 | 0.39 | 0.07 | 95 | 93 | −0.118 | 2.07 | 0.43 | 0.08 | 90 | 94 |

TABLE 41

| | Ar: 454 nm | | | | | | Ar: 477 nm | | | | | |
|---|---|---|---|---|---|---|---|---|---|---|---|---|
| Sample | Sensitivity of blue-sensitive layer | Density of yellow patch | | | Half value width of fine line | Score by observers | Sensitivity of blue-sensitive layer | Density of yellow patch | | | Half value width of fine line | Score by observers |
| | | Blue | Green | Red | | | | Blue | Green | Red | | |
| 1901 | 0.000 | 2.08 | 0.48 | 0.11 | 89 | 94 | −0.060 | 2.07 | 0.57 | 0.11 | 90 | 95 |
| 1902 | −0.115 | 2.06 | 0.52 | 0.12 | 92 | 94 | −0.172 | 2.07 | 0.67 | 0.13 | 92 | 93 |
| 1903 | −0.021 | 2.06 | 0.49 | 0.11 | 91 | 93 | −0.150 | 2.07 | 0.65 | 0.13 | 92 | 96 |
| 1904 | 0.084 | 2.05 | 0.45 | 0.10 | 89 | 93 | −0.083 | 2.08 | 0.59 | 0.12 | 89 | 94 |
| 1905 | 0.030 | 2.06 | 0.47 | 0.10 | 90 | 94 | −0.150 | 2.05 | 0.65 | 0.13 | 90 | 93 |
| 1906 | 0.056 | 2.06 | 0.46 | 0.10 | 92 | 96 | −0.150 | 2.07 | 0.66 | 0.14 | 89 | 95 |
| 1907 | 0.010 | 2.06 | 0.48 | 0.11 | 91 | 97 | −0.150 | 2.05 | 0.64 | 0.12 | 92 | 93 |
| 1908 | 0.026 | 2.06 | 0.47 | 0.10 | 90 | 95 | −0.150 | 2.08 | 0.65 | 0.13 | 91 | 93 |
| 1909 | 0.035 | 2.07 | 0.47 | 0.10 | 90 | 96 | −0.150 | 2.07 | 0.65 | 0.14 | 90 | 95 |
| 1910 | 0.063 | 2.06 | 0.46 | 0.10 | 88 | 93 | −0.150 | 2.08 | 0.65 | 0.13 | 91 | 95 |

TABLE 42

| Sample | Density of unexposed area | | | Remarks |
|---|---|---|---|---|
| | Blue | Green | Red | |
| 1901 | 0.072 | 0.118 | 0.081 | Inv. |
| 1902 | 0.075 | 0.112 | 0.086 | Inv. |
| 1903 | 0.072 | 0.116 | 0.084 | Inv. |
| 1904 | 0.071 | 0.118 | 0.081 | Inv. |
| 1905 | 0.073 | 0.112 | 0.082 | Inv. |
| 1906 | 0.074 | 0.120 | 0.088 | Inv. |
| 1907 | 0.072 | 0.118 | 0.084 | Inv. |
| 1908 | 0.071 | 0.120 | 0.088 | Inv. |
| 1909 | 0.074 | 0.114 | 0.087 | Inv. |
| 1910 | 0.072 | 0.114 | 0.081 | Inv. |

Inv.; Inventive

As can be seen from the results in Tables 40 to 42, the fine line width is sably a small value and an image expression with a good sharpness and little blurring can be attained in Samples 1901 through 1910 when exposed to light at 454 nm or 477 nm. Specifically, Samples 1905 to 1908, which satisfy the preferred requirements of the invention exhinited superior results even though no specific difference in the density of the unexposed area with respect to the various exposing procedure particularly when a relatively short wavelength blue-light such as 410 nm and 430 nm is used. It is understood that the green density and red density of the yellow patch image having the maximum density are stably low and a clear yellow image with little color contamination is reproduced in the high density region. Such the results are certainly reflected in the evaluation results by the observers. It is understood the foregoing results that Light-sensitive Materials 1905 to 1910 are preferable embodiment of the invention since a high print quality can be stably obtained by the various digital exposing apparatus.

Example 20

Light-sensitive material Samples 2001 through 2010 were prepared in a manner similar to Sample 104 in Example 1, except that the sensitizing dye used in the 1st layer was varied with respect to the kind and amount, as shown in Table 43.

TABLE 43

| Sample | Kind of sensitizing dye | Added amount moles/mole of AgX | Kind of sensitizing dye | Added amount moles/mole of AgX | Kind of sensitizing dye | Added amount moles/mole of Agx |
|---|---|---|---|---|---|---|
| 2001 | 1-1 | $1 \times 10^{-4}$ | 1-8 | $4 \times 10^{-4}$ | | |
| 2002 | 1-1 | $2 \times 10^{-4}$ | 1-8 | $3 \times 10^{-4}$ | | |
| 2003 | 1-1 | $5 \times 10^{-5}$ | 1-8 | $4.5 \times 10^{-4}$ | | |
| 2004 | 1-1 | $1 \times 10^{-4}$ | 1-8 | $5 \times 10^{-4}$ | | |
| 2005 | 1-1 | $1 \times 10^{-4}$ | 1-8 | $4 \times 10^{-4}$ | 9-1 | $5 \times 10^{-5}$ |
| 2006 | 1-1 | $1 \times 10^{-4}$ | 1-8 | $4 \times 10^{-4}$ | 9-1 | $1 \times 10^{-4}$ |
| 2007 | 1-1 | $1 \times 10^{-4}$ | 1-8 | $4 \times 10^{-4}$ | 9-5 | $5 \times 10^{-5}$ |
| 2008 | 1-1 | $1 \times 10^{-4}$ | 1-8 | $4 \times 10^{-4}$ | 9-5 | $1 \times 10^{-4}$ |
| 2009 | 1-1 | $1 \times 10^{-4}$ | 1-8 | $4 \times 10^{-4}$ | 9-7 | $5 \times 10^{-5}$ |
| 2010 | 1-1 | $1 \times 10^{-4}$ | 1-8 | $4 \times 10^{-4}$ | 9-7 | $1 \times 10^{-4}$ |

The light-sensitive materials were exposed by scanning by the R, G and B light beams while the light amount was controlled stepwise so that images similar to those obtained in Example 13. Then the light-sensitive material were processed by Processing 1 in Example 1. The printed samples thus obtained were evaluated in the same manner as in Example 13. The results are shown in Tables 44 to 46. The sensitivity of the blue-sensitive layer is expressed by a value of product of −1 and the logarithm of light amount necessary to form a yellow image having a density of 0.8. The difference between the such the value of each of the light-sensitive material and the value of light-sensitive material Sample 2001 to the blue-light of 454 nm emitted from the Ar gas laser was calculated to the relative value of the blue-light sensitivity listed in Tables 44 to 46.

TABLE 44

| Sample | LED: 410 nm Sensitivity of blue-sensitive layer | Density of yellow patch Blue | Green | Red | Half value width of fine line | Score by observers | SHG: 430 nm Sensitivity of blue-sensitive layer | Density of yellow patch Blue | Green | Red | Half value width of fine line | Score by observers |
|---|---|---|---|---|---|---|---|---|---|---|---|---|
| 2001 | −0.720 | 2.08 | 1.21 | 0.26 | 113 | 61 | −0.40 | 2.06 | 0.62 | 0.13 | 96 | 86 |
| 2002 | −0.799 | 2.07 | 1.37 | 0.30 | 114 | 55 | −0.495 | 2.07 | 0.69 | 0.14 | 100 | 84 |
| 2003 | −0.672 | 2.07 | 1.12 | 0.24 | 109 | 64 | −0.352 | 2.05 | 0.59 | 0.12 | 95 | 90 |
| 2004 | −0.569 | 2.06 | 0.91 | 0.19 | 104 | 73 | −0.233 | 2.06 | 0.51 | 0.10 | 93 | 94 |
| 2005 | −0.453 | 2.07 | 0.68 | 0.14 | 100 | 81 | −0.216 | 2.07 | 0.49 | 0.10 | 92 | 93 |
| 2006 | −0.343 | 2.08 | 0.46 | 0.09 | 95 | 93 | −0.148 | 2.06 | 0.45 | 0.09 | 90 | 96 |
| 2007 | −0.454 | 2.06 | 0.68 | 0.14 | 99 | 83 | −0.204 | 2.08 | 0.49 | 0.10 | 91 | 93 |
| 2008 | −0.345 | 2.08 | 0.46 | 0.09 | 94 | 89 | −0.130 | 2.05 | 0.44 | 0.09 | 91 | 96 |
| 2009 | −0.474 | 2.06 | 0.72 | 0.15 | 101 | 80 | −0.241 | 2.06 | 0.51 | 0.10 | 92 | 90 |
| 2110 | −0.375 | 2.07 | 0.52 | 0.10 | 98 | 87 | −0.185 | 2.07 | 0.47 | 0.09 | 91 | 94 |

TABLE 45

| Sample | Ar: 454 nm Sensitivity of blue sensitive layer | Density of yellow patch Blue | Green | Red | Half value width of fine line | Score by observers | Ar: 477 nm Sensitivity of blue-sensitive layer | Density of yellow patch Blue | Green | Red | Half value width of fine line | Score by observers |
|---|---|---|---|---|---|---|---|---|---|---|---|---|
| 2001 | 0.000 | 2.05 | 0.48 | 0.11 | 89 | 94 | −0.060 | 2.05 | 0.57 | 0.11 | 88 | 95 |
| 2002 | −0.115 | 2.06 | 0.52 | 0.12 | 91 | 94 | −0.172 | 2.06 | 0.67 | 0.13 | 93 | 95 |
| 2003 | −0.021 | 2.07 | 0.49 | 0.11 | 89 | 93 | −0.150 | 2.05 | 0.65 | 0.13 | 90 | 93 |
| 2004 | 0.084 | 2.07 | 0.45 | 0.10 | 89 | 97 | −0.083 | 2.07 | 0.59 | 0.12 | 90 | 94 |
| 2005 | 0.019 | 2.07 | 0.48 | 0.11 | 88 | 94 | −0.150 | 2.07 | 0.65 | 0.13 | 90 | 96 |
| 2006 | 0.038 | 2.08 | 0.47 | 0.10 | 91 | 93 | −0.150 | 2.07 | 0.65 | 0.13 | 92 | 93 |
| 2007 | 0.024 | 2.06 | 0.47 | 0.12 | 90 | 96 | −0.149 | 2.08 | 0.66 | 0.13 | 91 | 94 |
| 2008 | 0.046 | 2.07 | 0.47 | 0.10 | 88 | 94 | −0.150 | 2.06 | 0.65 | 0.12 | 92 | 93 |
| 2009 | 0.004 | 2.07 | 0.48 | 0.11 | 91 | 93 | −0.151 | 2.06 | 0.65 | 0.14 | 92 | 96 |
| 2110 | 0.016 | 2.07 | 0.48 | 0.11 | 92 | 95 | −0.150 | 2.05 | 0.65 | 0.13 | 89 | 96 |

TABLE 46

| Sample | Density of unexposed area Blue | Green | Red | Remarks |
|---|---|---|---|---|
| 2001 | 0.072 | 0.118 | 0.082 | Inv. |
| 2002 | 0.073 | 0.112 | 0.086 | Inv. |
| 2003 | 0.072 | 0.119 | 0.083 | Inv. |
| 2004 | 0.075 | 0.116 | 0.088 | Inv. |
| 2005 | 0.071 | 0.115 | 0.088 | Inv. |
| 2006 | 0.074 | 0.118 | 0.082 | Inv. |
| 2007 | 0.073 | 0.114 | 0.084 | Inv. |
| 2008 | 0.074 | 0.118 | 0.087 | Inv. |
| 2009 | 0.073 | 0.117 | 0.086 | Inv. |
| 2010 | 0.072 | 0.119 | 0.085 | Inv. |

Inv.; Inventive

As can be seen from the results in Tables 44 to 46, the fine line width is sably a small value and an image expression with a good sharpness and little blurring can be attained in Samples 2001 through 2010 when exposed to light at 454 nm or 477 nm. Specifically, Samples 2005 to 2008, which satisfy the preferred requirements of the invention exhinited superior results even though no specific difference in the density of the unexposed area with respect to the various exposing procedure particularly when a relatively short wavelength blue-light such as 410 nm and 430 nm is used. It is understood that the green density and red density of the yellow patch image having the maximum density are stably low and a clear yellow image with little color contamination is reproduced in the high density region. Such the results are certainly reflected in the evaluation results by the observers. It is understood the foregoing results that Light-sensitive Materials 2005 to 2010 are preferable embodiment of the invention since a high print quality can be stably obtained by the various digital exposing apparatus.

Example 21

Light-sensitive material Samples 2101 through 2110 were prepared in a manner similar to Sample 104 in Example 1, except that the sensitizing dye used in the 1st layer was varied with respect to the kind and amount, as shown in Table 47.

TABLE 47

| Sample | Kind of sensitizing dye | Added amount moles/mole of AgX | Kind of sensitizing dye | Added amount moles/mole of AgX | Kind of sensitizing dye | Added amount moles/mole of Agx |
|---|---|---|---|---|---|---|
| 2101 | 1-1 | $1 \times 10^{-4}$ | 1-8 | $4 \times 10^{-4}$ | | |
| 2102 | 1-1 | $2 \times 10^{-4}$ | 1-8 | $3 \times 10^{-4}$ | | |
| 2103 | 1-1 | $5 \times 10^{-5}$ | 1-8 | $4.5 \times 10^{-4}$ | | |
| 2104 | 1-1 | $1 \times 10^{-4}$ | 1-8 | $5 \times 10^{-4}$ | | |
| 2105 | 1-1 | $1 \times 10^{-4}$ | 1-8 | $4 \times 10^{-4}$ | 10-4 | $5 \times 10^{-5}$ |
| 2106 | 1-1 | $1 \times 10^{-4}$ | 1-8 | $4 \times 10^{-4}$ | 10-4 | $1 \times 10^{-4}$ |
| 2107 | 1-1 | $1 \times 10^{-4}$ | 1-8 | $4 \times 10^{-4}$ | 10-6 | $5 \times 10^{-5}$ |
| 2108 | 1-1 | $1 \times 10^{-4}$ | 1-8 | $4 \times 10^{-4}$ | 10-6 | $1 \times 10^{-4}$ |
| 2109 | 1-1 | $1 \times 10^{-4}$ | 1-8 | $4 \times 10^{-4}$ | 10-10 | $5 \times 10^{-5}$ |
| 2110 | 1-1 | $1 \times 10^{-4}$ | 1-8 | $4 \times 10^{-4}$ | 10-10 | $1 \times 10^{-4}$ |

The light-sensitive materials were exposed by scanning by the R, G and B light beams while the light amount was controlled stepwise so that images similar to those obtained in Example 13. Then the light-sensitive material were processed by Processing 1 in Example 1. The printed samples thus obtained were evaluated in the same manner as in Example 13. The results are shown in Tables 48 to 50. The sensitivity of the blue-sensitive layer is expressed by a value of product of -1 and the logarithm of light amount necessary to form a yellow image having a density of 0.8. The difference between the such the value of each of the light-sensitive material and the value of Light-sensitive Material 2101 to the blue-light of 454 nm emitted from the Ar gas laser was calculated to the relative value of the blue-light sensitivity listed in Tables 48 to 50.

TABLE 48

| | LED: 410 nm | | | | | | SHG: 430 nm | | | | | |
|---|---|---|---|---|---|---|---|---|---|---|---|---|
| Sample | Sensitivity of blue-sensitive layer | Density of yellow patch | | | Half value width of fine line | Score by observers | Sensitivity of blue-sensitive layer | Density of yellow patch | | | Half value width of fine line | Score by observers |
| | | Blue | Green | Red | | | | Blue | Green | Red | | |
| 2101 | −0.720 | 2.07 | 1.21 | 0.26 | 110 | 60 | −0.400 | 2.06 | 0.62 | 0.13 | 98 | 86 |
| 2102 | −0.799 | 2.05 | 1.37 | 0.30 | 118 | 55 | −0.495 | 2.07 | 0.69 | 0.14 | 100 | 83 |
| 2103 | −0.672 | 2.06 | 1.12 | 0.24 | 109 | 66 | −0.352 | 2.05 | 0.59 | 0.12 | 95 | 87 |
| 2104 | −0.569 | 2.07 | 0.91 | 0.19 | 105 | 73 | −0.233 | 2.06 | 0.51 | 0.10 | 94 | 93 |
| 2105 | −0.455 | 2.07 | 0.68 | 0.14 | 100 | 84 | −0.217 | 2.05 | 0.49 | 0.10 | 92 | 92 |
| 2106 | −0.346 | 2.08 | 0.46 | 0.09 | 95 | 91 | −0.149 | 2.06 | 0.45 | 0.09 | 90 | 95 |
| 2107 | −0.453 | 2.07 | 0.68 | 0.14 | 98 | 81 | −0.206 | 2.07 | 0.49 | 0.10 | 93 | 93 |
| 2108 | −0.343 | 2.06 | 0.46 | 0.09 | 96 | 90 | −0.133 | 2.06 | 0.44 | 0.09 | 88 | 95 |
| 2109 | −0.469 | 2.05 | 0.71 | 0.14 | 100 | 82 | −0.230 | 2.05 | 0.50 | 0.10 | 93 | 93 |
| 2110 | −0.367 | 2.06 | 0.51 | 0.10 | 95 | 89 | −0.169 | 2.07 | 0.46 | 0.09 | 92 | 95 |

TABLE 49

| | Ar: 454 nm | | | | | | Ar: 477 nm | | | | | |
|---|---|---|---|---|---|---|---|---|---|---|---|---|
| Sample | Sensitivity of blue-sensitive layer | Density of yellow patch | | | Half value width of fine line | Score by observers | Sensitivity of blue-sensitive layer | Density of yellow patch | | | Half value width of fine line | Score by observers |
| | | Blue | Green | Red | | | | Blue | Green | Red | | |
| 2101 | 0.000 | 2.07 | 0.48 | 0.11 | 91 | 94 | −0.060 | 2.08 | 0.57 | 0.11 | 89 | 96 |
| 2102 | −0.115 | 2.07 | 0.52 | 0.12 | 91 | 96 | −0.172 | 2.08 | 0.67 | 0.13 | 93 | 93 |
| 2103 | −0.021 | 2.07 | 0.49 | 0.11 | 91 | 97 | −0.150 | 2.06 | 0.65 | 0.13 | 89 | 96 |
| 2104 | 0.084 | 2.06 | 0.45 | 0.10 | 89 | 94 | −0.083 | 2.05 | 0.59 | 0.12 | 91 | 94 |
| 2105 | 0.020 | 2.08 | 0.47 | 0.11 | 92 | 93 | −0.150 | 2.06 | 0.65 | 0.13 | 89 | 95 |
| 2106 | 0.041 | 2.07 | 0.47 | 0.10 | 89 | 94 | −0.150 | 2.06 | 0.64 | 0.13 | 91 | 95 |
| 2107 | 0.022 | 2.08 | 0.47 | 0.11 | 89 | 96 | −0.149 | 2.06 | 0.65 | 0.12 | 92 | 93 |
| 2108 | 0.043 | 2.07 | 0.47 | 0.10 | 89 | 93 | −0.148 | 2.05 | 0.65 | 0.13 | 90 | 96 |

TABLE 49-continued

| Sample | Ar: 454 nm Sensitivity of blue-sensitive layer | Density of yellow patch Blue | Green | Red | Half value width of fine line | Score by observers | Ar: 477 nm Sensitivity of blue-sensitive layer | Density of yellow patch Blue | Green | Red | Half value width of fine line | Score by observers |
|---|---|---|---|---|---|---|---|---|---|---|---|---|
| 2109 | 0.007 | 2.06 | 0.48 | 0.11 | 91 | 94 | −0.150 | 2.07 | 0.66 | 0.14 | 91 | 95 |
| 2110 | 0.020 | 2.07 | 0.47 | 0.11 | 91 | 97 | −0.151 | 2.07 | 0.65 | 0.13 | 93 | 96 |

TABLE 50

| Sample | Density of unexposed area Blue | Green | Red | Remarks |
|---|---|---|---|---|
| 2101 | 0.073 | 0.115 | 0.081 | Inv. |
| 2102 | 0.072 | 0.116 | 0.084 | Inv. |
| 2103 | 0.073 | 0.117 | 0.089 | Inv. |
| 2104 | 0.074 | 0.115 | 0.084 | Inv. |
| 2105 | 0.073 | 0.112 | 0.083 | Inv. |
| 2106 | 0.075 | 0.119 | 0.082 | Inv. |
| 2107 | 0.072 | 0.118 | 0.088 | Inv. |
| 2108 | 0.074 | 0.120 | 0.085 | Inv. |
| 2109 | 0.075 | 0.117 | 0.082 | Inv. |
| 2110 | 0.072 | 0.117 | 0.087 | Inv. |

Inv.; Inventive

As can be seen from the results in Tables 48 to 50, the fine line width is sably a small value and an image expression with a good sharpness and little blurring can be attained in Samples 2101 through 2110 when exposed to light at 454 nm or 477 nm. Specifically, Samples 2105 to 2108, which satisfy the preferred requirements of the invention exhinited superior results even though no specific difference in the density of the unexposed area with respect to the various exposing procedure particularly when a relatively short wavelength blue-light such as 410 nm and 430 nm is used. It is understood that the green density and red density of the yellow patch image having the maximum density are stably low and a clear yellow image with little color contamination is reproduced in the high density region. Such the results are certainly reflected in the evaluation results by the observers. It is understood the foregoing results that light-sensitive material Samples 2105 to 2110 are preferable embodiment of the invention since a high print quality can be stably obtained by the various digital exposing apparatus.

A silver halide color photographic light-sensitive material and an image forming method using the light sensitive material can be provided according to the invention, by which a high quality print, particularly a specifically colored blur at the edge of fine line is small and mixing of magenta and cyan color in the yellow image is inhibited, can be stably obtained by various digital exposing apparatus.

According to the invention, an image forming method comprising the steps of exposing a light-sensitive material according to digitized image information and processing the light-sensitive material can be provided, by which blur of fine line image is difficultly formed, the fluctuation of fine line reproducibility depending on the variation of the conditions of the exposure and processing is small, and color contamination is difficultly occurred.

Moreover, a stable print quality can be obtained by various digital exposing apparatus, particularly a specifically colored blurring of fine image such as a fine line is prevented, by the use of the light-sensitive material according to the invention.

What is claimed is:

1. An image forming method comprising the steps of subjecting a silver halide photographic light-sensitive material comprising a support having thereon an yellow color image forming layer, a magenta color image forming layer and a cyan color image forming layer each containing a silver halide emulsion to scanning exposure with a light beam so that an exposure time is not more than $10^{-3}$ second per pixel, and developing the photographic material by a color developer, wherein a maximum exposure amount ($E_{max}$) is controlled by an output of a calibration patch, and a difference between the logarithm of the exposure amount necessary to give a density of 0.3 and the logarithm of $E_{max}$ is within the range of from 0.35 to 0.6 in each of the yellow, magenta and cyan image forming layers.

2. The image forming method of claim 1, wherein said yellow image forming layer exhibits a density of not more than a limiting maximum density ($LD_{max}$) when subjected to exposure of the $E_{max}$.

3. The image forming method of claim 2, wherein a mean gradation between the $LD_{max}$ and a density given by an exposure amount 0.1 higher by logarithm than the exposure amount giving a density of the $LD_{max}$ ($LE_{max}$) is within the range of from 1.5 to 4.0 in each of the yellow, magenta and cyan image forming layers.

4. The image forming method of claim 2, wherein, in at least one of the yellow, magenta and cyan image forming layers, an exposure amount giving a density of the $LD_{max}$ ($LE_{max}$) is smaller than the $E_{max}$ and a ratio ($\gamma H/\gamma L$) of a mean gradation between the $LE_{max}$ and the $E_{max}$ ($\gamma H$) to a mean gradation between an exposure amount giving a density of ½ of the $LD_{max}$ and the $LE_{max}$ ($\gamma L$) is within the range of 0.35 to 0.9.

5. The image forming method of claim 2, wherein an exposure amount giving a density of the $LD_{max}$ ($LE_{max}$) is smaller than the $E_{max}$ in each of the yellow, magenta and cyan image forming layers, a ratio ($\gamma LY/\gamma LM$) of a mean gradation between an exposure amount giving a density of ½ of the $LD_{max}$ and the $L_{max}$ in the yellow image forming layer ($\gamma LY$) to a mean gradation between an exposure amount giving a density of ½ of the $LD_{max}$ and the $LE_{max}$ in the magenta image-forming layer ($\gamma LM$) is within the range of 0.9 to 1.2, and a ratio ($\gamma LC/\gamma LM$) of a mean gradation between an exposure amount giving a density of ½ of the $LD_{max}$ and the $LE_{max}$ ($\gamma LC$) in the cyan-image forming layer to the yLM is within the range of 0.9 to 1.35.

6. The image forming method of claim 1, wherein a ratio ($D_{max}R/D_{max}G$) of a red reflection density ($D_{max}R$) to a green reflection density ($D_{max}G$) of a black image area formed by subjecting each of the yellow, magenta and cyan image forming layers to exposure of $E_{max}$ is within the range of from 1.02 to 1.18, and a ratio ($D_{max}B/D_{max}G$) of a blue reflection density ($D_{max}B$) to $D_{max}G$ is within the range of 0.85 to 1.0.

7. The image forming method of claim 1, wherein a black image area formed by subjecting each of the yellow, magenta and cyan image forming layers to an exposure of $E_{max}$ exhibits an L* value of 12±4, an a* value of −1±2, a b* value of −5±2 and an (a*+b*) value of −6±2 in 1976 CIE L*a*b* color space.

8. The image forming method of claim 1, wherein a ratio ($LD_{max}/LD_{max}G$) of a red light reflection density ($LD_{max}R$) to a green light reflection density ($LD_{max}G$) of the black image area formed by subjecting each of the yellow, magenta and cyan image forming layers to an exposure of $LE_{max}$ giving a limiting $D_{max}$ ($LD_{max}$) is within the range of 1.02 to 1.18, and a ratio ($LD_{max}B/LD_{max}G$) of a blue light reflection density ($LD_{max}B$) to ($LD_{max}G$) is within the range of 0.85 to 1.0.

9. The image forming method of claim 1, wherein a black image area formed by subjecting each of the yellow, magenta and cyan image forming layers to an exposure giving a limiting maximum density exhibits an L* value of 15±4, an a* value of −1±2, a b* value of −5±2 and an (a*+b*) value of −6±2 in 1976 CIE L*a*b* color space.

10. The image forming method of claims 1, wherein at least one of the color image forming layers comprises a silver halide emulsion containing silver halide grains which are spectrally sensitized with at least two sensitizing dyes each exhibiting an absorption maximum different in wavelength by not less than 40 nm from each other.

11. The image forming method of claim 10, wherein said silver halide grains are blue-sensitive.

12. The image forming method of claim 1, wherein at least one of the yellow, magenta and cyan image forming layers comprises a silver halide emulsion containing silver halide grains having an average chloride content of not less than 95 mol %; and an exposure amount ($E_{max}\lambda$) necessary to give a maximum density with light at a wavelength of λ nm is formulated by the following equation (1):

$$S_\lambda = -\log(E_{max}\lambda) \quad (1)$$

wherein a difference of a maximum value of $S_\lambda$ and a minimum value of $S_\lambda$ within the range of 400 nm to 490 nm is not more than 1.3.

13. The image forming method of claim 12, wherein an average value of $S_\lambda$ over the wavelengths of from 400 to 490 nm ($S_B$) and a value of $S_\lambda$ at a wavelength of 470 nm ($S_{470}$) satisfy the following requirement (2):

$$|S_{470}-S_B| \leqq 0.55 \quad (2).$$

14. The image forming method of claim 13, wherein an average value of $S_\lambda$ over the wavelengths of from 400 to 490 nm ($S_B$) and an average value of $S_\lambda$ over the range of 510 to 570 nm ($S_G$) satisfy the following requirement (3):

$$|S_B/S_G| \leqq 0.55 \quad (3).$$

15. The image forming method of claim 12, wherein $S_\lambda$ and a spectral reflective density ($D_\lambda$) at a wavelength of λ nm are formulated by the following equation (4):

$$SD_\lambda = D_\lambda + S_\lambda \quad (4)$$

wherein a difference between a maximum value of $SD_\lambda$ and a minimum value of $SD_\lambda$ over the wavelengths of from 400 nm to 490 nm is not more than 0.9.

16. The image forming method of claim 15, wherein an average value of $SD_\lambda$ over the wavelengths of from 400 to 490 nm ($SD_B$) and a value of $SD_\lambda$ at a wavelength of 470 nm ($SD_{470}$) satisfy the following requirement (5):

$$|SD_{470}-SD_B| \leqq 0.49 \quad (5).$$

17. The image forming method of claim 15, wherein an average value of $SD_\lambda$ over the wavelengths of from 400 to 490 nm ($SD_B$) and an average value of $SD_\lambda$ over the wavelenth range of 510 to 570 rim ($SD_G$) satisfy the following requirement (6):

$$|SD_B/SD_G| \leqq 0.3 \quad (6).$$

18. The image forming method of claim 12, wherein a difference between a maximum value of $S_\lambda$ and a minimum value of $S_\lambda$ is not more than 1.1.

19. The image forming method of claim 13, wherein $S_{470}$ and $S_B$ satisfy the following requirement (7):

$$|SD_{470}-SD_B| \leqq 0.5 \quad (7).$$

20. The image forming method of claim 14, wherein $S_B$ and $S_G$ satisfy the following requirement (8):

$$|S_B/S_G| \leqq 0.44 \quad (8).$$

21. The image forming method of claim 15, wherein a difference of a maximum value of $S_\lambda$ and a minimum value of $S_\lambda$ is not more than 0.75.

22. The image forming of claim 16, wherein $SD_{470}$ and $SD_B$ satisfy the following requirement (9):

$$|SD_{470}-SD_B| \leqq 0.45 \quad (9).$$

23. The image forming method of claim 17, wherein $SD_B$ and $SD_G$ satisfy the following requirement (10):

$$|SD_B/SD_G| \leqq 0.18 \quad (10).$$

24. The image forming method of claim 1, wherein the light beam comprises a blue light emitted from a semiconductor laser emitting light of a wavelength of 390 to 430 nm or a combination of a semiconductor laser and a second harmonics generation element.

25. The image forming method of claim 1, wherein at least one of the color image forming layers comprises a silver halide emulsion containing silver halide grains having an average chloride content of not less than 95 mol% and which are spectrally sensitized with a first sensitizing dye represented by formula 1 and a second sensitizing dye exhibiting a spectral absorption maximum at a wavelength of 380 to 430 nm when the dye is added a silver halide emulsion having an average chloride content of silver chloride of not less than 95 mol% and a pAg value of 6.0 to 7.7:

Formula 1

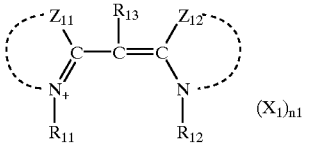

wherein $Z_{11}$ and $Z_{12}$ are each independently a group of non-metallic atoms necessary to form a benzothiazole ring, a naphthothiazole ring, a benzoselenazole ring, a naphthoselenazole ring, a benzimidazole, a naphthoimidazole, a benzoxazole or a naphthoxazole; $R_{11}$ and $R_{12}$ are each independently an alkyl group, an alkenyl group or an aryl group, $R_{13}$ is a hydrogen atom, a fluorine atom, a methyl group or an ethyl group; $X_1$ is a counter ion necessary to neutralize the charge, n1 is an integer of 0 or more necessary to neutralize the intramolecular charge; and one of $Z_{11}$ and $Z_{12}$ is naphthothiazole ring or a naphthoselenazole ring when another one of $Z_{11}$ and $Z_{12}$ is a benzimidazole ring or a benzoazole ring.

26. The image forming method of claim 25, wherein said second sensitizing dye is represented by Formula 2:

Formula 2

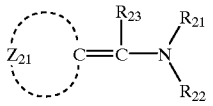

wherein $Z_{21}$ is a group of non-metallic atoms necessary to form a rhodanine ring, a 2-thiohydantoine ring, a 2-thiooxazoline-2,4-dione ring, a 2-thioselenazoline-2,4-dione ring, a barbituric acid ring, a 2-thiobarbituric acid ring or a 2-pyrazoline-5-one ring; $R_{21}$, $R_{22}$ and $R_{23}$ are each a hydrogen atom, an alkyl group, an alkenyl group or an aryl group, and $R_{21}$, $R_{22}$ and $R_{23}$ may form a ring structure by bonding with each other.

27. The image forming method of claim 25, wherein said second sensitizing dye is represented by Formula 3:

Formula 3

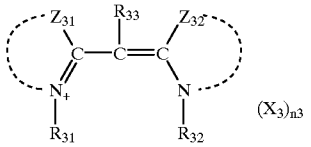

wherein $Z_{31}$ is a group of non-metallic atoms necessary to form a thiazole ring, a thiazoline ring, a thiazolidine ring, a benzothiazole ring, a naphthothiazole ring, a selenazole ring, a selenazoline ring, a selenazolidine ring, a benzoselenazole ring, a naphthoselenazole ring, an oxazole ring, an oxazoline ring, an oxazolidine ring, a benzoxazole ring, a naphthoxazole ring, an imidazole ring, an imidazoline ring, an imidazolidine ring, a benzimidazole ring, a naphthimidazole ring, a pyrrole ring, a pyrroline ring, a pyrrolidine ring, an indole ring, a pyridine ring or a quinoline ring; $Z_{32}$ is a group of non-metallic atoms necessary to form a pyrrole ring, a pyrroline ring, a pyrrolidine ring or an indole ring; $R_{31}$, and $R_{32}$ are each an alkyl group, an alkenyl group or an aryl group, $R_{33}$ is a hydrogen atom, a fluorine atom, a methyl group or an ethyl group; $X_3$ is a counter ion necessary to neutralize the charge and n3 is an integer on 0 or more necessary to neutralize the intramolecular charge.

28. The image forming method of claim 25, wherein said second sensitizing dye is represented by Formula 4:

Formula 4

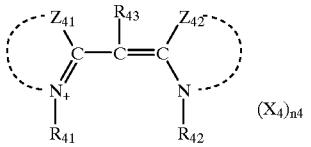

wherein $Z_{41}$ and $Z_{42}$ are each a group of non-metallic atoms necessary to form a thiazole ring, a thiazoline ring, a thiazolidine ring, a benzothiazole ring or a naphthothiazole ring, at least one of $Z_{41}$ and $Z_{42}$ is a thiazole ring, a thiazoline ring or a thiazolidine ring; $R_{41}$ and $R_{42}$ is an alkyl group, an alkenyl group or an aryl group, $R_{43}$ is a hydrogen atom, a fluorine atom, a methyl group or an ethyl group; $X_4$ is a counter ion necessary to neutralize the charge and n4 is an integer on 0 or more necessary to neutralize the intramolecular charge.

29. The image forming method of claim 25, wherein said second sensitizing dye is represented by Formula 5:

Formula 5

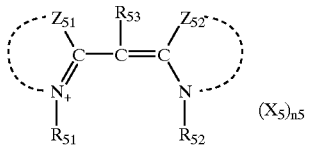

wherein $Z_{51}$ and $Z_{52}$ are each a group of non-metallic atoms necessary to form a thiazole ring, a thiazoline ring, a thiazolidine ring, a benzothiazole ring, a naphthothiazole ring, an oxazole ring, an oxazoline ring, an oxazolidine ring, a benzoxazole ring or a naphthoxazole ring, and at least one of $Z_{51}$ and $Z_{52}$ is an oxazole ring, an oxazoline ring, an oxazolidine ring, a benzoxazole ring or a naphthoxazole ring; $R_{51}$ and $R_{52}$ are each an alkyl group, an alkenyl group or an aryl group, $R_{53}$ is a hydrogen atom, a fluorine atom, a methyl group or an ethyl group; $X_5$ is a counter ion necessary to neutralize the charge and n5 is an integer on 0 or more necessary to neutralize the intramolecular charge; provided that when at least one of $Z_{51}$ and $Z_{52}$ is a naphthoxazole ring, another one is not a naphthoxazole ring, a naphthothiazole ring and benzothiazole ring, and when at least one of $Z_{51}$ and $Z_{52}$ is a napht,hothiazole ring, another one is not a benzoxazole ring.

30. The image forming method of claim 25, wherein said second sensitizing dye is represented by Formula 6:

Formula 6

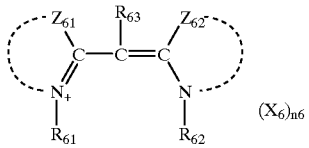

wherein $Z_{61}$ and $Z_{62}$ are each a group of non-metallic atoms necessary to form a thiazole ring, a thiazoline ring, a thiazolidine ring, a benzothiazqle ring, a naphthothiazole ring, a selenazole ring, a selenazoline ring, a selenazolidine ring, a benzoselenazole ring, a naphthoselenazole ring, an imidazole ring, an imidazoline ring, an imidazolidine ring, a benzimidazole ring, a naphthoimidazole ring, an oxazole ring, an oxazoline ring, an oxazolidine ring, a benzoxazole ring or a naphthoxazole ring, and at least one of $Z_{61}$ and $Z_{62}$ is an imidazole ring, an imidazoline ring, an imidazolidine ring, a benzimidazole ring or a naphthimidazole ring; $R_{61}$ and $R_{62}$ is an alkyl group, an alkenyl group or an aryl group, and $R_{63}$ is a hydrogen atom, a fluorine atom, a methyl group or an ethyl group; $X_6$ is a counter ion necessary to neutralize the charge and n6 is an integer on 0 or more necessary to neutralize the intramolecular charge; provided that when at least one of $Z_{61}$ and $Z_{62}$ is a naphthoimidazole ring, another one is not a naphthoxazole, a benzothiazole, a naphthothiazole, a benzoselenazole, a naphthoselenazole and a naphthoimidazole, and when at least one of $Z_{51}$ and $Z_{52}$ is a naphthothiazole ring or a naphthoselenazole ring, another one is not a benzimidazole ring.

31. The image forming method of claim 25, wherein said second sensitizing dye is represented by Formula 7, Formula 7

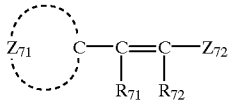

wherein $Z_{71}$ is a group of non-metallic atoms necessary to form a thiazole ring, a thiazoline ring, a thiazolidine ring, a benzothiazole ring, a naphthothiazole ring, an oxazole ring, an oxazoline ring, an oxazolidine ring,, a benzoxazole ring, a naphthoxazole ring, a selenazole ring, a selenazoline ring, a selenazolidine ring, a benzoselenazole ring, a naphthoselenazole ring, an imidazole ring, an imidazoline ring, an imidazolidine ring, a benzimidazole ring, a naphthoimidazole ring, a pyrrole ring, a pyrroline ring, a pyrrolidine ring, an indole ring, a pyridine ring or a quinoline ring, and $Z_{72}$ is a phenyl group, a cyclohexyl group, a furyl group, a pyrazolyl group or an amino group; and $R_{71}$ and $R_{72}$ are each a hydrogen atom, an alkyl group, an alkenyl group or an aryl group.

32. The image forming method of claim 25, wherein said second sensitizing dye is represented by Formula 8:

Formula 8

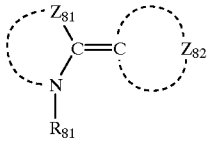

wherein $Z_{81}$ is a group of non-metallic atoms necessary to form a thiazoline ring, a thiazolidine ring, a selenazoline ring, a selenazolidine ring, a oxazoline ring, an oxazolidine ring, an imidazoline ring, an imidazolidine ring, a pyrroline ring or a pyrrolidine ring; $Z_{82}$ is a group of non-metallic atoms necessary to form a rhodanine ring, a 2-thiohydantoine ring, 2-thiooxazoline-2,4-dinoe ring, a 2-thioselenazoline-2,4-dione ring, a barbituric acid ring, a 2-thiobarbituric acid ring or a 2-pyrazoline-5-one ring; and $R_{81}$ is an alkyl group, an alkenyl group or an aryl group.

33. The image forming method of claim 25, wherein said second sensitizing dye is represented represented by Formula 9:

Formula 9

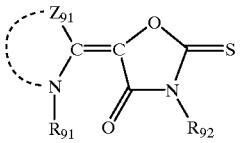

wherein $Z_{91}$ is a group of non-metallic atoms necessary to form a benzoxazole ring, a naphthoxazole ring, a benzimidazole ring, a naphthoimidazole ring, an indole ring,, a benzindole ring, a pyridine ring or a quinoline ring; and $R_{91}$ and $R_{92}$ are each an alkyl group, an alkenyl group or an aryl group.

34. The image forming method of claim 25, wherein said second sensitizing dye is represented by Formula 10:

Formula 10

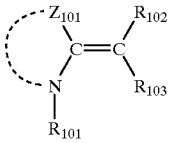

wherein $Z_{101}$ is a group of non-metallic atoms necessary to form a thiazoline ring, a thiazolidine ring, a benzothiazole ring, a naphthothiazole ring, an oxazoline ring, an oxazolidine ring, a benzoxazole ring, a naphthoxazole ring, a selenazoline ring, a selenazolidine ring, a benzoselenazole ring, a naphthoselenazole ring, an imidazoline ring, an imidazolidine ring, a benzimidazole ring, a naphthimidazole ring, a pyrroline ring, a pmrolidine ring, an indole ring, a pyridine ring or a quinoline ring; $R_{101}$ is an alkyl group, an alkenyl group or an aryl group, and $R_{102}$ and $R_{103}$ are each a hydrogen atom, an alkyl group, an alkenyl group or an aryl group; and $R_{102}$ and $R_{103}$ may be bonded to form a ring structure other than a rhodanine ring, a 2-thiohydantoine ring, a 2-thiooxazoline-2,4-dinoe ring, a 2-thioselenazoline-2,4-dione ring, a barbituric acid ring, a 2-thiobarbituric acid ring and a 2-pyrazoline-5-dione ring.

* * * * *